US007234592B2

(12) United States Patent
Ide et al.

(10) Patent No.: US 7,234,592 B2
(45) Date of Patent: Jun. 26, 2007

(54) PHOTOGRAPHIC PROCESSING AGENT CARTRIDGE AND CONTAINER USABLE THEREIN

(75) Inventors: Hiroki Ide, Odawara (JP); Kikuo Andoh, Odawara (JP); Toru Kenmotsu, Odawara (JP); Satoshi Hori, Odawara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/049,710

(22) Filed: Feb. 4, 2005

(65) Prior Publication Data

US 2005/0175338 A1 Aug. 11, 2005

Related U.S. Application Data

(63) Continuation-in-part of application No. 10/875,299, filed on Jun. 25, 2004, now abandoned, and a continuation-in-part of application No. 29/196,676, filed on Jan. 5, 2004, now Pat. No. Des. 521,389, and a continuation-in-part of application No. 29/196,675, filed on Jan. 5, 2004, now Pat. No. Des. 521,388, and a continuation-in-part of application No. 29/196,674, filed on Jan. 5, 2004, now Pat. No. Des. 518,096, and a continuation-in-part of application No. 29/196,668, filed on Jan. 5, 2004, now Pat. No. Des. 517,597, and a continuation-in-part of application No. 29/196,669, filed on Jan. 5, 2004, and a continuation-in-part of application No. 29/196,672, filed on Jan. 5, 2004, now Pat. No. Des. 520,372, and a continuation-in-part of application No. 29/196,673, filed on Jan. 5, 2004, now Pat. No. Des. 523,346, and a continuation-in-part of application No. 29/196,680, filed on Jan. 5, 2004, now Pat. No. Des. 521,390, and a continuation-in-part of application No. 29/196,704, filed on Jan. 5, 2004, now Pat. No. Des. 522,865, and a continuation-in-part of application No. 29/196,705, filed on Jan. 5, 2004, now Pat. No. Des. 520,365, and a continuation-in-part of application No. 29/196,703, filed on Jan. 5, 2004, now Pat. No. Des. 521,391.

(30) Foreign Application Priority Data

| | | |
|---|---|---|
| Jun. 27, 2003 | (JP) | 2003-184539 |
| Jun. 27, 2003 | (JP) | 2003-184540 |
| Jul. 7, 2003 | (JP) | 2003-19491 |
| Jul. 7, 2003 | (JP) | 2003-19492 |
| Jul. 7, 2003 | (JP) | 2003-19493 |
| Jul. 7, 2003 | (JP) | 2003-19494 |
| Jul. 7, 2003 | (JP) | 2003-19495 |
| Jul. 7, 2003 | (JP) | 2003-19496 |
| Jul. 7, 2003 | (JP) | 2003-19497 |
| Jul. 7, 2003 | (JP) | 2003-19498 |
| Jul. 7, 2003 | (JP) | 2003-19499 |
| Jul. 7, 2003 | (JP) | 2003-19500 |
| Jul. 7, 2003 | (JP) | 2003-19501 |

(51) Int. Cl.
*B65D 85/00* (2006.01)

(52) U.S. Cl. ..... 206/229; 206/526; 220/23.88

(58) Field of Classification Search ..... 206/229, 206/427, 526; 215/383–385; 220/23.4–23.8, 220/23.88, 669, 675; 141/2, 9, 100; 396/564, 396/617; 430/403, 466
See application file for complete search history.

(56) References Cited

U.S. PATENT DOCUMENTS

| | | | |
|---|---|---|---|
| D20,656 | S | 3/1891 | Dawes |
| D23,100 | S | 3/1894 | Fay et al. |
| D79,958 | S | 11/1929 | Wagner |
| D88,152 | S | 11/1932 | Kahn |
| D92,469 | S | 6/1934 | Humphreys |
| D130,199 | S | 10/1941 | Mamlok |
| D214,974 | S | 8/1969 | Amand |
| D237,583 | S | 11/1975 | Kemp |
| D237,861 | S | 12/1975 | Rossi |
| 3,923,184 | A | 12/1975 | Choksi et al. |
| 4,113,129 | A | 9/1978 | Cambio, Jr. |
| 4,607,756 | A | 8/1986 | Courtman |
| D289,858 | S | 5/1987 | Duval et al. |

| | | | | | |
|---|---|---|---|---|---|
| D290,225 | S | | 6/1987 | Carlson | |
| D292,267 | S | | 10/1987 | Costa | |
| 4,782,945 | A | * | 11/1988 | Geiler et al. | 206/427 |
| 5,022,547 | A | | 6/1991 | Spangler et al. | |
| 5,048,708 | A | * | 9/1991 | Musco | 220/23.4 |
| D332,373 | S | | 1/1993 | Kahl | |
| 5,178,816 | A | | 1/1993 | Suzuki et al. | |
| D351,337 | S | | 10/1994 | Bonnema et al. | |
| 5,385,250 | A | | 1/1995 | Pasquale | |
| 5,503,281 | A | * | 4/1996 | Bergner et al. | 215/12.1 |
| 5,543,884 | A | * | 8/1996 | Earle et al. | 396/626 |
| 5,582,957 | A | * | 12/1996 | Sirianni et al. | 215/383 |
| D379,309 | S | | 5/1997 | Crawford | |
| D381,903 | S | | 8/1997 | Zimmer et al. | |
| D412,087 | S | | 7/1999 | Spencer | |
| D412,664 | S | | 8/1999 | Hirst | |
| 6,183,075 | B1 | | 2/2001 | Sasaki | |
| 6,216,942 | B1 | | 4/2001 | Kittscher | |
| 6,457,602 | B2 | | 10/2002 | Uchiyama | |
| 6,505,655 | B2 | * | 1/2003 | Piccinino et al. | 141/2 |
| D470,770 | S | | 2/2003 | Machado et al. | |
| 6,520,693 | B2 | * | 2/2003 | Lobo et al. | 396/564 |
| D473,469 | S | | 4/2003 | Claessen | |
| 6,561,413 | B2 | * | 5/2003 | Colby | 206/459.1 |
| D475,296 | S | | 6/2003 | Lee | |
| 6,637,467 | B2 | * | 10/2003 | Piccinino et al. | 141/2 |
| 6,698,872 | B2 | | 3/2004 | Hou et al. | |
| D494,851 | S | | 8/2004 | Uchiyama | |
| 6,773,174 | B2 | * | 8/2004 | Call et al. | 396/626 |
| D500,681 | S | | 1/2005 | Uchiyama | |
| D501,138 | S | | 1/2005 | Uchiyama | |
| 6,951,276 | B2 | * | 10/2005 | Danner et al. | 206/229 |
| 6,959,813 | B2 | * | 11/2005 | Colby | 206/526 |
| 7,011,226 | B2 | * | 3/2006 | Uchiyama | 220/229 |
| 7,028,719 | B2 | * | 4/2006 | Danner et al. | 141/9 |
| 2003/0196984 | A1 | | 10/2003 | Uchiyama | |

FOREIGN PATENT DOCUMENTS

| | | | |
|---|---|---|---|
| JP | 4-149551 | A | 5/1992 |
| JP | 7-230155 | A | 8/1995 |
| JP | 8-137078 | A | 5/1996 |
| JP | 8-286349 | A | 11/1996 |
| JP | 9-171242 | A | 6/1997 |
| JP | 11-278467 | A | 10/1999 |
| JP | 11-282148 | | 10/1999 |
| JP | 11-305393 | A | 11/1999 |
| JP | 2000-3014 | A | 1/2000 |
| JP | 2000-275812 | A | 10/2000 |

OTHER PUBLICATIONS

Machine-assisted English translation of 9-171242.
Machine-assisted English translation of 8-137078.
Machine-assisted English translation of 8-286349.
Machine-assisted English translation of 2000-3014.
Machine-assisted English translation of 11-305393.
Machine-assisted English translation of 11-278467.
Machine-assisted English translation of 2000-275812.
Machine-assisted English translation of 7-230155.

* cited by examiner

*Primary Examiner*—Bryon P. Gehman
(74) *Attorney, Agent, or Firm*—Sughrue Mion, PLLC

(57) ABSTRACT

A cartridge for photographic processing agents, which is formed of containers for photographic processing agents and a storage box for housing the containers in any selected dispositions in the box, in which at least one of the containers is provided with at least one recess on an outer side thereof, and at least one opening is formed on the storage box corresponding to the recess of the container housed in the storage box, and in which the cartridge having the recess in the container and the opening corresponding to recess in the storage box prevents the cartridge from being erroneously loaded to an automatic photo-processor; and a container for a photographic processing agent usable in the cartridge.

16 Claims, 97 Drawing Sheets

12A
12B
12C
26
14
50
58
64
78
80
82
84
90
140
142
143
144
145
146
147
148

PHOTOGRAPHIC PROCESSING AGENT CARTRIDGE AND CONTAINER USABLE THEREIN

CROSS REFERENCE TO RELATED APPLICATIONS

This application is a Continuation-In-Part of (i) Utility application Ser. No. 10/875,299, filed Jun. 25, 2004, (ii) Design Application Ser. No. 29/196,676 filed Jan. 5, 2004, now U.S. Design Pat. No. D521,389 (iii) Design Application No. 29/196,675 filed Jan. 5, 2004, now U.S. Design Pat. No. D521,388 (iv) Design Application No. 29/196,674 filed Jan. 5, 2004, now U.S. Design Pat. No. D518,096 (v) Design Application No. 29/196,668 filed Jan. 5, 2004, now U.S. Design Pat. No. D517,597 (vi) Design Application No. 29/196,669 filed Jan. 5, 2004, (vii) Design Application No. 29/196,672 filed Jan. 5, 2004, now U.S. Design Pat. No. D520,372 (viii) Design Application No. 29/196,673 filed Jan. 5, 2004, now U.S. Design Pat. No. D523,346 (ix) Design Application No. 29/196,680 filed Jan. 5, 2004, now U.S. Design Pat. No. D521,390 (x) Design Application No. 29/196,704 filed Jan. 5, 2004, now U.S. Design Pat. No. D522,865 (xi) Design Application No. 29/196,705 filed Jan. 5, 2004 now U.S. Design Pat. No. D520,365 and (xii) Design Application No. 29/196,703 filed Jan. 5, 2004, now U.S. Design Pat. No. D521,391 the above-noted applications incorporated herein by reference in their entirety.

FIELD OF THE INVENTION

The present invention relates to a cartridge for photographic processing agents. More particularly, the present invention relates to a cartridge for photographic processing agents formed of a set of plural containers, each of which is filled with a different kind of the photographic processing agent, such as a developing solution, a bleaching solution, and a fixing solution, so that the cartridge can supply the photographic processing agents at one time to an automatic photo-processor. Further, the present invention relates to a container for photographic processing agents, which container is usable in the above cartridge for photographic processing agents.

BACKGROUND OF THE INVENTION

In the automatic photo-processors having such functions as a film processor for subjecting films to development and a printer processor for outputting film images as a print, different kinds of plural photographic processing agents or processing chemicals are used during the processing steps such as developing, bleaching, and fixing. In general, the photographic processing agents are contained in specific containers, and distributed to a processing station lab. The containers for photographic processing agents are installed in the automatic photo-processor by an operator to supply or refill (replenish) photographic processing agents to said processor. Recently, in order to supply the photographic processing agents by the operator simply and cleanly to the automatic photo-processor, the cartridge system which is capable of exchanging a set of plural containers (each containing a different kind of the photographic processing agent) for another set of containers, has become the most popular and used frequently.

For example, in a conventional cartridge 200 for photographic processing agents shown in FIGS. 26 and 27, containers 202 for photographic processing agents (202A, 202B and 202C) are filled with processing solutions such as a developing solution, a bleaching solution, and a fixing solution, respectively, and the three containers 202 making a set are held in a rectangular storage box (corrugated cardboard box) 204. Each container 202 is made of plastic and is formed in a tetragonal bottle shape as shown in FIGS. 28 to 30. The container is provided with a cap 206 and a packing 208 to close a mouth to prevent the photographic processing agents from leaking out of the container.

The cartridge 200 for the photographic processing agents is installed in a cartridge loading chamber of the automatic photo-processor manually by an operator, turning mouths (the cap 206 and the packing 208) of the containers 202 downwards. When the loading is completed, a penetrating member, which is a washing nozzle mounted on the automatic photo-processor corresponding to each container 202, pushes the packing 208 to tear so that the photographic processing agents can drain away from the containers and are supplied to the automatic photo-processor. Then, the inside of the container 202 for photographic processing agents is washed with a cleaning solution sprayed upwards out of the washing nozzle, and each photographic processing agent is diluted to a desired concentration by mixing together with the cleaning solution. In this cartridge system, three kinds of the photographic processing agents, such as a developing solution, a bleaching solution, and a fixing solution, can be simply and cleanly supplied to the automatic photo-processor at one time, with the operator not touching the containers and the photographic processing agents.

And, there is also another cartridge intended for a set of two kinds of photographic processing agents, which can be smaller in size and holds two containers smaller than the container 202. While, there is proposed a new cartridge system made of plural cartridges, which are same in size, each of which contains three kinds of the photographic processing agents different in compositions adaptable to the automatic photo-processor to be used. In order not to lead the cartridge for the photographic processing agents from being erroneously loaded to the automatic photo-processor of a different model, cutouts, for example, two cutouts 212 disposed asymmetrically in FIG. 26, are formed on the upper part of a front face 210 of the box 204. The number and arrangement of cutouts on the cartridge are variable depending upon automatic photo-processor to be used. The automatic photo-processor is provided with protrusions for engaging with the cutouts so that an operator can determine whether or not the cartridge for photographic processing agents is properly installed in the automatic photo-processor judging from the engagement of the protrusions to the corresponding cutouts (see, for example, JP-A-11-282148 ("JP-A" means unexamined published Japanese patent application), pages 5 to 7 and 9, and FIGS. 1 and 5).

In the cartridge 200 for photographic processing agents, the cutouts 212, openings or the like engaging with the protrusions of the automatic photo-processor are limited to form on the upper end of the storage box 204 of which inside is empty. Accordingly, toward the prevention of erroneous loading, not so many patterns can be formed on the cartridge, that is made use of by the member of cutouts 212, openings or the like and differences in the location of the cutouts 212, opening or the like. Since there were not so many kinds of the cartridges for photographic processing agents before, the conventional cartridge explained above did not create problems. However, it is expected that the kind of cartridges for photographic processing agents will be increased as the kind of the automatic photo-processor increases. Accordingly, a new cartridge capable of providing a larger number of simple patterns toward the prevention of erroneous loading has been demanded.

According to one of the new cartridge under manufacturing as an experiment at present, for example, a guide portion for engaging with the protrusions of the automatic photo-processor is formed of recesses disposed on an outer side face of the containers for photographic processing agents and openings arranged on a cartridge of the containers corresponding to the recesses of the containers. The number and the arrangement of the guide portion for engaging can alter such that the number and arrangement of the openings on the cartridge are variable depending upon an orientation of housing the containers in the cartridge to have the recesses of the container directed to a predetermined arrangement in the cartridge. However, this cartridge is not satisfactory in that a washing liquid is interrupted by the recesses protruded into an inside of the container depending upon such conditions as the location and depth (size) of the recesses disposed on the container when the container is washed, and the washing liquid is not distributed in every nook and corner of the inside of the container. As a result, the cleaning capacity of the container is decreased, which is another problem.

SUMMARY OF THE INVENTION

The present invention resides in a cartridge for photographic processing agents capable of forming a variety of patterns easily on the cartridge to prevent the cartridge from being erroneously loaded to an automatic processor.

At the same time, the present invention resides in a container for a photographic processing agent satisfactorily capable of washing the inside of the container not interrupted by a recess disposed on the container to prevent the container from being erroneously loaded to the automatic processor.

According to the present invention, a cartridge for photographic processing agents comprises: plural containers, each of which is filled with a different kind of photographic processing agent; and a holding member for making a set of the plural containers. The cartridge for photographic processing agents is loaded into a cartridge loading chamber mounted in an automatic photo-processor, to supply the different kind of photographic processing agents to the automatic photo-processor. At least one of the plural containers has at least one recess formed on an outer surface of the container by being partially deformed to form a concave portion on said surface. The at least one recess is engageable with at least one guide protrusion arranged in the cartridge loading chamber.

In the cartridge of the present invention, the recess is formed on at least one of plural containers, each of which is filled with the different kind of photographic processing agent, by partially deforming the outer surface of the container. The plural containers are aggregated together by the holding member to make a set so that the cartridge for photographic processing agents is prepared. When the cartridge is installed in the automatic photo-processor, it is confirmed whether or not the recess formed to at least one of plural containers can be engaged with the guide protrusion arranged in the cartridge loading chamber in the automatic photo-processor. Thus, an erroneous loading of the cartridge for photographic processing agents can be prevented.

The number of recesses in the cartridge is variable depending upon the number of containers having the recess (es) or the number of the recesses disposed in the container(s). In other words, the number of recesses in the cartridge is variable, if the plural containers, each of which has a different number of recesses, are used. In order to change the locations of the recesses in the cartridge, the containers are disposed in a different manner when a container set is prepared with the holding member. Alternately, the location of the recess on the outer surface of the container may be changed. In other words, the location of the recesses in the cartridge is variable, if the plural containers, each of which has the recess at a different position of the outer surface of the container, is used. By combining the recesses variable in number and arrangement, a large number of erroneous loading prevention patterns can be prepared. In addition, the erroneous loading prevention pattern made of the combination in the number and arrangement of recesses can be prepared by using the containers and the holding members applied to the conventional cartridge, without using additional members. According to the present invention, it is possible to provide easily a larger number of patterns toward prevention of erroneous loading with the cartridge for photographic processing agents.

In the cartridge for photographic processing agents according to the present invention, the holding member can be a box in which the plural containers are stored. The box is provided with an opening(s) corresponding to the recess (es) of the containers stored in the box.

According to the present invention, when the cartridge for photographic processing agents is prepared by housing the plural containers in the box, the recess formed in at least one of containers is aligned with the opening in the box. In order to prevent the cartridge for photographic processing agents from being erroneously loaded into the automatic photo-processor, it is confirmed whether or not the recess of the container or opening of the box can be engaged with the guide protrusion arranged in the cartridge loading chamber of the automatic photo-processor. According to the present invention, a large number of patterns toward prevention of erroneous loading can be easily prepared by providing different in number and location of openings with the storage box, corresponding to the number and arrangement of recesses in the containers.

In the cartridge for photographic processing agents according to the present invention, the holding member can be a tie binding the plural containers together.

According to the present invention, the cartridge for photographic processing agents can be prepared by fastening or wrapping the plural containers, for example, with tapes or a film material. The binding materials, such as tapes or films are advantageous in reducing the cartridge production costs. Plastic binding materials are preferable, because it can be recycled.

In the cartridge for photographic processing agents according to the present invention, the container provided with the recess(es) can be stored in the box so as to have the recess in the container directed to a predetermined direction selected from plural directions for housing containers in which arrangement direction of recess(es) is different each other.

In the cartridge of the present invention, when the container having the recess is stored in the box, it is possible to store the containers in any selected dispositions in the box so as to have the recess in the container directed to a predetermined direction of the box.

The container is stored at one of the plural storage dispositions. Thus, the number and arrangement of the recesses can be easily modified at the time of forming the patterns preventing erroneous loading. For example, it is possible to form a larger recess different from the single recess, by using the plural containers having each recess confronted each other. In this manner, a further variety of patterns towards prevention of erroneous loading can be formed.

In the cartridge for photographic processing agents according to the present invention, each of the containers may be of a polygonal bottle shaped or a cylindrical.

In the cartridge of the present invention, when the container is a polygonal bottle shape, the recess can be easily formed on an outer side face that is a part of the outer surface thereof, and the erroneous loading prevention pattern can be formed using the recess. When the container is a cylindrical shape, the recess can be easily formed on an outer peripheral surface that is a part of the outer surface thereof, and the pattern toward prevention of erroneous loading can be formed using the recess.

In the cartridge for photographic processing agents according to the present invention, the polygonal bottle shaped container may be of a tetragonal bottle shape having four outer side faces that are a part of the container's outer surface, and the recess is formed on at least one face of the four outer side faces.

According to the photographic processing agent cartridge of the present invention, by making the container to have the tetragonal bottle shape, dead spaces around the containers stored in the box or between each container and the box can be reduced. By forming one recess in any one of the four outer side faces of the tetragonal bottle shape container, it is possible to suppress the volume reduction of the container as compared with the formation of plural recesses. Furthermore, when the container is stored in the box, the orientation of the recess can be selected from the four storage dispositions of container different in the recess arrangement each other.

In the cartridge for photographic processing agents according to the present invention, the plural containers may have the same structure of container each other.

The plural containers of the same structure made of the same material and having the same shape, i.e. by using only one kind of container in the cartridge of the present invention, permits manufacturing control of the containers and the cartridge for photographic processing agents to be effected easily, and the production costs can be reduced.

In the cartridge for photographic processing agents according to the present invention, the cartridge comprises at least one container in the shape of a bottle having an elongated body, a bottom, a shoulder, and a relatively narrow neck having a mouth at the terminating end thereof. The container is provided with at least one recess on an outer side face of the container for preventing the cartridge from erroneously loading in an automatic photo-processor, and said container is filled with a photographic processing agent therein. The cartridge is installed in a cartridge loading chamber of the automatic photo-processor by turning the mouth of said container down so as to discharge and supply the photographic processing agent to the automatic photo-processor. The mouth is sealed by a packing, into which a washing nozzle mounted on the automatic photo-processor is penetrated, so as to drain the photographic processing agent filled in the container to supply said agent with said automatic photo-processor when the cartridge is installed in the cartridge loading chamber of the automatic photo-processor. The washing nozzle sprays a washing liquid for washing the inside of the container. The recess is disposed at a position above ⅓ of the height of the outer side face of the container measured from the bottom of the container, and the recess has the maximum depth of ½ or less of the width of the container in the horizontal cross section. The recess may have a curved surface in the vertical cross section.

According to the present invention, the container for a photographic processing agent, which comprises: a mouth; and a packing by which said mouth is sealed, in which said container is capable of draining and supplying a photographic processing agent filled in said container with an automatic photo-processor when said container is installed in said automatic photo-processor by turning said mouth of said container down and into said mouth a washing nozzle mounted on said automatic photo-processor is penetrated through said packing, and an inside of said container is washed by a washing liquid sprayed from said washing nozzle, wherein said container has at least one recess on an outer side face of said container for preventing said container from erroneously loading in said automatic photo-processor, said at least one recess being shaped with said outer side face of said container to form partially a concave portion, and wherein said at least one recess is disposed at a position above ⅓ of the height of said outer side face of said container measured from a bottom of said container, and said at least one recess has the maximum depth of ½ or less of the width of said container in the horizontal cross section.

According to the present invention, the container is filled with the photographic processing agent and the mouth of the container is closed and sealed by the packing member. When the container is installed in the automatic photo-processor by directing the mouth of the container downward, the packing member is penetrated by the washing nozzle mounted on the automatic photo-processor to drain the photographic processing agent filled in the container for supplying said agent with the automatic photo-processor. As supplying the photographic processing agent, the inside of the container is washed by the washing liquid sprayed from the washing nozzle so that the photographic processing agent remaining in the container can be used up and the photographic processing agent is diluted to a predetermined concentration.

In the photographic processing agent container, at least one recess is provided on an outer side face of the container for preventing the container from erroneously loading in an automatic photo-processor, the recess being formed by partially deforming the outer side face of the container to form a concave portion as the recess. The recess is disposed at a position above ⅓ of the height of the outer side face of the container measured from the bottom of the container, and the recess has the maximum depth of ½ or less of the width of the container in the horizontal cross section.

According to the present invention, the recess for preventing the container and the cartridge from erroneously loading in the automatic photo-processor is not obstructive to the washing liquid sprayed from the washing nozzle at the time of washing the container, thereby to permit the washing liquid to distribute in every nook and corner of the bottom side of the container. The photographic processing agent remaining in the bottom side of the container is rinsed away by the washing liquid and supplied to the automatic photo-processor. Thus, the washing performance in the inside of the container is not deteriorated by the recess for preventing the cartridge from erroneously loading in the automatic photo-processor.

In the photographic processing agent cartridge of the present invention or in the photographic processing agent container of the present invention that can be used in said cartridge, the recess in the container preferably has a curved surface in the vertical cross section thereof. The recess having the curved surface in the vertical cross section permits the mixed liquid of the photographic processing agent and the washing liquid satisfactorily to flow down from the upper part (bottom side) of the recess to the mouth of the container through the recess.

Other and further features and advantages of the invention will appear more fully from the following description, taken in connection with the accompanying drawings.

BRIEF DESCRIPTION OF THE DRAWINGS

FIG. 31-1 is a perspective view of a modified embodiment of a container according to the present invention;

FIG. 31-2 is a front view of the container of FIG. 31-1, the rear view being a mirror image;

FIG. 31-3 is a left side view of the container of FIG. 31-1;

FIG. 31-4 is a right side view of the container of FIG. 31-1;

FIG. 31-5 is a top view of the container of FIG. 31-1;

FIG. 31-6 is a bottom view of the container of FIG. 31-1;

FIG. 31-7 is an A—A cross-sectional view of the container of FIG. 31-1;

FIG. 31-8 is a B—B cross-sectional view of the container of FIG. 31-1;

FIG. 31-9 is a reference view of the containers of FIG. 31-1 in a cartridge box (hereinafter also referred to as a storage box);

FIG. 31-10 is a reference view showing the containers of FIG. 31-1, enclosed in a cartridge box, in actual use;

FIG. 32-1 is a perspective view of a modified embodiment of a container according to the present invention;

FIG. 32-2 is a front view of the container of FIG. 32-1, the rear view being a mirror image;

FIG. 32-3 is a left side view of the container of FIG. 32-1;

FIG. 32-4 is a right side view of the container of FIG. 32-1;

FIG. 32-5 is a top view of the container of FIG. 32-1;

FIG. 32-6 is a bottom view of the container of FIG. 32-1;

FIG. 32-7 is an A—A cross-sectional view of the container of FIG. 32-1;

FIG. 32-8 is a B—B cross-sectional view of the container of FIG. 32-1;

FIG. 32-9 is a reference view of the containers of FIG. 32-1 in a cartridge box;

FIG. 33-1 is a perspective view of a modified embodiment of a cartridge according to the present invention;

FIG. 33-2 is a front view of the cartridge of FIG. 33-1, the rear view being a mirror image;

FIG. 33-3 is a left side view of the cartridge of FIG. 33-1;

FIG. 33-4 is a right side view of the cartridge of FIG. 33-1;

FIG. 33-5 is a top view of the cartridge of FIG. 33-1;

FIG. 33-6 is a bottom view of the cartridge of FIG. 33-1;

FIG. 33-7 is a perspective view of a cartridge box for the cartridge of FIG. 33-1;

FIG. 33-8 is a front view of the cartridge box of FIG. 33-7, the rear view being a mirror image;

FIG. 33-9 is a left side view of the cartridge box of FIG. 33-7;

FIG. 33-10 is a right side of the cartridge box of FIG. 33-7;

FIG. 33-11 is a top view of the cartridge box of FIG. 33-7;

FIG. 33-12 is a bottom view of the cartridge box of FIG. 33-7;

FIG. 33-13 is a perspective view of a container for the cartridge of FIG. 33-1;

FIG. 33-14 is a reference view of the containers of FIG. 33-13 in the cartridge box of FIG. 33-7;

FIG. 34-1 is a perspective view of a modified embodiment of a cartridge according to the present invention;

FIG. 34-2 is a front view of the cartridge of FIG. 34-1, the rear view being a mirror image;

FIG. 34-3 is a left side view of the cartridge of FIG. 34-1;

FIG. 34-4 is a right side view of the cartridge of FIG. 34-1;

FIG. 34-5 is a top view of the cartridge of FIG. 34-1;

FIG. 34-6 is a bottom view of the cartridge of FIG. 34-1;

FIG. 34-7 is a perspective view of a cartridge box for the cartridge of FIG. 34-1;

FIG. 34-8 is a front view of the cartridge box of FIG. 34-7, the rear view being a mirror image;

FIG. 34-9 is a left side view of the cartridge box of FIG. 34-7;

FIG. 34-10 is a right side view of the cartridge box of FIG. 34-7;

FIG. 34-11 is a top view of the cartridge box of FIG. 34-7;

FIG. 34-12 is a bottom view of the cartridge box of FIG. 34-7;

FIG. 34-13 is a perspective view of a container for the cartridge of FIG. 34-1;

FIG. 34-14 is a reference view of the container of FIG. 34-13 in the cartridge box of FIG. 34-7;

FIG. 35-1 is a perspective view of a modified embodiment of a cartridge according to the present invention;

FIG. 35-2 is a front view of the cartridge of FIG. 35-1, the rear view being a mirror image;

FIG. 35-3 is a right side view of the cartridge of FIG. 35-1, the left side view being identical;

FIG. 35-4 is a top view of the cartridge of FIG. 35-1;

FIG. 35-5 is a bottom view of the cartridge of FIG. 35-1;

FIG. 35-6 is a perspective view of a cartridge box for the cartridge of FIG. 35-1;

FIG. 35-7 is a front view of the cartridge box of FIG. 35-6, the rear view being a mirror image;

FIG. 35-8 is a right side view of the cartridge box of FIG. 35-6, the left side view of the cartridge box being identical;

FIG. 35-9 is a top view of the cartridge box of FIG. 35-6;

FIG. 35-10 is a bottom view of the cartridge box of FIG. 35-6;

FIG. 35-11 is a reference view of the containers of FIG. 32-1 in the cartridge box of FIG. 35-6;

FIG. 36-1 is a perspective view of a modified embodiment of a container according to the present invention;

FIG. 36-2 is a front view of the container of FIG. 36-1, the rear view being identical;

FIG. 36-3 is a left side view of the container of FIG. 36-1, the right side view being identical;

FIG. 36-4 is a top view of the container of FIG. 36-1;

FIG. 36-5 is a bottom view of the container of FIG. 36-1;

FIG. 36-6 is an A—A cross-sectional view of the container of FIG. 36-1;

FIG. 36-7 is a B—B cross-sectional view of the container of FIG. 36-1;

FIG. 36-8 is a reference view of the containers of FIG. 36-1 in a cartridge box;

FIG. 37-1 is a perspective view of a modified embodiment of a container according to the present invention;

FIG. 37-2 is a front view of the container of FIG. 37-1;

FIG. 37-3 is a rear view of the container of FIG. 37-1;

FIG. 37-4 is a left side view of the container of FIG. 37-1;

FIG. 37-5 is a right side view of the container of FIG. 37-1;

FIG. 37-6 is top view of the container of FIG. 37-1;

FIG. 37-7 is a bottom view of the container of FIG. 37-1;

FIG. 37-8 is an A—A cross-sectional view of the container of FIG. 37-1;

FIG. 37-9 is a B—B cross-sectional view of the container of FIG. 37-1;

FIG. 37-10 is a reference view of the containers of FIG. 37-1 in a cartridge box;

FIG. 38-1 is a perspective view of a modified embodiment of a container according to the present invention;

FIG. 38-2 is a front view of the container of FIG. 38-1, the rear view, the left side view, the right side view being identical;

FIG. 38-3 is a top view of the container of FIG. 38-1;

FIG. 38-4 is a bottom view of the container of FIG. 38-1;

FIG. 38-5 is an A—A cross-sectional view of the container of FIG. 38-1;

FIG. 38-6 is a B—B cross-sectional view of the container of FIG. 38-1;

FIG. 38-7 is a reference view of the containers of FIG. 38-1 in a cartridge box;

FIG. 39-1 is a perspective view of a modified embodiment of a container according to the present invention;

FIG. 39-2 is a front view of the container of FIG. 39-1, the rear view, the left side view, the right side view being identical;

FIG. 39-3 is a top view of the container of FIG. 39-1;

FIG. 39-4 is a bottom view of the container of FIG. 39-1;

FIG. 39-5 is an A—A cross-sectional view of the container of FIG. 39-1;

FIG. 39-6 is a B—B cross-sectional view of the container of FIG. 39-1;

FIG. 39-7 is a reference view of the containers of FIG. 39-1 in a cartridge box;

FIG. 40-1 is a perspective view of a modified embodiment of a container according to the present invention;

FIG. 40-2 is a front view of the container of FIG. 40-1, the rear view being a mirror image;

FIG. 40-3 is a left side view of the container of FIG. 40-1;

FIG. 40-4 is a right view of the container of FIG. 40-1;

FIG. 40-5 is a top view of the container of FIG. 40-1;

FIG. 40-6 is a bottom view of the container of FIG. 40-1;

FIG. 40-7 is an A—A cross-sectional view of the container of FIG. 40-1;

FIG. 40-8 is a B—B cross-sectional view of the container of FIG. 40-1;

FIG. 40-9 is a reference view of the containers of FIG. 40-1 in a cartridge box;

FIG. 41-1 is a perspective view of a modified embodiment of a container according to the present invention;

FIG. 41-2 is a front view of the container of FIG. 41-1, the rear view being a mirror image;

Figure 1:
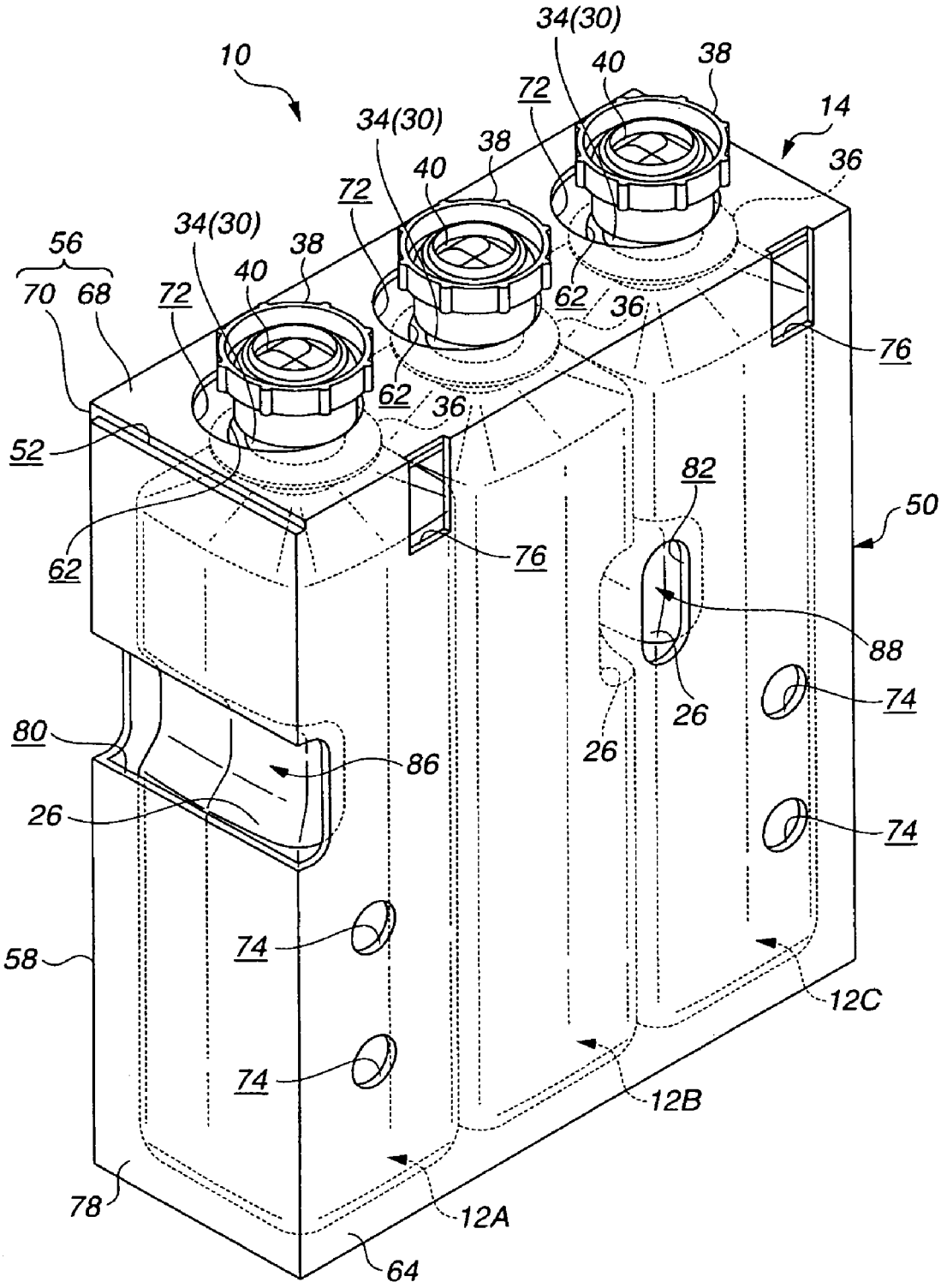
FIG. 1 is a perspective view of a cartridge for photographic processing agents looking from the front face side according to a first embodiment of the present invention.
Figure 3:
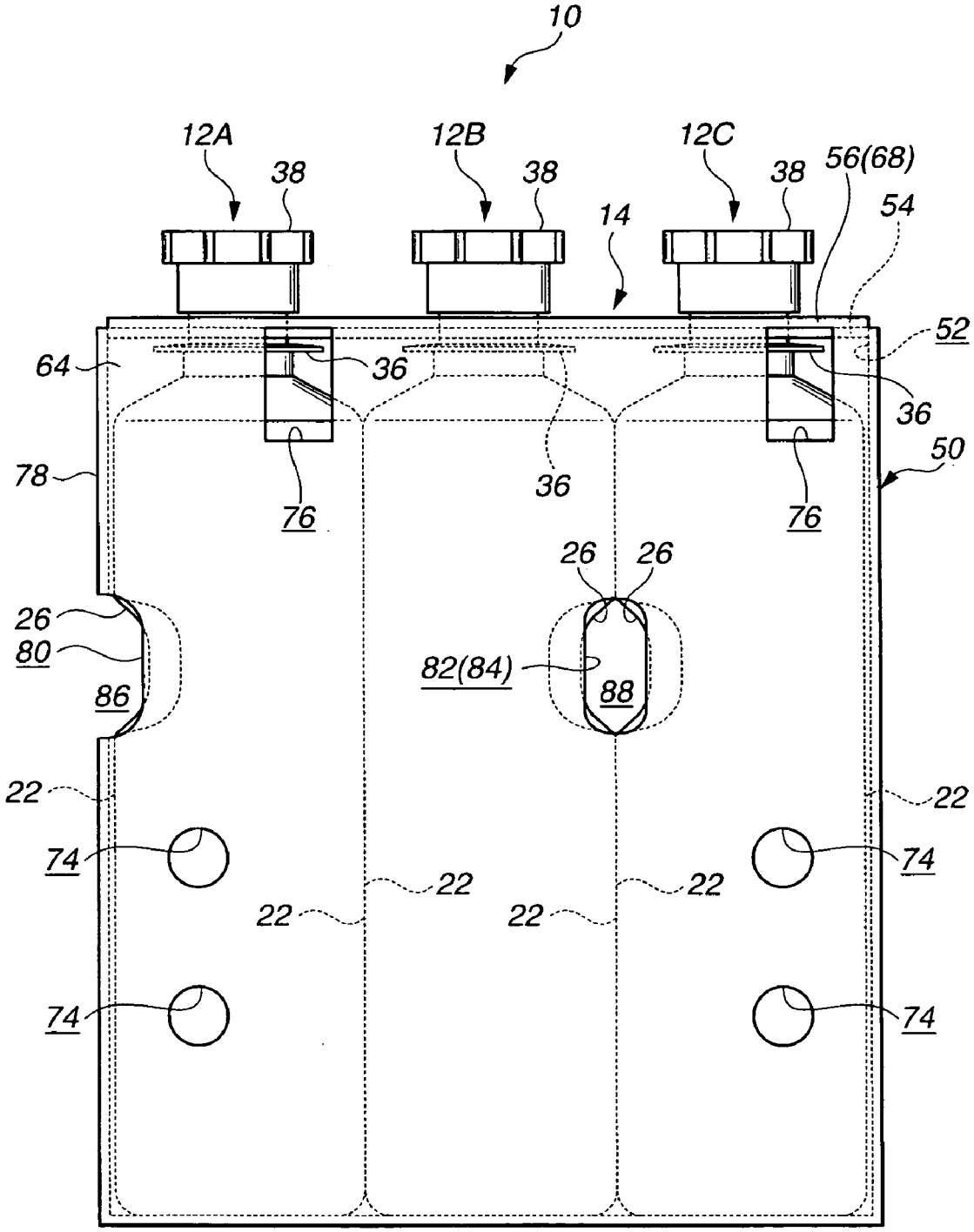
FIG. 3 is a front view of the cartridge for photographic processing agents according to the first embodiment of the present invention.
Figure 4:
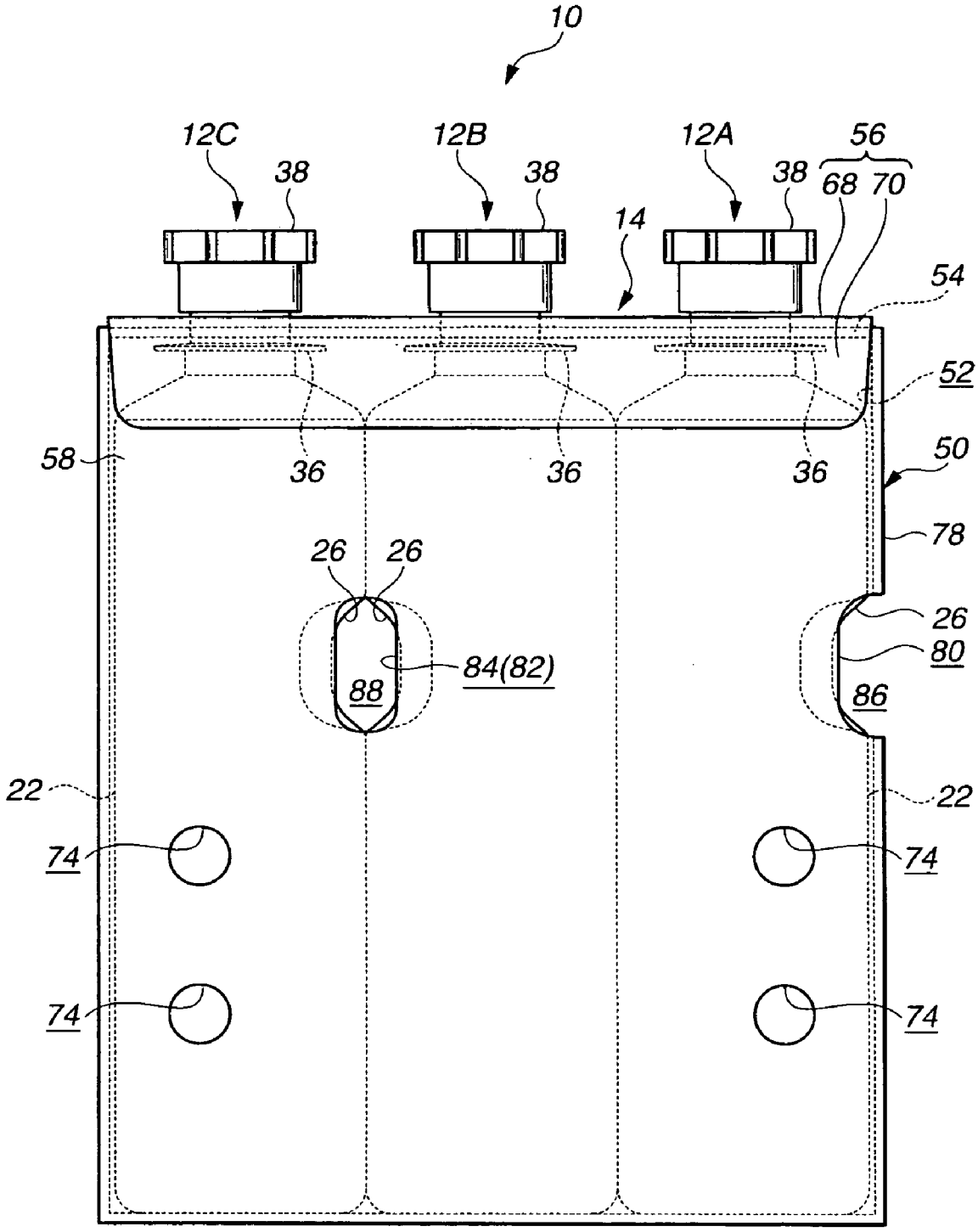
FIG. 4 is a rear view of the cartridge for photographic processing agents according to the first embodiment of the present invention.
Figure 5:
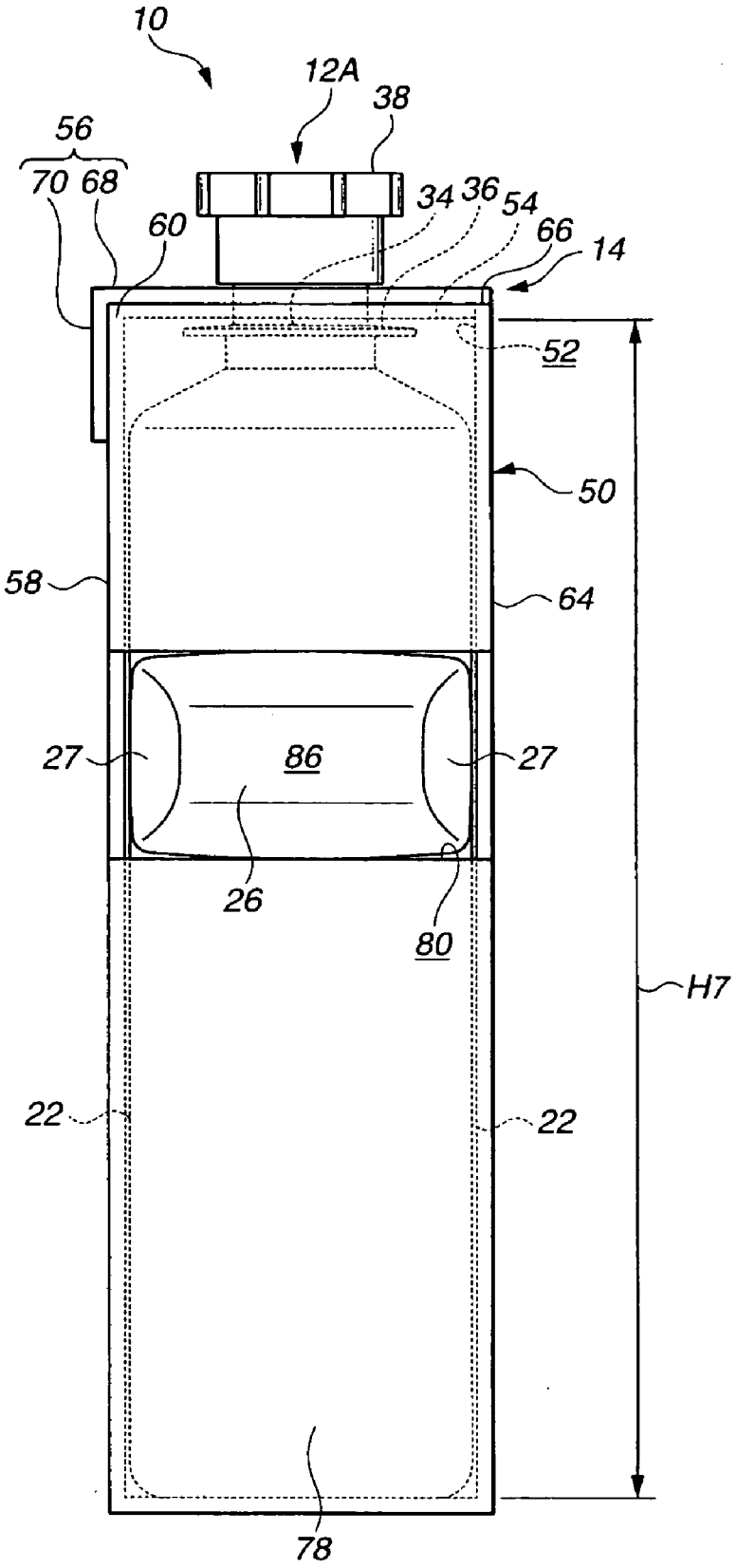
FIG. 5 is a left side view of the cartridge for photographic processing agents according to the first embodiment of the present invention.
Figure 6:
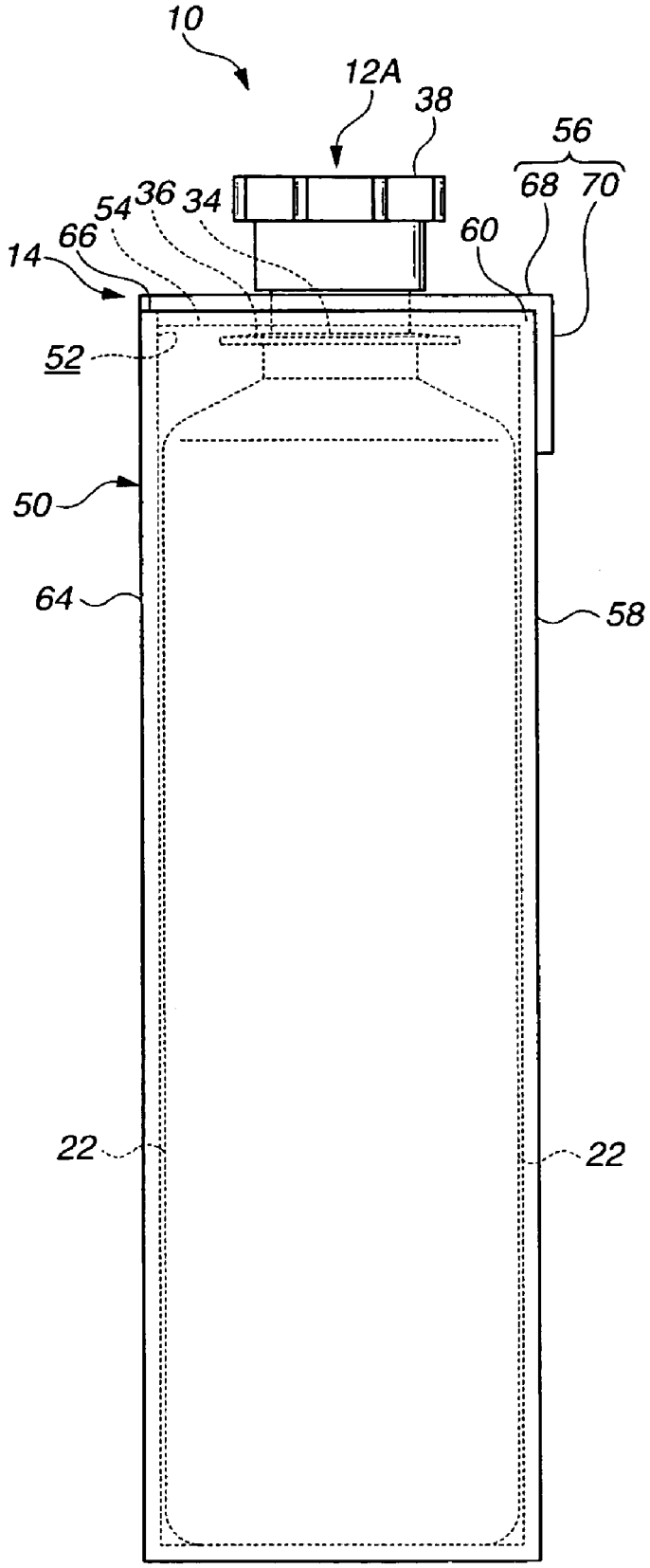
FIG. 6 is a right side view of the cartridge for photographic processing agents according to the first embodiment of the present invention.
Figure 7:
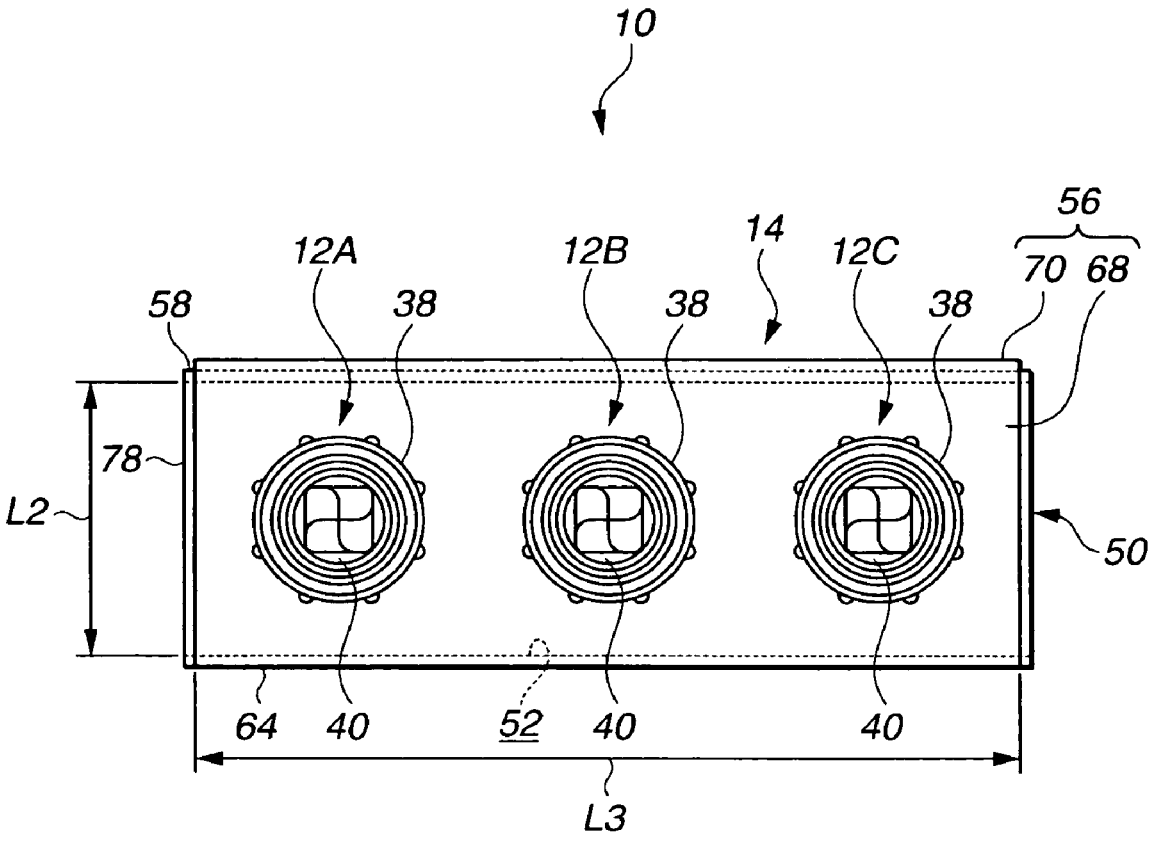
FIG. 7 is a plane view of the cartridge for photographic processing agents according to the first embodiment of the present invention.
Figure 8:
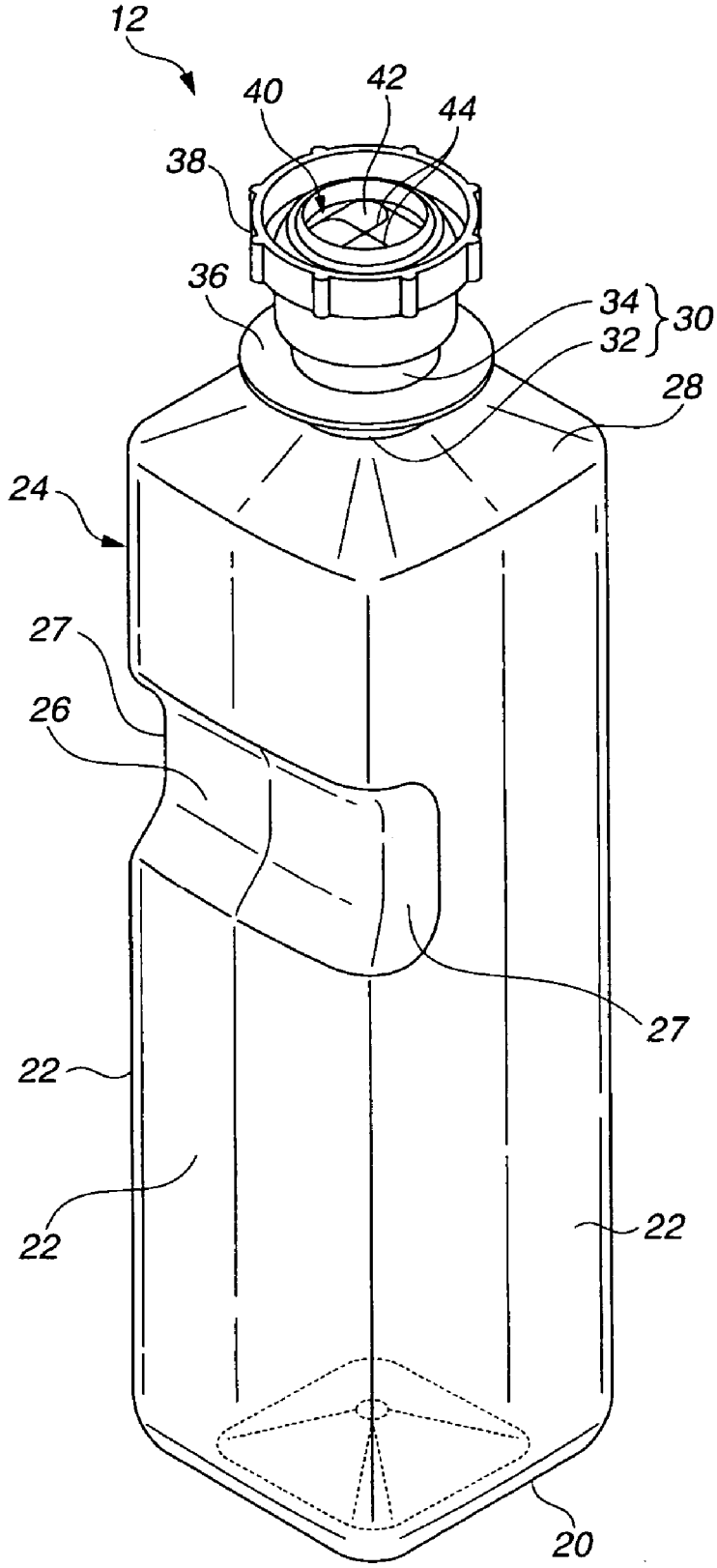
FIG. 8 is a perspective view of a container for a photographic processing agent looking from the left side of the front face according to the first embodiment of the present invention.
Figure 9:
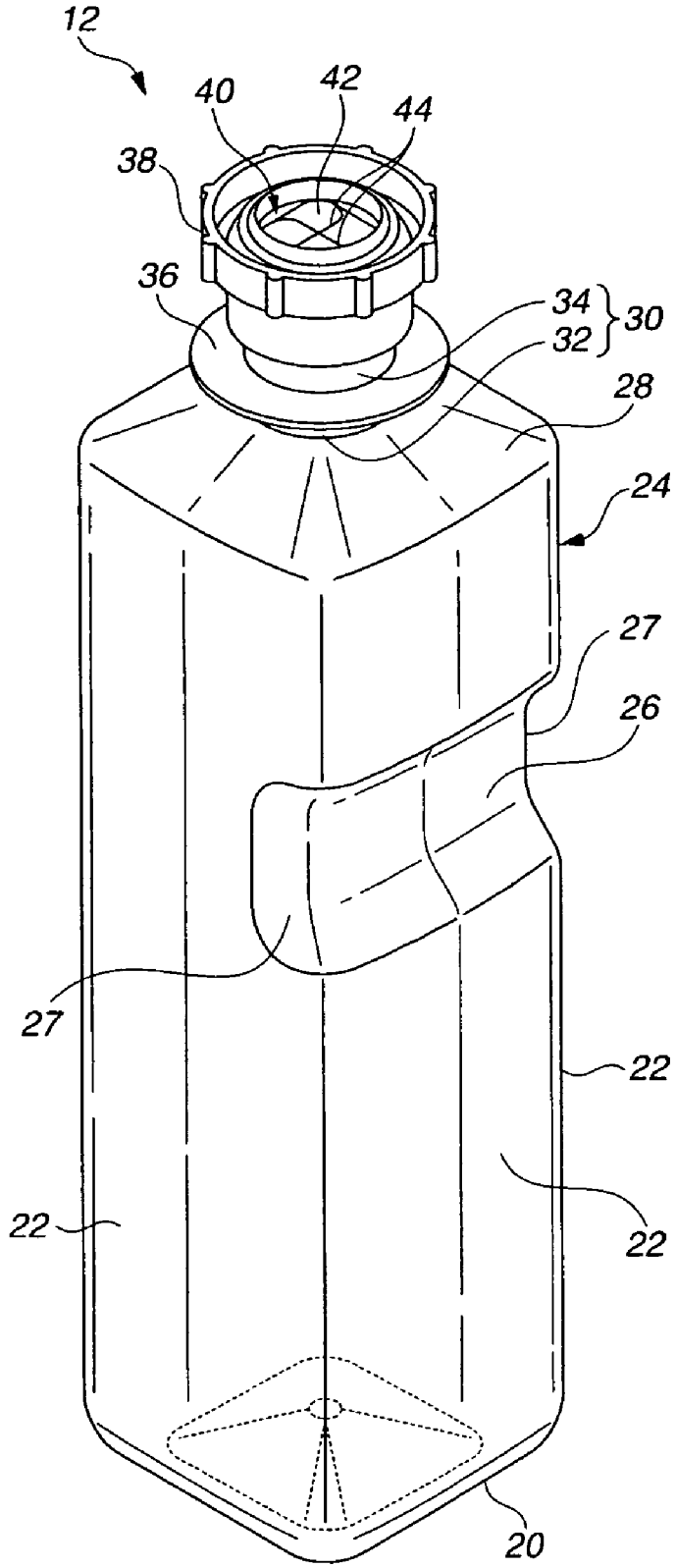
FIG. 9 is a perspective view of the container for a photographic processing agent looking from the right side of the front face according to the first embodiment of the present invention.
Figures 1, 41:
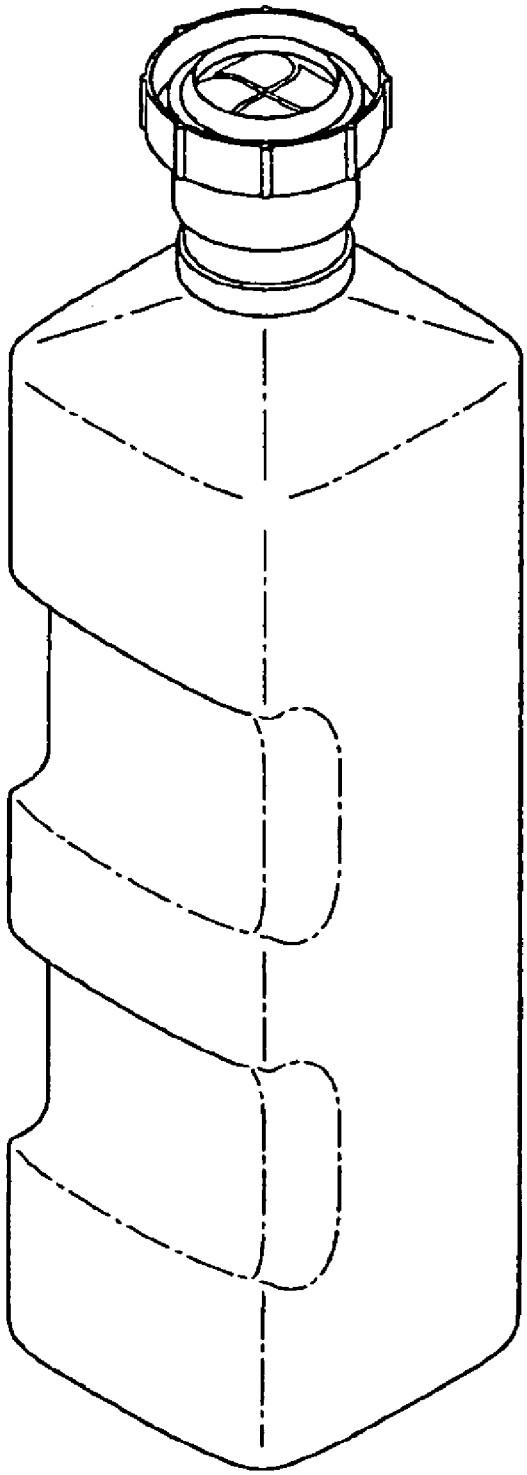
Figures 2, 41:
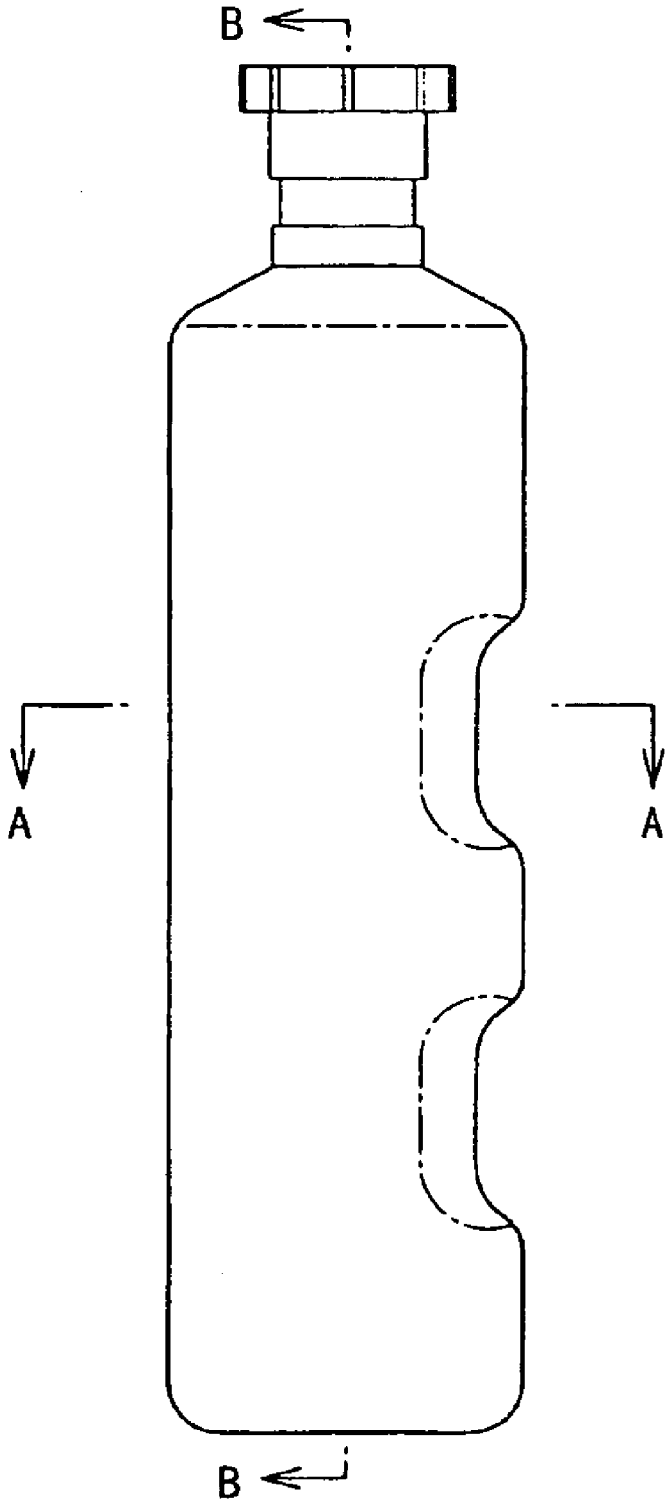
Figures 3, 41:
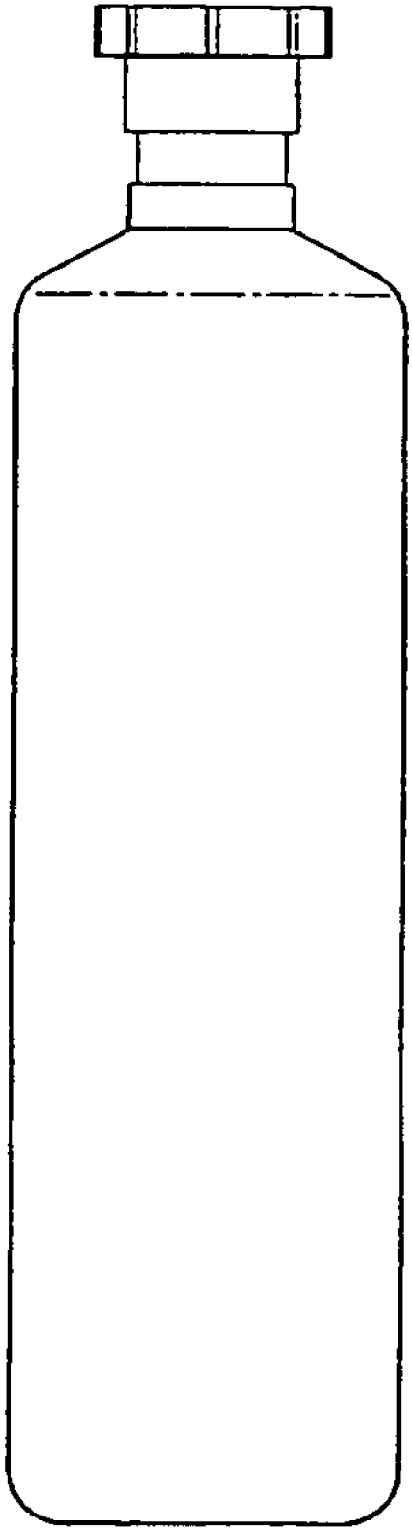
Figures 4, 41:
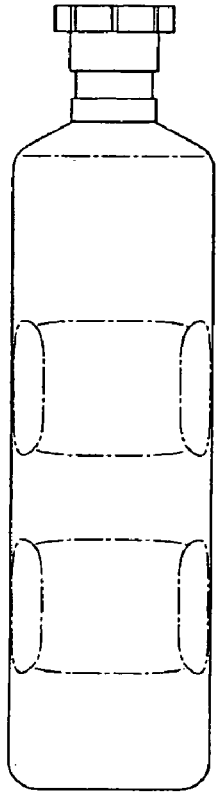
Figures 5, 41:
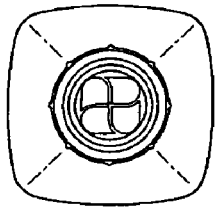
Figures 6, 41:
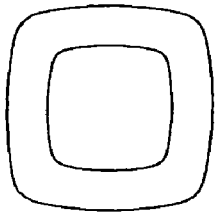
Figures 7, 41:
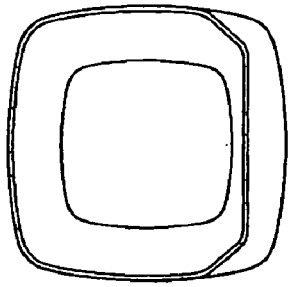
Figures 8, 41:
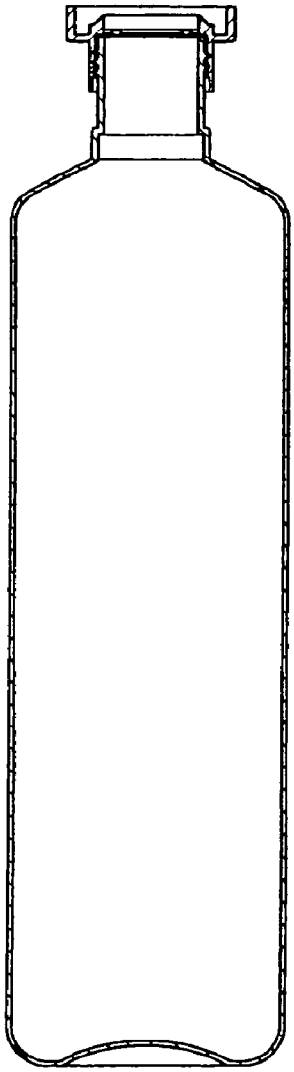
Figures 9, 41:
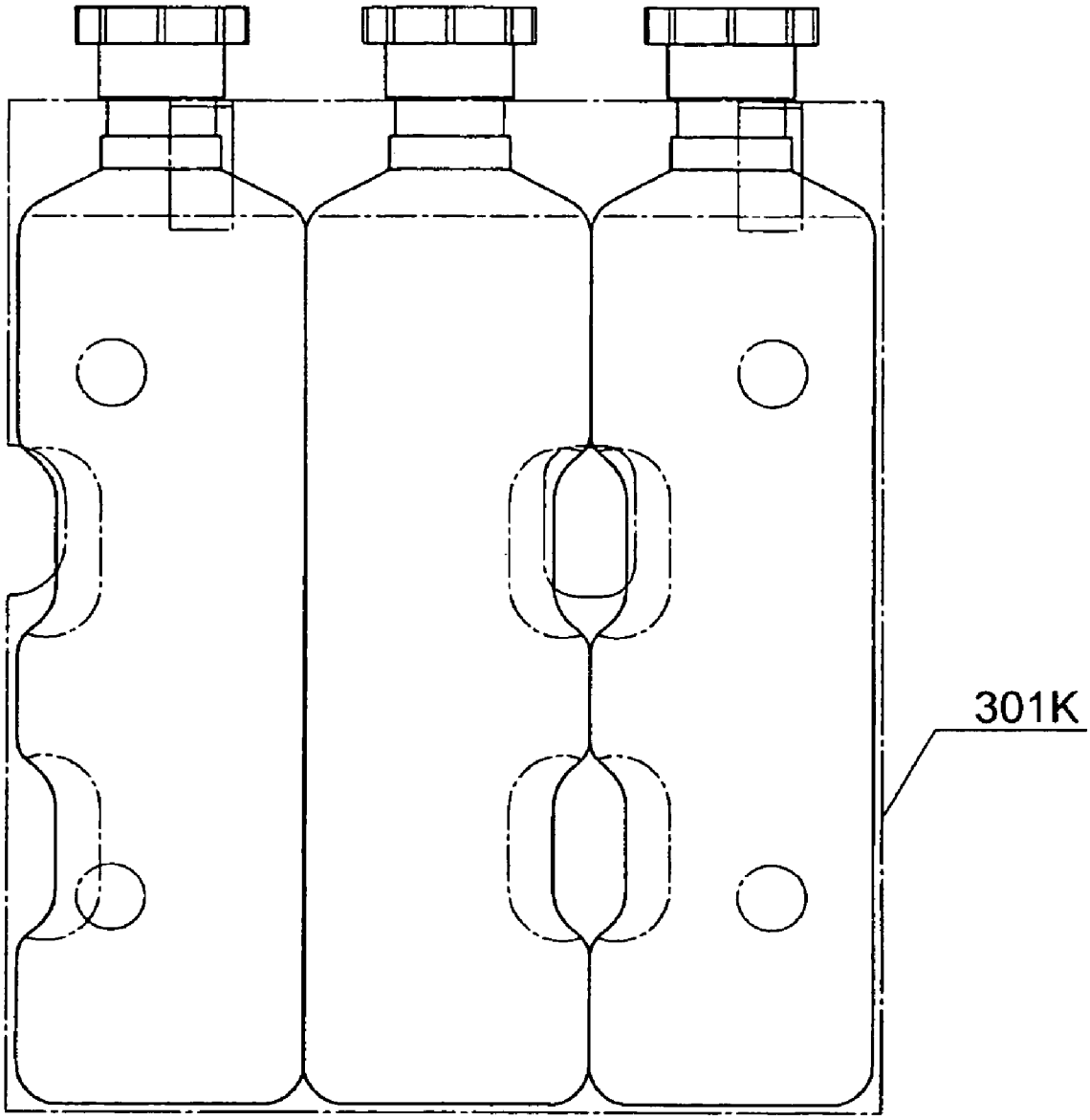

FIG. 41-3 is a left side view of the container of FIG. 41-1;

FIG. 41-4 is a right view of the container of FIG. 41-1;

FIG. 41-5 is a top view of the container of FIG. 41-1;

FIG. 41-6 is a bottom view of the container of FIG. 41-1;

FIG. 41-7 is an A—A cross-sectional view of the container of FIG. 41-1;

FIG. 41-8 is a B—B cross-sectional view of the container of FIG. 41-1; and FIG. 41-9 is a reference view of the containers of FIG. 41-1 in a cartridge box.

DETAILED DESCRIPTION OF THE INVENTION

Some embodiments according to the present invention will be described below, by referring to the attached drawings.

FIGS. 1 to 7 show a cartridge 10 for photographic processing agents according to the first embodiment of the present invention. FIGS. 8 to 13 show a container 12 for a photographic processing agent that can be provided in the cartridge 10 for photographic processing agents.

As shown in FIGS. 1 to 4, the cartridge 10 for photographic processing agents is formed of three containers 12 (12A, 12B and 12C) for photographic processing agents and a storage box 14. The containers 12 are filled with a developing solution, a bleaching solution and a fixing solution, respectively. The containers 12 are housed in the storage box 14 as one set (one package).

Each of the three containers 12 has the same structure and the same shape and is formed of the same material. In this embodiment, each container is made of a plastic material, such as PE (HDPE (high density polyethylene), LDPE (low density polyethylene)). Each container is formed in a tetragonal bottle shape through a blow molding method, such as the direct blow molding method or the injection blow molding method.

Figure 13:
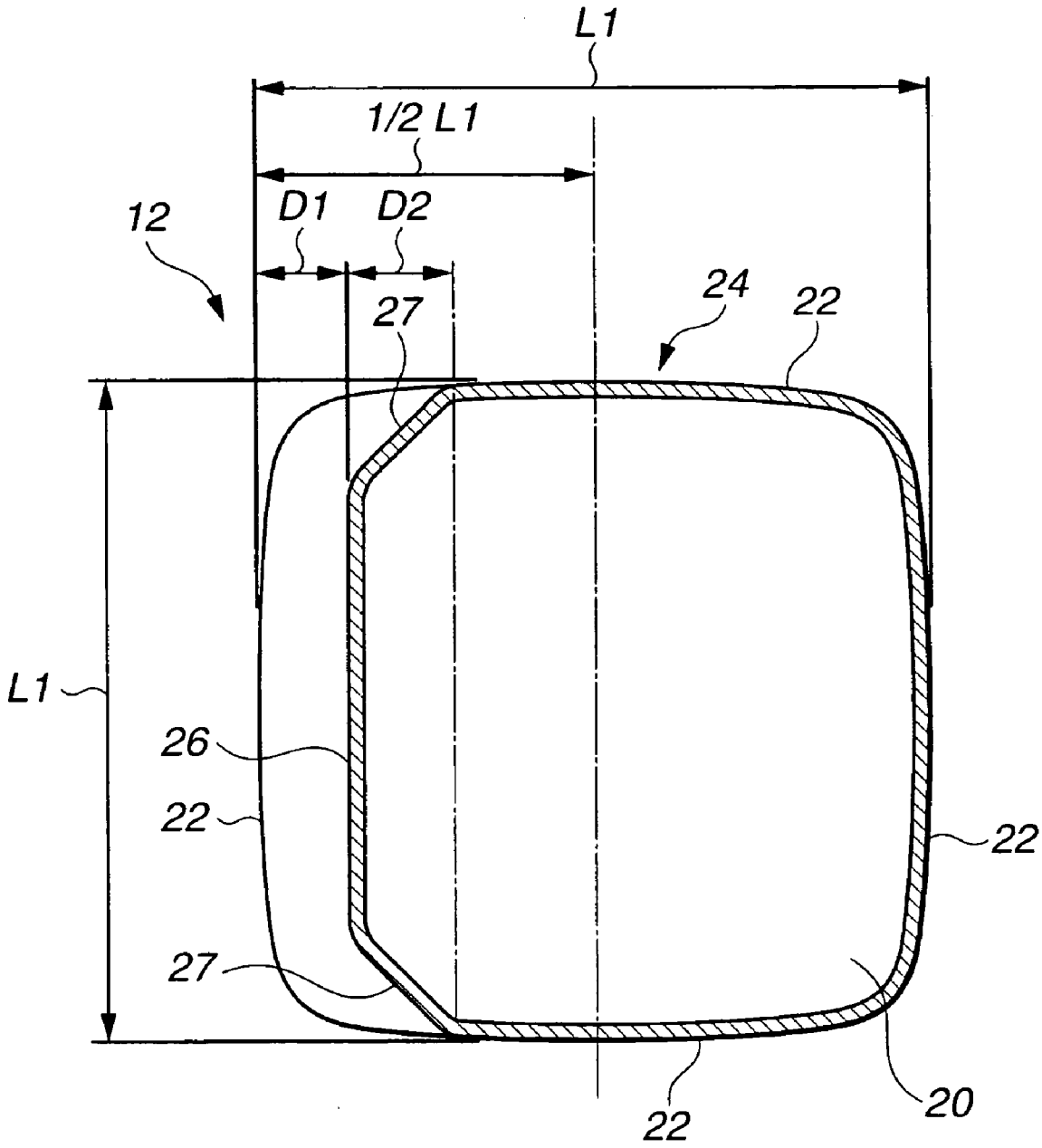
FIG. 13 is a cross-sectional view, taken horizontally along the line 13—13 of FIG. 11, of the recess formed on the container for a photographic processing agent according to the first embodiment of the present invention.

In the container 12 for a photographic processing agent, as shown in FIG. 13, the container 12 includes a bottom 20 (outer face) substantially square in shape having four rounded corners and four sides each having the same length of L1. Each side forming the substantial square is slightly curved outward due to the molding. The length L1 of each side represents the maximum length including the curved portion and corresponds to the width of the horizontal cross section of the container 12.

Four outer side faces 22 rise up vertically from the four sides of the bottom 20. The four outer side faces 22 outline a body 24 (outer face) of the container 12. One of the outer side faces 22 is provided with a recess 26 at a position above the middle portion of the vertical length of the outer side face (see FIGS. 8 to 12).

Figure 10:
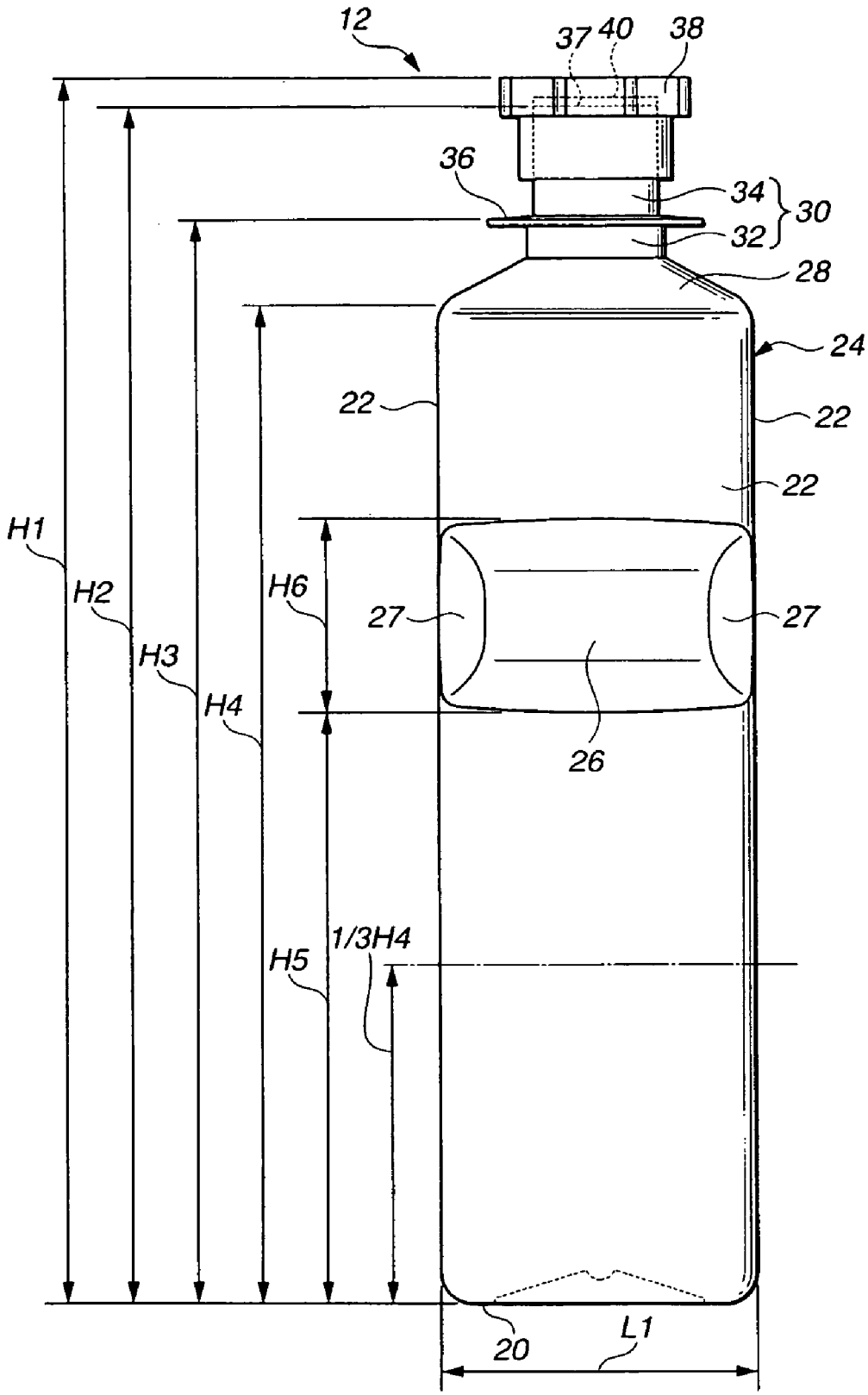
FIG. 10 is a front view of the container for a photographic processing agent according to the first embodiment of the present invention.

The recess 26 is substantially rectangular in shape of long side-ways in the front view as shown in FIG. 10. The upper and lower horizontal longer sides are substantially vertical to the longer side of the outer side face 22 (the corner of the body 24). In the side view shown in FIG. 11 and the vertical cross-section shown in FIG. 12, the recess 26 is of a curved shape substantially trapezoidal in shape having the rounded corners. As shown in the horizontal cross-sectional view of FIG. 13, the corner of each side end of the recess 26 is chamfered at about 45° having slanted faces 27 forming the recess at the outer side face 22. The recess 26 and the slanted face 27 formed continuously from the recess 26 are made by deforming the outer side face 22 partially in the shape of a recess (concave). In this embodiment, each slanted face 27 extends over the outer side face 22 defining the recess 26 and the adjacent outer side faces 22 (see FIG. 11). The recess as a whole ranges over three outer side faces 22. It should be noted that the erroneous installation of the cartridge is prevented by means of the recess 26 as will be described later. Thus, one recess is substantially formed in any one of the four outer side faces in this embodiment.

The container 12 is provided with a quadrangular pyramid shoulder 28 formed by narrowing down the upper part of a body 24, and a cylindrical portion 30 protruding upward at the top of the shoulder 28.

The cylindrical portion 30 has vertically extending double necks having: a large diameter cylindrical portion 32 to be axially connected to the shoulder 28 at the lower side thereof; and a small diameter cylindrical portion 34 axially provided at the upper side thereof, the diameter of which is smaller than the large diameter cylindrical portion 32. The cylindrical portion further includes a round flange 36 having a diameter slightly larger than that of the large diameter cylindrical portion 32 disposed coaxially between the large diameter cylindrical portion 32 and the small diameter cylindrical portion 34. A male screw (not shown) is threaded on the upper end (the front tip) of the outer peripheral surface of the small diameter cylindrical portion 32. A cap 38 and a packing 40 are disposed on the upper end of the small diameter cylindrical portion 34 to close a round mouth 37 (round in its plane view) formed at the end of the small diameter cylindrical portion 34 of the cylindrical portion 30.

The cap 38 and the packing 40 are formed of a plastic material, such as PE (polyethylene). The cap 38 is cylindrical and a female screw (not shown) is threaded on the inner peripheral surface thereof so that the female screw can be screwed to the male screw of the small diameter cylindrical portion 34. The cap 38 further includes a stepped portion reduced in diameter in a predetermined value around the upper fringe of the inner peripheral surface of the cap 38. As for the packing 40, the packing is a circular seal having a diameter enough to close the mouth 37 of the cylindrical portion 30. In the closing state of the container shown in FIGS. 8 and 9, the packing 40 includes a vulnerable portion formed of four grooves 44 extending radially from the center to the outer fringe on an unblocked face (surface) 42 exposed from the opening of the cap 38.

Preferable size dimensions of the container 12 for a photographic processing agent according to this embodiment of the present invention are as follows (see FIG. 10).

The height H1 of the container 12, namely the dimension between the outer bottom face of the bottom 20 and the upper face of the cap 38, is about 306 mm. However, this height H1 is variable somewhat due to, for example, the accuracy of the thickness of the packing 40 or the fastening strength of the cap 38. The height H2 between the outer bottom face of the bottom 20 of the container 12 and the front end of the mouth 37 is about 301 mm. The height H3 between the outer bottom face of the bottom 20 of the container 12 and the upper face of the flange 36 is about 263 mm. The height H4 of the outer side face 22 between the outer bottom face of the bottom 20 of the container 12 and the upper end of the body 24, namely, the boundary between the body 24 and the shoulder 28, is about 250 mm. The width L1 of the container 12 is about 78 mm.

Referring to the recess 26, the height H5 between the outer bottom face of the bottom 20 of the container 12 and the lower edge of the recess 26 is about 145 mm. The height H6 of the recess 26 is about 40 mm. The depth D1 of the recess 26 is about 10 mm. The volume of the recess 26 corresponds to about 30 mL.

The average wall thickness of the body 24 and the recess 26 of the container 12 is about 0.3 to 0.7 mm.

The volume (capacity) of the body 24 of the container 12 excluding the recess 26 is about 1521 mL (about 250 mm×about 78 mm×about 78 mm), if the reduction in volume resulted from the wall thickness, the rounded corner at the boundary between the bottom 20 and the body 24, the recess in the middle of the bottom 20, the four rounded corners in horizontal cross section of the body 24, and the curved portion of the outer side face 22, is ignored. The substantial volume of the body 24 of the container 12 including the recess 26 is about 1491 mL (about 1521 mL−about 30 mL). Accordingly, the recess 26 occupies about 2% of the volume (capacity) of the body 24 of the container 12 {(about 30 mL/about 1521 mL)×100}.

Figure 12:
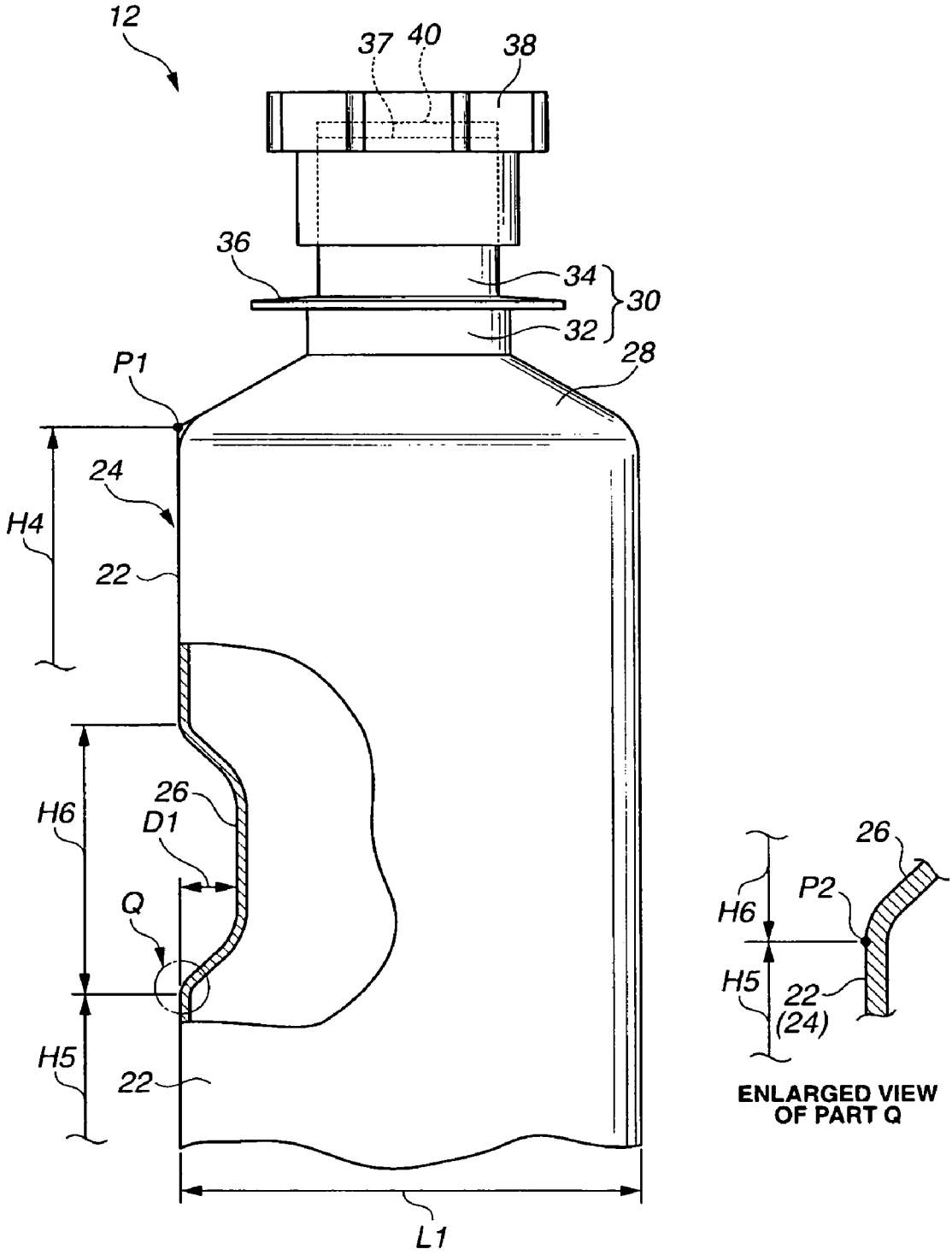
FIG. 12 is an enlarged vertical right side elevation, partially in cross-section, illustrating a recess and the vicinity thereof which is formed in the container for a photographic processing agent according to the first embodiment of the present invention.

In the container 12 for a photographic processing agent of this embodiment, the boundary between the body 24 and the shoulder 28 is curved to maintain the mechanical strength of the container 12. The boundary between the body 24 and the recess 26 is slightly curved through molding. Thus, as shown in FIG. 12, the virtual boundary point P1 at which the line vertically extending from the outer side face 22 of the body 24 intersects the line extending from the surface of the shoulder 28 is used to define the boundary between the body 24 and the shoulder 28 representing the above height H4. The inflection point P2 between the outer side face 22 (even face) of the body 24 and the curved surface of the edge of the recess 26 in the vertical cross section is used to define the boundary between the body 24 and the recess 26 representing the heights H5 and H6. It should be noted that the recess 26 according to this embodiment of the present invention shown in FIG. 12 has a flat bottom surface. Accordingly, the depth between the outer side face 22 of the container 12 and the outer bottom face of the recess 26 becomes the maximum depth of the recess 26.

In this embodiment of the present invention, the recess 26 is preferably disposed at the position above ⅓ of the height of the outer side face 22 of the container 12 (H5 (about 145 mm)>⅓ H4 (about 83.3 mm)), and, the maximum depth is ½ or less of the width of the container. 12 in the horizontal cross section (D1 (about 10 mm≦½ L1 (about 39 mm)). Supposing that the depth of the slanted face 27 to the bottom surface of the recess 26 is defined by D2, the overall depth of the recess 26 including the slanted face 27 (depth of D1+depth D2 in FIG. 12) is ½ or less of the width of the horizontal cross section of the container 12 (D1+D2≦½ L1).

According to this embodiment of the present invention, the container 12 has the structure as explained above, and is filled with a predetermined amount of the photographic processing agent leaving the mouth 37 of the cylindrical portion 30 open. Then, the packing 40 is placed on the mouth 37, and the cap 38 is screwed to the front end of the cylindrical portion 30. The packing 40 clutching into the cap 38 is pressed and fixed against the mouth 37 by the stepped portion of the cap 38, and then the mouth 37 is sealed. In this manner, the container 12 filled with a photographic processing agent is prepared.

The storage box 14 for the containers 12 is made of a corrugated paper. As shown in FIGS. 1 to 7, the storage box 14 containing the containers 12 has a rectangular solid shape.

As shown in FIGS. 3 to 6, the storage box 14 is provided with a box body 50, an inner lid 54, and an outer lid 56. The body 50 has an upper face having a rectangular opening and an empty space for putting the containers 12 into the inside of the box 14. The opening 52 of the body 50 is closed with both the inner lid 54 and the outer lid 56.

As shown in FIG. 7, the opening 52 of the box 50 has the shorter side length L2 substantially equal to the length L1 of the container 12, and the longer side length L3 substantially three times longer than the length L1. As shown in FIG. 5, the depth (height) H7 of the empty space of the body 50 is slightly larger than the height H3 of the container 12 (see FIG. 10, i.e. the height from the bottom 20 of the container 12 to the upper face of the flange 36). In addition, the box 50 is provided with plural openings to be described in detail later.

Figure 2:
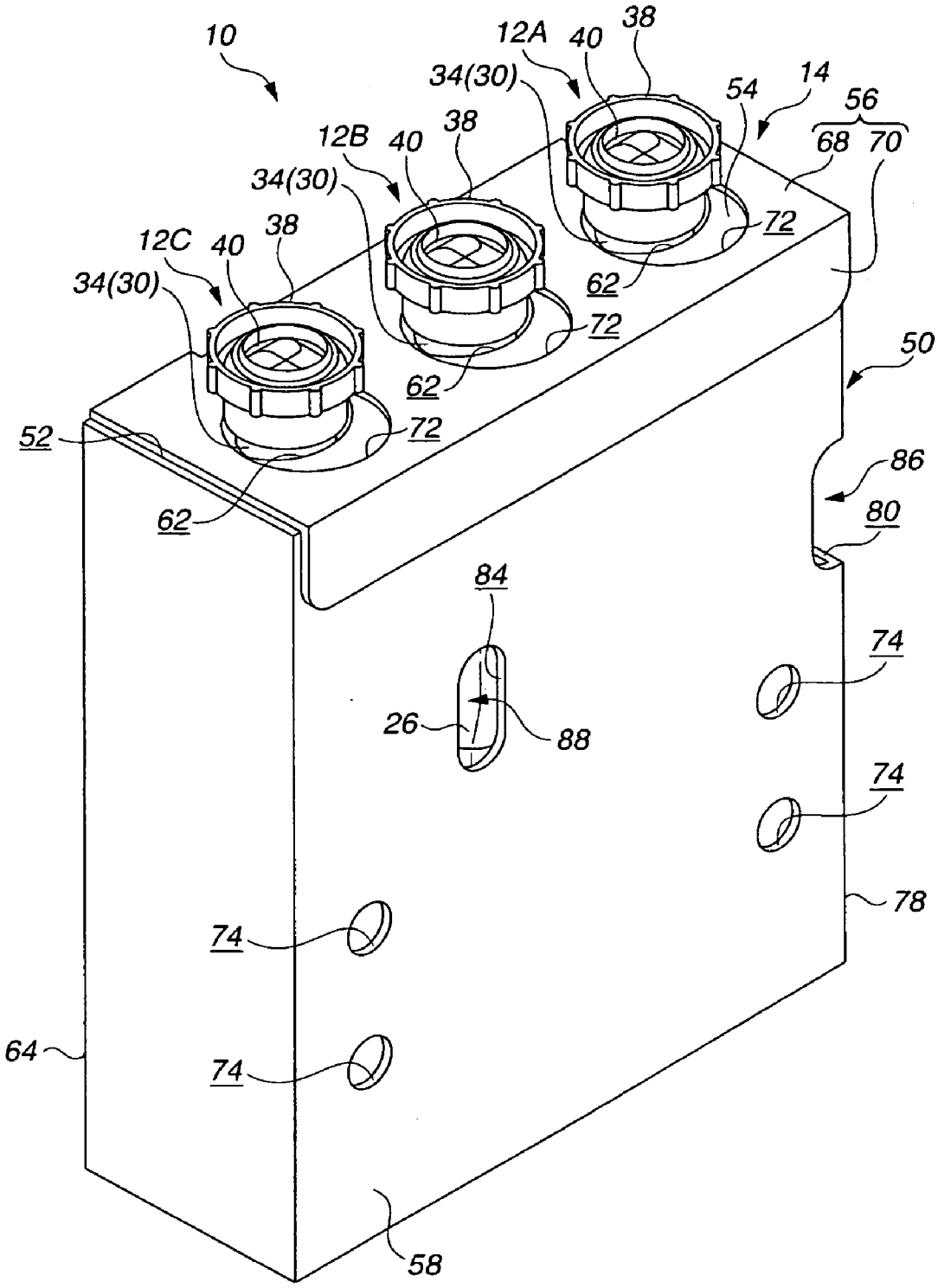
FIG. 2 is a perspective view of the cartridge for photographic processing agents looking from the back face side according to the first embodiment of the present invention.

As shown in FIGS. 5 and 6, the inner lid 54 is connected to the upper edge 60 of the back face 58 of the box 50. The inner lid 54 is rectangular in shape and is slightly smaller than the opening 52 of the body 50. A fold line is provided on the upper edge 60 acting as a connecting portion of the box body 50. The inner lid 54 can be folded in the directions either to open or close the opening 52 of the box body 50 along the fold line. As shown in FIGS. 1 and 2, the inner lid 52 has three circular holes 62 longitudinally arranged at predetermined intervals along the lid. The diameter of each hole 62 is slightly larger than the diameter of the cap 38 for the container 12 in the portion having the largest diameter, and the center of each hole is offset in a predetermined distance toward the front end of the inner lid 54.

As shown in FIGS. 5 and 6, the outer lid 56 is connected to the upper edge 66 of the front face 64 of the box body 50. The outer lid 56 is formed of a rectangular cover 68 connected to the upper edge 66 and having the size approximately equal to the opening 52 of the box body 50, and a flap 70 provided at the front end of the cover 68. A fold line is provided on the upper edge 66 acting as a connecting portion of the box body 50. The outer lid 56 can be folded in the directions either to open or close the opening 52 of the box 50 along the fold line. The connecting portion of the cover 68 and the flap 70 is provided with a fold line formed in parallel to the fold line of the upper edge 66 so that the flap 70 may be folded to the cover 68 along the fold line. As shown in FIGS. 1 and 2, the cover 68 has three circular holes 72 arranged longitudinally at predetermined intervals along the cover 68. The diameter of each circular hole 72 is slightly larger than the diameter of the cap 38 in the portion having the maximum diameter and is substantially the same diameter as the circular hole 62 of the inner lid 54. The center of each hole 72 is offset in a predetermined distance toward the front end of the outer lid 56.

The storage box 14 is fabricated as explained above. When the containers 12 are put into the storage box 14, the inner lid 54 and the outer lid 56 of the box 50 are spread in open and the containers 12 are inserted vertically into the box 50 through the opening 52 from the bottom 20 side of the container, as shown in FIGS. 8 to 11. When all of three containers 12 are inserted into the box 50, the containers 12 are lined in row in such a manner that outer side faces 22 of adjacent containers are in contact with each other and the other outer side faces 22 thereof are in contact with the inner faces of the box 50. Accordingly, there is little waste space created around the containers 12 and also between each container 12 and the box 50, and any involuntary lateral, forward, and backward movements of the containers 12 in the box 50 can be prevented.

In the state of holding the containers in the box, the cap 38 and the small diameter cylindrical portion 34 of the cylindrical portion 30 of each container 12 protrude upward from the opening 52 on the upper face of the box 50. Then, the inner lid 54 and the outer lid 56 are folded alternately toward the opening 52.

First, when the inner lid 54 is folded, the cap 38 and the small diameter cylindrical portion 34 of each container 12 pass through the corresponding circular hole 62. At the position where the inner lid 54 is folded substantially perpendicularly to the back face 58 of the box 50, the edge of the rear face of each circular hole 62 substantially contacts to the flange 36 as shown in FIG. 1. Then, when the outer lid 56 is folded, the cap 38 and the small diameter cylindrical portion 34 of each container 12 pass through the corresponding circular hole 72. At the position where the outer lid 56 is folded substantially perpendicularly to the front face 64 of the box 50, the edge of the rear face of each circular hole 72 substantially contacts to the flange 36 while the lid 68 is overlapped with the inner lid 54, as shown in FIG. 1.

Last, the flap (fixing portion) 70 of the outer lid 56 is folded downward at substantially the right angle with respect to the lid 68 and is bonded and fixed to the rear face 58 of the box 50 in contact via the face. In this state, the opening 52 of the box 50 is closed double by both the inner lid 54 and the outer lid 56, and the flange 36 is pressed down by the inner lid 54 and the outer lid 56, and the vertical irregular movements of the containers 12 in the box 50 is prevented. As a result, the cartridge 10 for the photographic processing agents containing three containers 12 as one set in row within the storage box 14, while exposing the cap 38 and the packing 40 of each container 12 to the outside, is provided.

The containers 12 can be selectively stored in the box 14 to have the recesses 26 of the containers 12 directed to given directions among plural different recess dispositions in the box. In this embodiment, the container 12 is turned around the axis thereof at an interval of 90° so that the recess 26 can be directed selectively in any one of four dispositions, namely back, front, left and right directions. In the cartridge shown in FIG. 1, the containers 12 are housed in the box 14 to have each recess 26 of the container 12A disposed on the left side in the box and the container 12C disposed on the right side in the box, directed leftward, and the recess 26 of the container 12B disposed in the middle directed rightward. Thus, the recess 26 of the container 12B confronts the recess 26 of the container 12C, and these two recesses 26 form a vertically-elongated, substantially hexagonal through hole which penetrates in the horizontal direction, as shown in FIGS. 3 and 4.

As described in the above, in this embodiment of the present invention, plural openings such as holes or cutouts are formed in the body 50 of the storage box 14.

In the box shown in FIGS. 1 to 4, two pairs of circular holes 74 are formed in the front face 64 and the back face 58 of the box 50. In other words, four holes are formed on each face and eight holes in total on both faces. The two pairs of circular holes 74 are formed below the horizontal center line on each face of the box 50 on the left and right sides symmetrical to the vertical center line of each face of the box 50, respectively. The holes 74 of each pair are spaced vertically at a predetermined interval. Each hole 74 is provided to receive fingertips when an operator holds the cartridge 10. The diameter of the hole 74 is about 18 mm.

The cartridge 10 according to this embodiment is heavy because the cartridge contains three containers 12. Furthermore, the storage box 14 is made of a corrugated paper. Thus, the operator or other person has to firmly hold the storage box 14 of the cartridge 10 so as not to slip the box 14 of the cartridge 10 out of his hands, if the surface of the storage box 14 is smooth. For this reason, the plural holes 74 are formed on the left and right sides of the box 50 into which fingertips of both hands are inserted to hold the storage box 14 firmly and securely so as not to slip the cartridge 10 out of the operator's hands.

Figure 26:
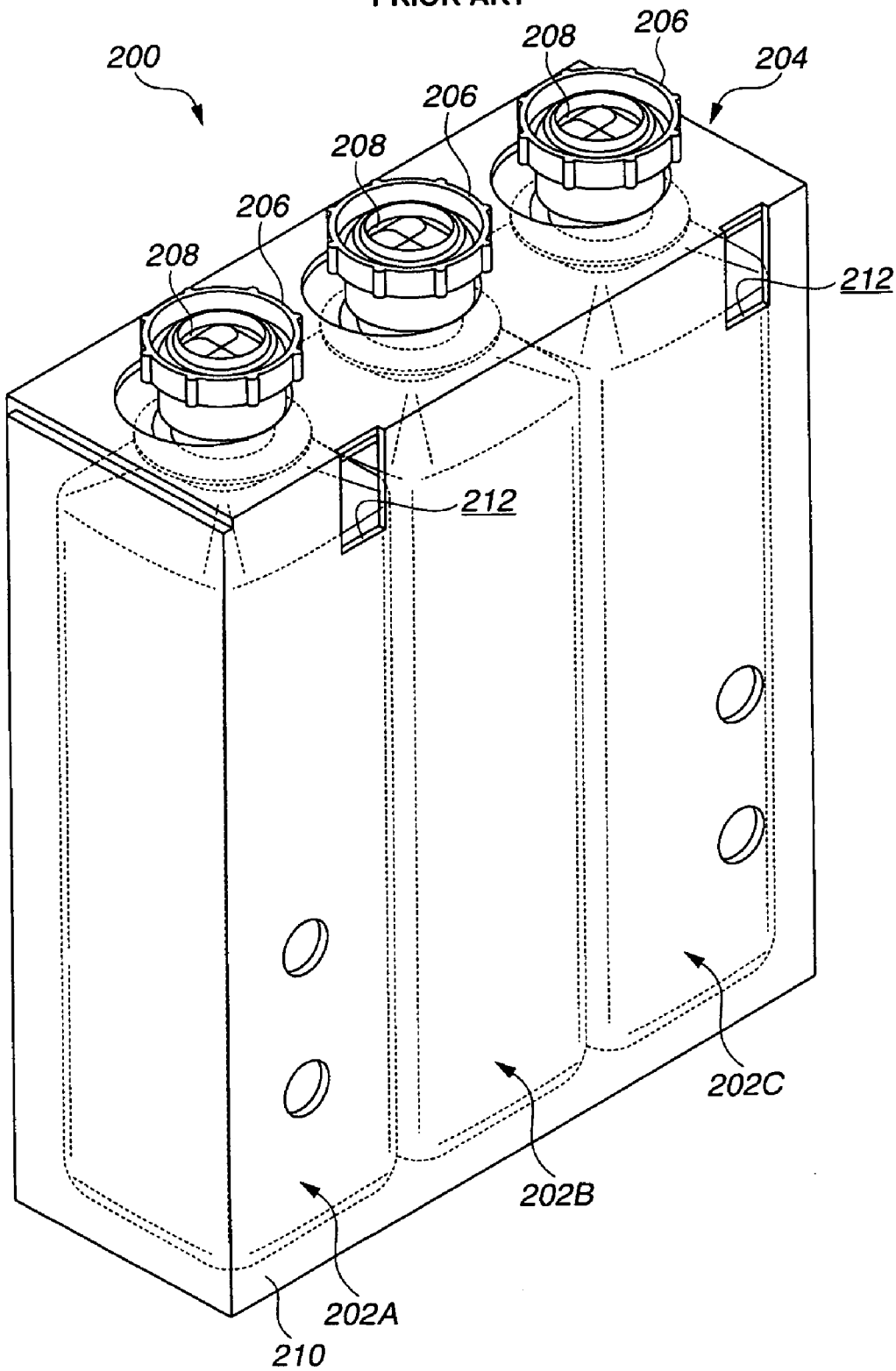
FIG.26 PRIOR ART
FIG. 26 is a perspective view of a conventional cartridge for photographic processing agents looking from the front face side.
Figure 27:
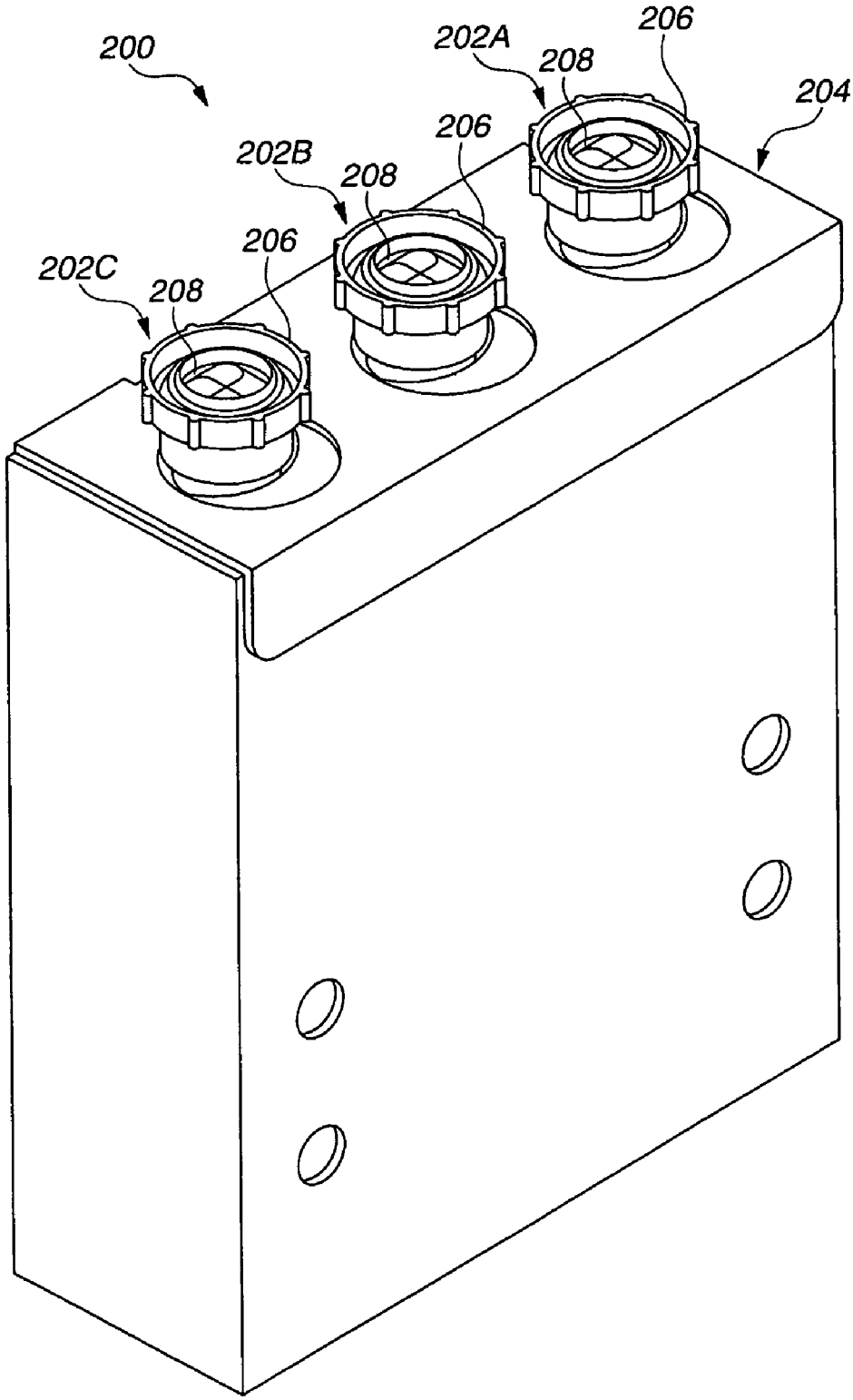
FIG.27 PRIOR ART
FIG. 27 is a perspective view of the conventional cartridge for photographic processing agents looking from the rear face side.
Figure 28:
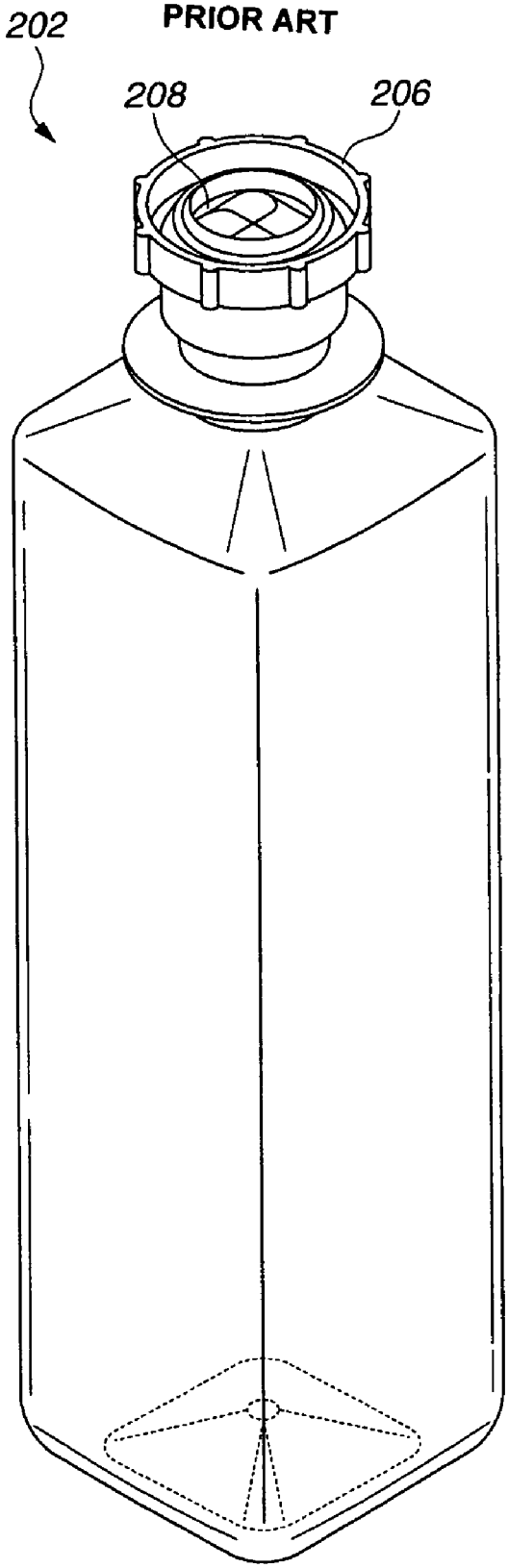
FIG.28 PRIOR ART
FIG. 28 is a perspective view of a conventional container for a photographic processing agent.
Figure 29:
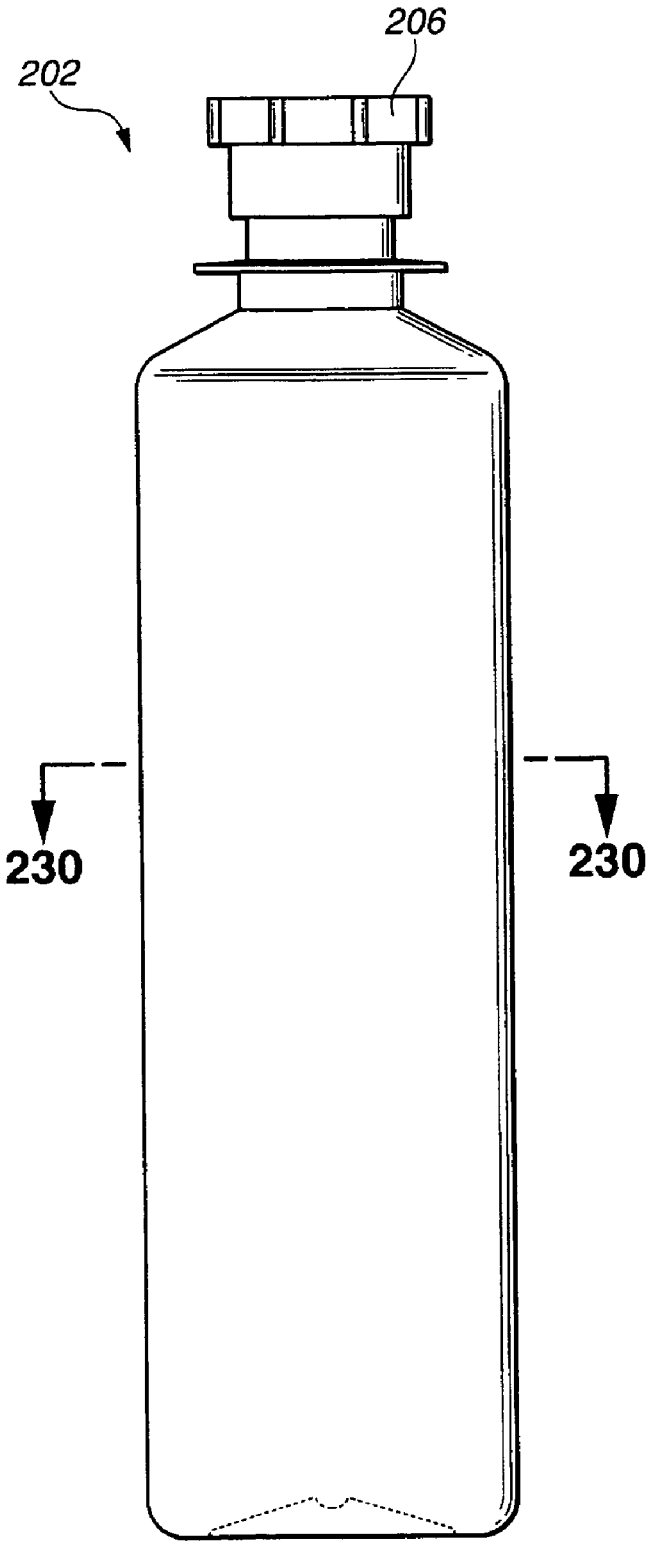
FIG.29 PRIOR ART
FIG. 29 is a front view of the conventional container for a photographic processing agent.
Figure 30:
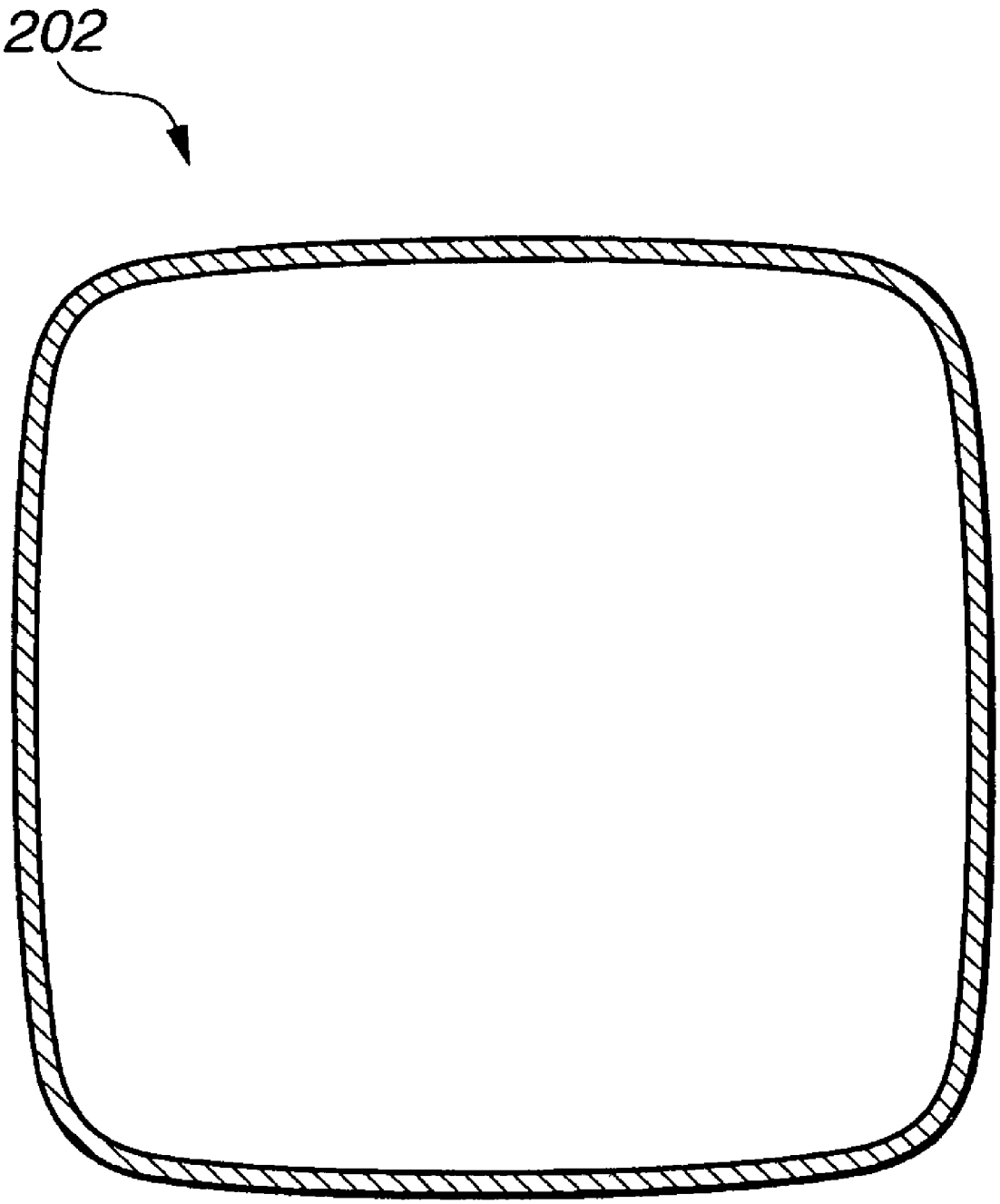
FIG.30 PRIOR ART
FIG. 30 is a cross-sectional view illustrating a body of the conventional container for a photographic processing agent taken horizontally along the line 230—230 of FIG. 29.

It should be noted that two vertically-oblong rectangular cutouts 76 are formed on the upper end of the front face 64 of the box 50. The cutouts 76 are formed at a predetermined position and asymmetrically in a manner similar to the cutouts 212 in the conventional cartridge 200 as shown in FIG. 26.

On the left side face 78, the front face 64, and the rear face 58 of the box 50, openings 80, 82 and 84 are formed at the positions corresponding to the recesses 26 of the three containers 12 in the box 50, respectively.

More specifically, the cutout opening 80 corresponding to the recess 26 in the container 12A is formed on the left side face 78 of the box 50. The opening 80 on the left side face is rectangular and has a height approximately equal to that of the recess 26, as shown in FIG. 5. As shown in FIGS. 3 and 4, a vertically elongated cutout having a substantially half oval shape is formed on the front face 64 and the rear face 58, respectively. The depth of the cutout substantially corresponds to the depth of the recess 26. The opening 80 and the recess 26 form a first guide portion 86 in the shape of horizontally penetrating recess on the left side end of the storage box 14 for the cartridge 10.

The vertically-elongated, substantially oval openings 82 and 84 corresponding to the recesses 26 of the containers 12B and 12C, which are disposed to confront each other, are formed on the front and rear faces 64 and 58 of the box 50, respectively. The openings 82 and 84 have substantially the same height and width as the vertically-elongated, substantially hexagonal through hole defined by the confronting two recesses 26, as shown in FIGS. 3 and 4. The openings 82 and 84 and the two recesses 26 combined together form a second guide portion 88 in the shape of horizontally extending through hole on the upper side of slightly above the center of the horizontal direction of the storage box 14 and on the right side slightly deviated from the center of the vertical direction of the storage box 14, as shown in FIG. 3.

Figure 17:
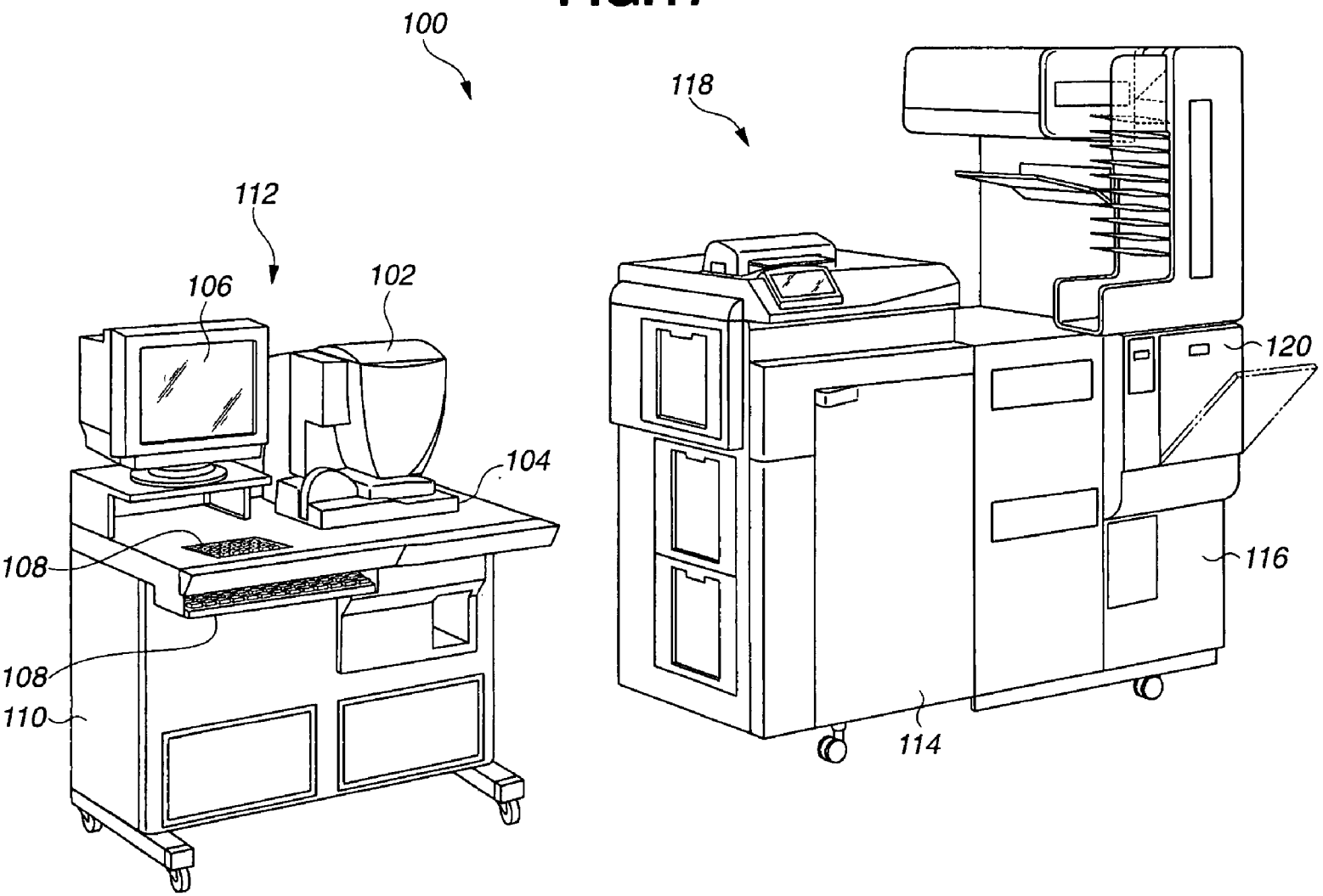
FIG. 17 is a schematic view of an automatic photo-processor to which the cartridge for photographic processing agents is loaded.

FIG. 17 shows an automatic photo-processor (digital laboratory system) 100, to which the above-described cartridge 10 for photographic processing agents is installed.

The automatic photo-processor 100 includes an integrated input unit 112 and an integrated output unit 118. The input unit 112 includes an image pickup (CCD scanner) 102, a film carrier 104, a display (color display) 106, a controller 108, and an image processor 110. The output unit 118 includes a laser printer 114 and a paper processor 116. In the output unit 118, there is provided a cartridge loading chamber 120 in which the cartridge 10 for photographic processing agents is installed. The cartridge loading chamber 120 will be described below.

Figure 18:
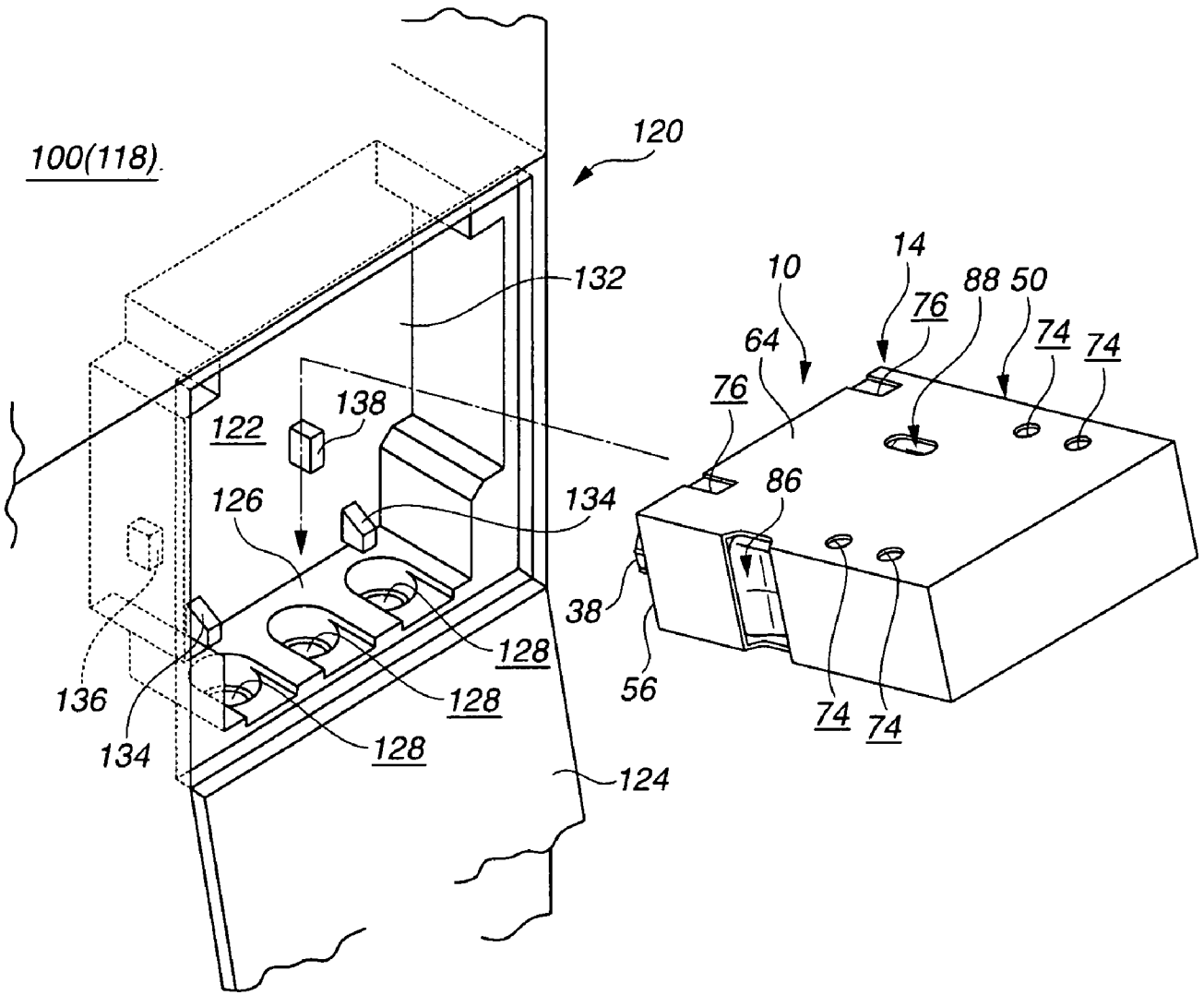
FIG. 18 is a perspective view illustrating a manner of installing the cartridge for photographic processing agents in a cartridge loading chamber of the automatic photo-processor.
Figure 19:
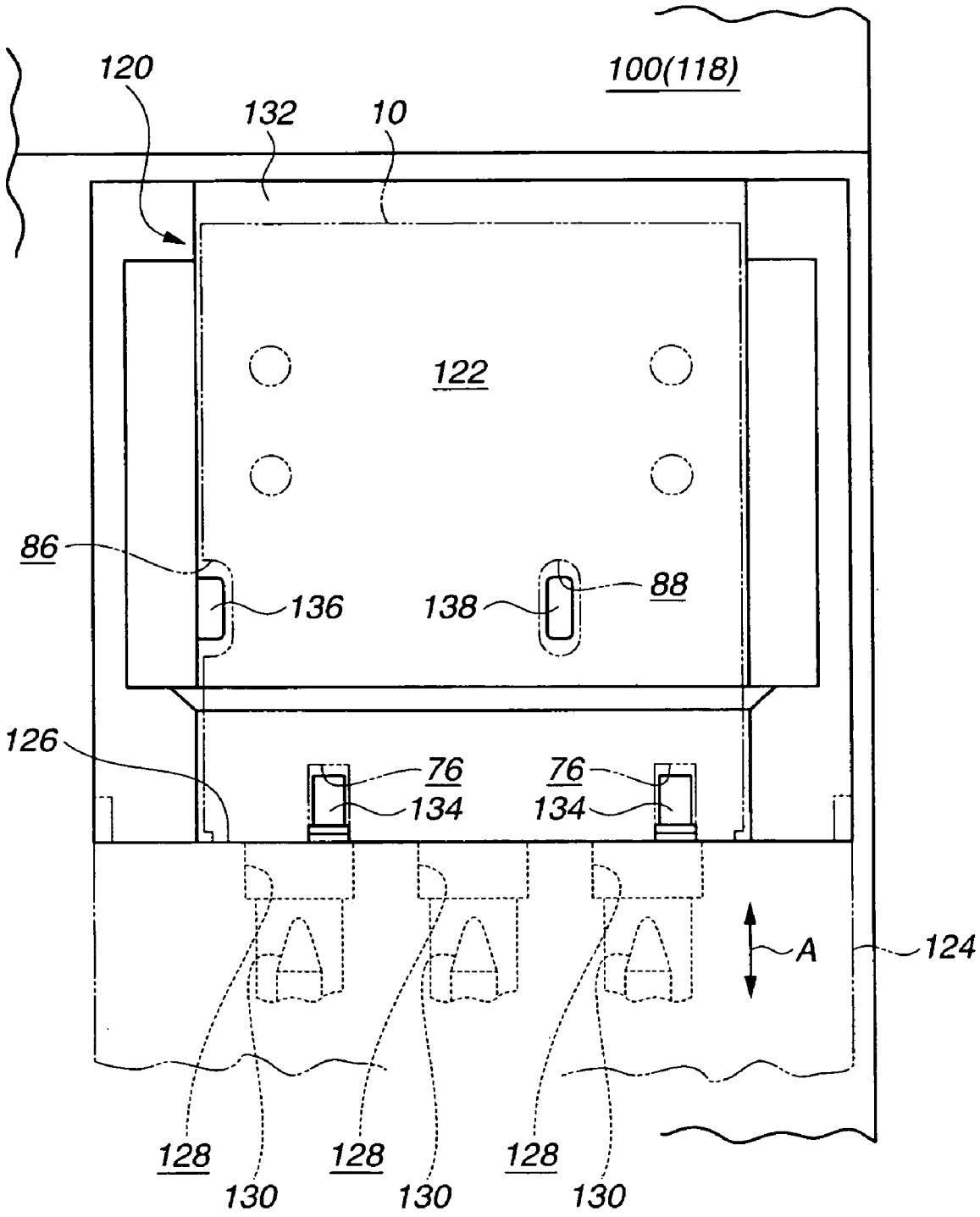
FIG. 19 is a front view of the cartridge loading chamber of the automatic photo-processor.

FIGS. 18 and 19 show the cartridge loading chamber 120 according to the first embodiment of the present invention. The cartridge loading chamber 120 has a cavity 122 having a substantially rectangular front opening. A door 124 is attached on the front face of the cavity 122 so as to open and close the cavity 122.

The height of the cavity 122 is larger than the height of the storage box 14 of the cartridge 10 at a predetermined length, and the width is slightly larger than that of the storage box 14, and the depth is slightly larger than the thickness of the storage box 14.

In the cartridge loading chamber 120, there are formed three insertion holes 128 horizontally arranged at a predetermined interval on a bottom wall 126 of the cavity 122. The cartridge 10 is loaded in the cartridge loading chamber to have each mouth 37 including cap 38 and the packing 40 of the containers 12A, 12B and 12C inserted into the insertion holes 128. A washing nozzle 130 having a conical tip is coaxially disposed in the inside of each insertion hole 128. The washing nozzle 130 is to spray conically and upward a cleaning liquid out of an orifice at the end of the washing nozzle, thus it is a spraying nozzle. The washing nozzle is vertically movable in the direction of the arrow A in FIG. 19 by a drive mechanism (not shown). The cleaning liquid is supplied to each washing nozzle 130 by a pump (not shown) mounted in the automatic photo-processor 100 through conduits.

In the automatic photo-processor 100 according to this embodiment of the present invention, the spray pressure of the cleaning liquid is from about 0.137 to about 0.157 MPa, the spray volume is from 18 to 22 mL/sec., the spray time is from 30 to 60 sec., and the spray angle θ is from 30 to 60°. The cleaning liquid is water or a chemical(s). It should be noted that the spray time is variable depending upon the liquid volume to be applied and the concentration of the photographic processing agents. As for the spray angle, if the spray angle is less than 30°, then the jet stream of the cleaning liquid is liable to converge on upwards not to impinge directly on the inner side faces of the container 12, which results in deteriorating the washing or cleaning capability. On the other hand, if the spray angle is more than 60°, as the center of the jet stream becomes thin, the jet stream does not impinge directly on the inner bottom face of the container 12 as well, which results in deteriorating the washing capability.

In an innermost wall 132 of the cavity 122, there are formed four protrusions corresponding to the two cutouts 76, the first guide hole 86, and the second guide hole 88 in the cartridge 10, respectively.

Among the four protrusions, two protrusions 134 correspond to the two cutouts 76 and are disposed at a predetermined position of the lower end of the innermost wall 132, respectively. A first guide protrusion 136 corresponds to the first guide opening 86 and is disposed slightly below from the center of the horizontal direction of the wall 132 and on the left side of the wall 132. A second guide protrusion 138 corresponds to the second guide opening 88 and is disposed at the same height as the first guide protrusion 136 and on the right side slightly deviated from the center of the vertical direction of the wall.

The cartridge loading chamber 120 has the structure as explained above. The method of loading the cartridge 10 for photographic processing agents into the cartridge loading chamber 120 in the automatic photo-processor 100 will be described below.

In order to install the cartridge 10 in the automatic photo-processor 100, an operator opens the door 124 of the cartridge loading chamber 120 as shown in FIG. 18, and then installs the cartridge 10 in the cartridge loading chamber 120 making the storage box 14 upside down and directing the front face 64 side of the box 14 to the cavity 122.

In this installing, first, the caps 38 of the containers 12A, 12B and 12C are inserted into the holes 128, respectively, while the cartridge 10 is slanted forward slightly. The insertion of the caps 38 into the holes 128 makes it possible for the cutouts 76 of the cartridge 10 to be in alignment with and engaged with the protrusion 134, to permit further insertion of the cartridge. When the cap 38 is inserted further and the outer lid 56 of the box 14 contacts to the bottom wall 126 of the cavity 122, the insertion operation is completed, and then the cartridge 10 is pushed into the cavity 122.

In this pushing operation, the first guide hole 86 and the second guide hole 88 of the cartridge 10 are also aligned and engaged with the first guide protrusion 136 and the second guide protrusion 138, respectively, to permit the cartridge 10 to push further into the cavity. When the cartridge 10 is pushed further into the cavity 122 and the front face 64 of the box 14 contacts to the innermost wall 132 of the cavity 122, the loading operation of the cartridge 10 is completed.

In this loading operation, the operator can confirm that the cartridge 10 is a proper cartridge for the automatic photo-processor 100, by knowing that the cartridge 10 can be loaded properly by engaging the first guide hole 86 and the second guide hole 88 with the first guide protrusion 136 and the second guide protrusion 138, respectively. If a cartridge having guide holes corresponding to the first guide hole 86 and the second guide hole 88 which are different in number and arrangement, is tried to be loaded to the automatic photo-processor 100, the guide holes cannot be engaged with the first and second guide protrusions 136 and 138. Therefore, the cartridge cannot be loaded to the automatic photo-processor 100. As a result, the operator can know that such a cartridge that is impossible to be installed is not proper for the automatic photo-processor 100.

When the operator conducts a predetermined operation to start supplying photographic processing agents after the completion of loading of the cartridge 10, the washing nozzles 130 elevate and push against the packings 40 on the containers 12A, 12B and 12C. Then, the four grooves 44 formed in the packings 40 begin to tear up at the center thereof. As the washing nozzles 130 rise up further, the break expands to open each of the containers 12A, 12B and 12C, and the photographic processing agents in each container are discharged and supplied to the automatic photo-processor 100.

Figure 14:
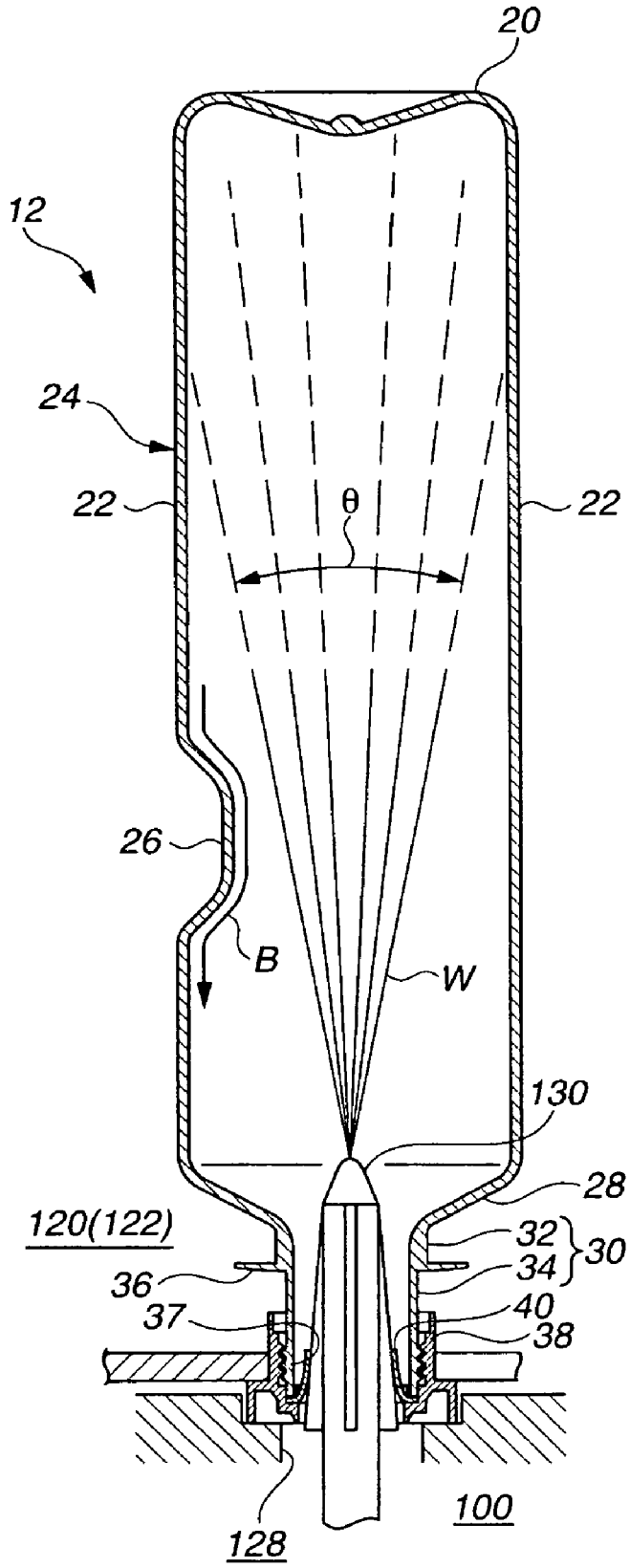
FIG. 14 is a vertical sectional view illustrating a manner for washing the container for a photographic processing agent according to the first embodiment of the present invention.

Subsequently, for example, as shown in FIG. 14, the cleaning nozzles 130 spray a washing water (W) from the tip orifice through an automatic liquid adjusting device so as to clean the insides of the containers 12, e.g. 12A, 12B and 12C, respectively. In this operation, the photographic processing agents remaining in each container are effectively drained out and supplied to the automatic developer 100 without a waste, and the photographic processing agents in each container of the above containers are mixed with the washing water and diluted to a desired concentration.

As explained above, the container 12 is provided with the concave recess 26 having the outer side face of the container partially deformed, in order to prevent the container 12 from loading erroneously in the automatic photo-processor 100. The recess 26 is disposed at the upper portion of ⅓ of the height of the outer side face 22 of the container 12, and the maximum depth is ½ or less of the width in the horizontal cross section of the container 12. Thus, when washing the washing liquid W sprayed from the washing nozzles 130 are permitted to be distributed to every nook and corner of the bottom 20 side of the container 12 on the opposite side of the mouth 37, without being interrupted by the recess 26. The photographic processing agents remaining in the bottom 20 side is effectively washed away by the washing liquid W.

In the cartridge system where the cartridge 10 holding a set of three containers 12A, 12B and 12C is used, the operator can supply at a time three kinds of photographic processing agents (including a developing solution, a bleaching solution and a fixing solution) to the automatic photo-processor 100, without contacting the containers and the photographic processing agents. This enables the operator to load the cartridge effectively in simple manner and clean condition.

As explained in the above, in the container 12 according to this embodiment, it is possible to avoid deterioration of washing capability in the inside of the container 12 without being interrupted by the provision of the recess 26 for prevention of erroneous loading of the container 12 to the automatic photo-processor 100.

In addition, in this embodiment, the vertical cross section of the recess 26 is substantially trapezoidal in shape having the rounded corners and curved surface. This makes it possible for recess 26 to improve the performance of washing-away with the mixed liquid of the photoprocessing agents and the washing liquid flowing down from the bottom (upside down as top) to the mouth of the container 12 via the recess 26 along the inner wall of the container 12, as shown by the arrow B in FIG. 14, when the inside of the container 12 is washed.

Figure 15:
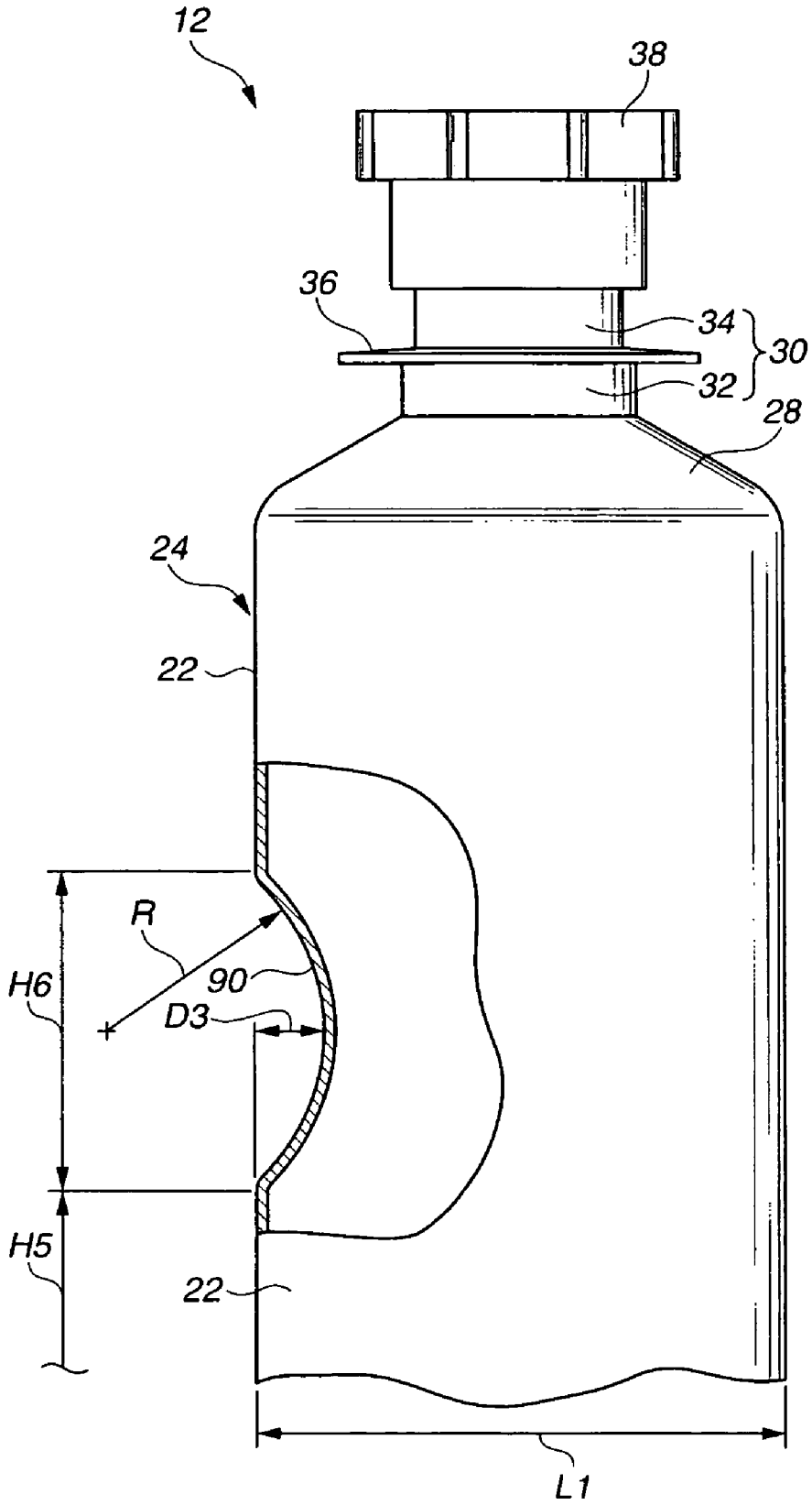
FIG. 15 is an enlarged vertical right side elevation, partially in cross-section, illustrating a modification of the shape of recess formed on the container for a photographic processing agent according to the present invention.

FIG. 15 is an example of modification of the shape of the recess formed on the container 12 in the first embodiment explained above. The explanation will be omitted by affixing the same reference numerals to the same elements as those described in the first embodiment.

In the embodiment shown in FIG. 15, the container is provided with a recess 90 which is formed at the same position on the outer side face 22 of the container 12 as the recess 26 in the first embodiment.

The vertical cross section of the recess 90 has a curved circular arc face having a predetermined radius (R) of curvature. The horizontal cross section of the recess 90 is substantially identical with that of the recess 26 in the first embodiment, as shown in FIG. 13.

The depth D3 of the recess 90 is approximately 10 mm which is the same as the depth of the recess 26 in the first embodiment. The depth from the outer side face 22 of the container 12 to the center of the recess 90 is the deepest, because the recess 90 has the curved circular arc face.

Figure 16:
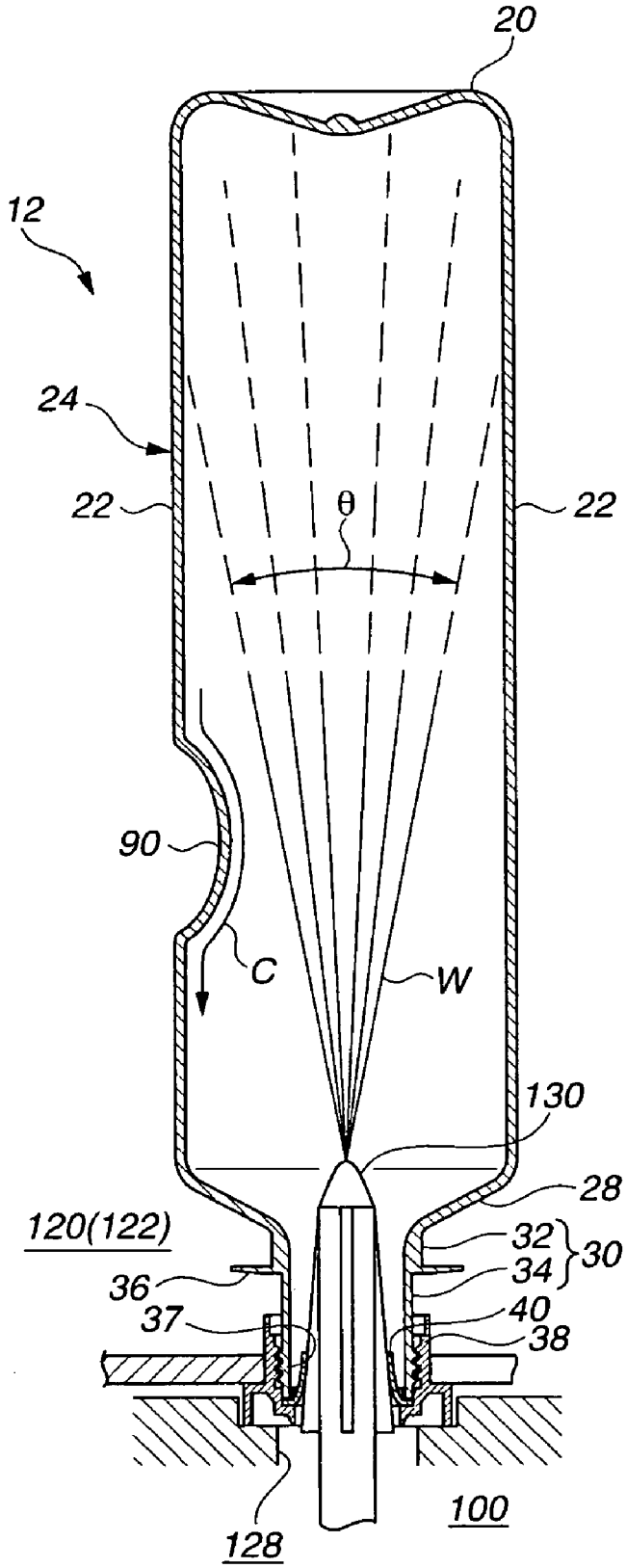
FIG. 16 is a vertical sectional view showing a manner for washing the container for a photographic processing agent shown in FIG. 15 according to the present invention.

The recess 90 having the curved circular arc face in the vertical cross section improves the performance of washing-away with the mixed liquid of the photoprocessing agents and the washing liquid flowing down on the recess 90, as shown by the arrow C in FIG. 16, when the inside of the container 12 is washed.

In the same manner as the recess 26 of the first embodiment, the recess 90 is disposed at the upper portion of ⅓ of the overall height of the outer side face 22 of the container 12, and the maximum depth is ½ or less of the width of the horizontal cross section of the container 12 so as to improve the washing capability in the container 12.

According to the cartridge 10 of the present invention, it is possible to prepare a large number of combination of the number and arrangement of guide portions, i.e. loading patterns for preventing the erroneous loading of the cartridge (10), for example, easily by changing the number of openings and the arrangement of the openings formed on the box 14, as well as the disposition direction of the containers 12A, 12B, and 12C in the box 14. Some examples of other patterns towards prevention of erroneous loading will be described below according to the second to fifth embodiments of the present invention.

The second to fifth embodiments show patterns towards prevention of erroneous loading, different from the first embodiment pattern. In the second to fifth embodiments, the number and arrangement of the guide portions are changed from the first embodiment. The explanation of these embodiments will be omitted by affixing the same reference numeral to the similar elements as those described in the first embodiment.

FIGS. 20(A) to 20(E) show the relationship between the disposition of the containers 12A, 12B and 12C in the cartridge for photographic processing agents and the number and arrangement of openings formed on the storage box 14 according to the first to fifth embodiments of the present invention. FIGS. 21(A) to 24(B) show the cartridges for photographic processing agents according to the second to fifth embodiments of the present invention.

Figures 20A, 20B, 20C, 20D, 20E:
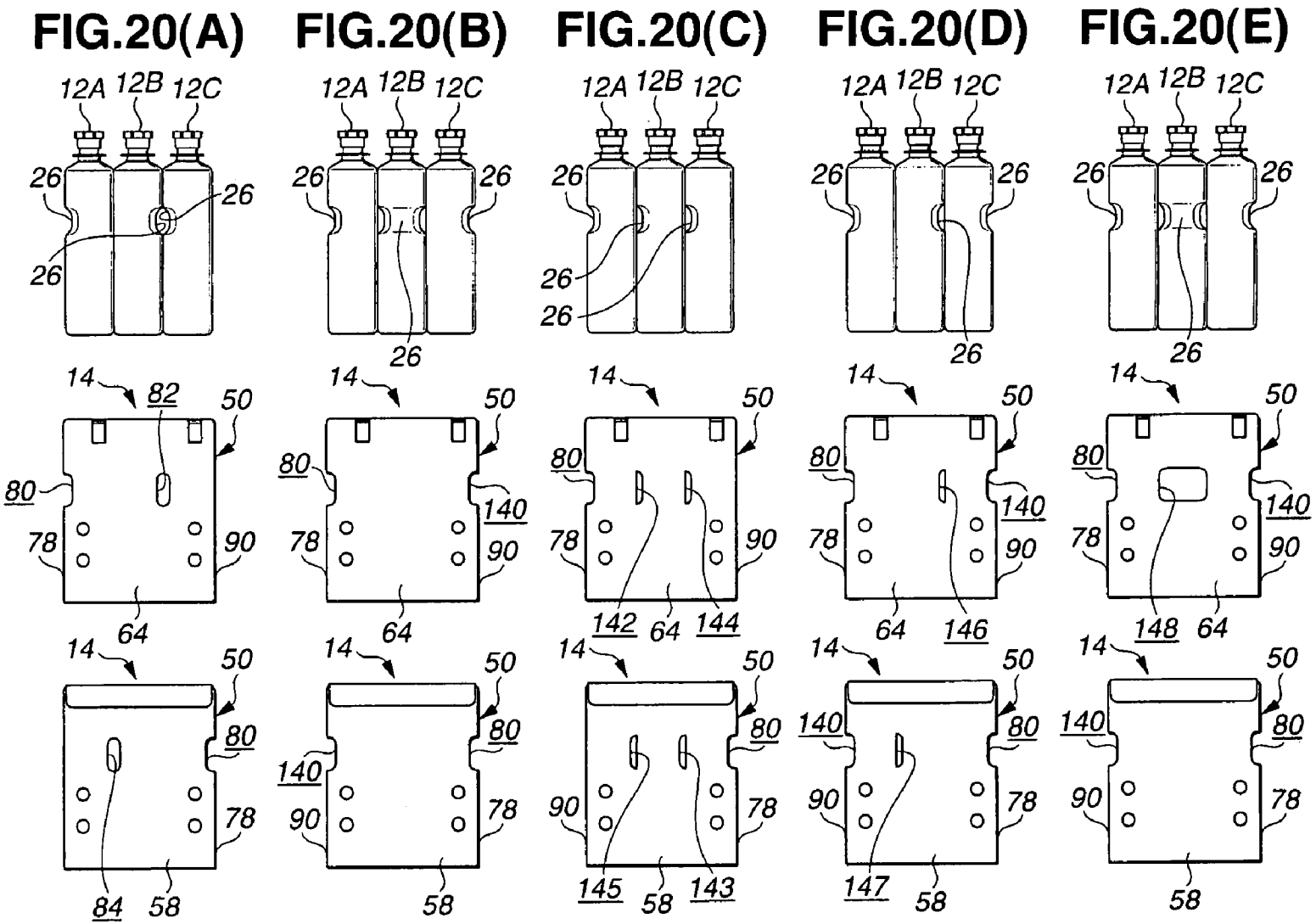
FIGS. 20(A) to 20(E) are diagrams illustrating patterns for preventing the cartridge for photographic processing agents from erroneously installing in the automatic photo-processor, according to the first to fifth embodiments of the present invention.

In the first embodiment as shown in FIG. 20(A), as explained in the above, the containers 12A, 12B and 12C are each housed in the box 14 directing the recesses 26 of the containers 12A and 12C leftward and the recess 26 of the container 12B rightward. In this mode of housing, the opening 80 corresponding to the recess 26 of the container 12A is formed on the left side face 78 of the body 50 of the storage box 14, and the openings 82 and 84 corresponding to the recesses 26 of the containers 12B and 12C are formed on the front face 64 and the back face 58 of the storage box 14, respectively.

In this manner, a first pattern towards prevention of erroneous loading formed of the first guide portion 86 and the second guide portion 88 is arranged in the cartridge 10 according to the first embodiment. The first guide portion 86 is formed of each recess 26 of the container 12A and 12C and the openings 80 and 82. The second guide portion 88 is formed of the recess 26 of the container 12C and the opening 84.

Figure 21A:
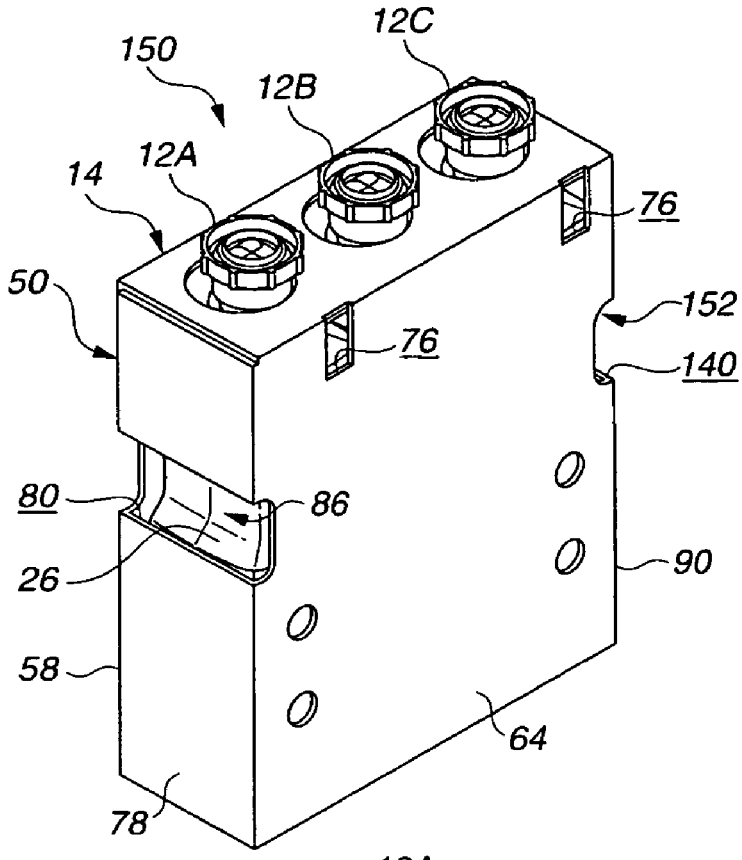
FIG. 21(A) is a perspective view of the cartridge for photographic processing agents looking from the front face side according to the second embodiment of the present invention.
Figure 21B:
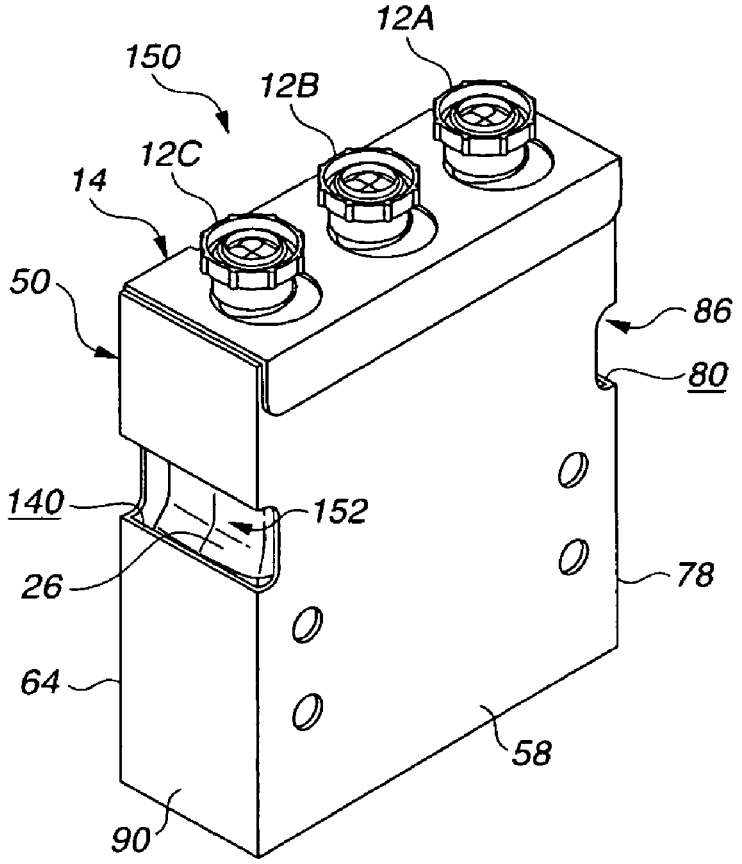
FIG. 21(B) is a perspective view looking from the rear face side thereof.

In the second embodiment as shown in FIG. 20(B) and FIGS. 21(A) and 21(B), the containers 12 are housed in the box 14 to have the recess 26 of the container 12A directed leftward, the recess 26 of the container 12B directed forward and the recess 26 of the container 12C directed rightward. In this mode of housing, in the body 50 of the storage box 14, the opening 84 is formed on the left side face 78 similar to the first embodiment, and the opening 140 corresponding to the recess 26 of the container 12C is formed on the right side face 90.

In this manner, a second pattern towards prevention of erroneous loading is formed on the cartridge 150 for photographic processing agents according to the second embodiment. The second pattern towards prevention of erroneous loading is formed of the first guide portion 86 identical to that in the first embodiment, and the third guide portion 152 formed of the recess 26 of the container 12C and the opening 140. In the second embodiment, the container 12B is not necessarily housed in the storage box 14 in the disposition as explained above, because the storage box 14 does not have the opening corresponding to the recess 26 of the container 12B.

Figure 22A:
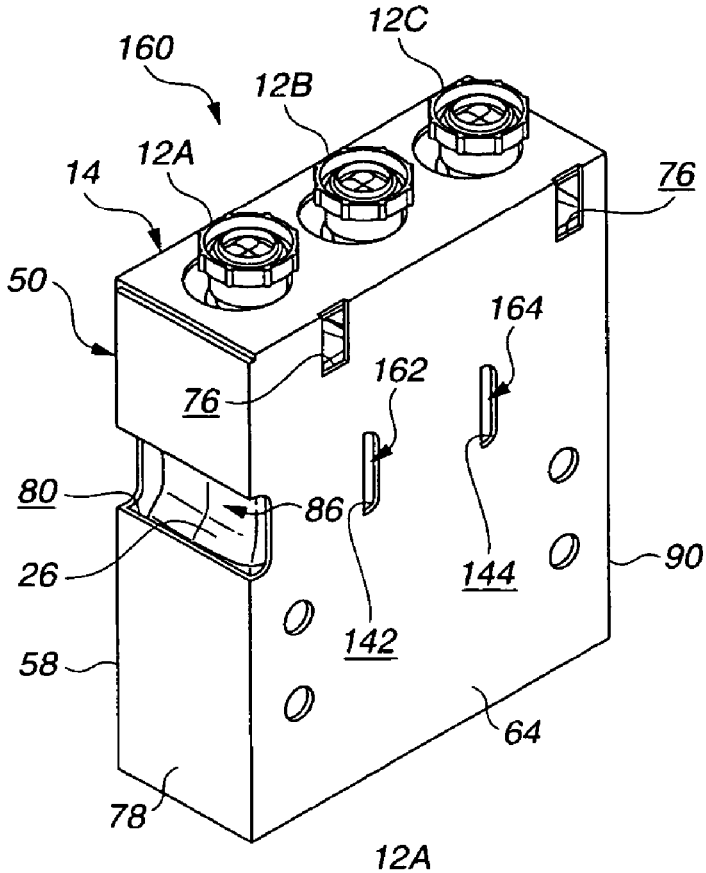
FIG. 22(A) is a perspective view of the cartridge for photographic processing agents looking from the front face side according to the third embodiment of the present invention.
Figure 22B:
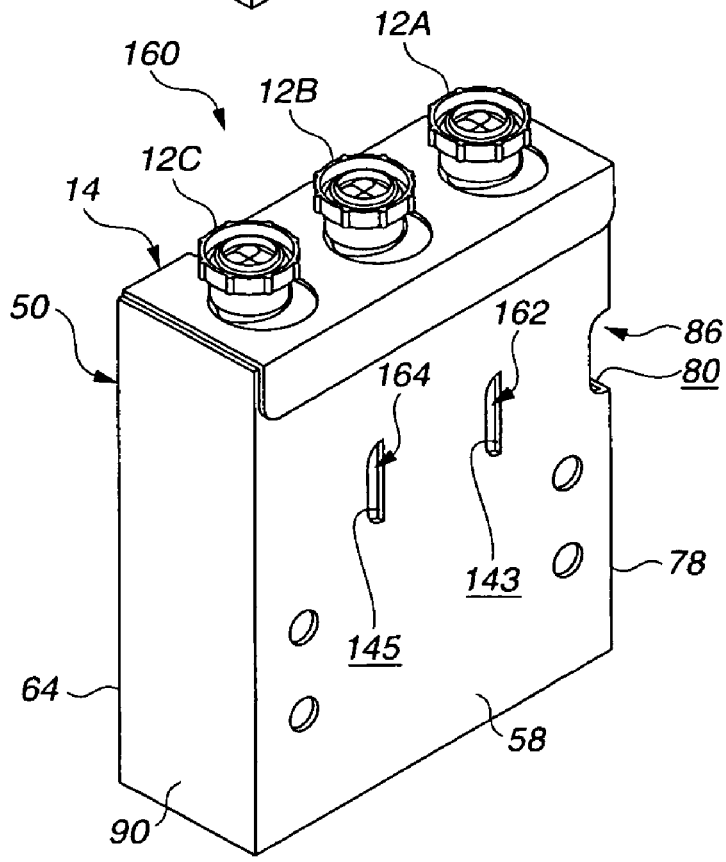
FIG. 22(B) is a perspective view looking from the rear face side thereof.

In the third embodiment as shown in FIG. 20(C) and FIGS. 22(A) and 22(B), the containers 12 are housed in the box 14 to have each recess 26 of all of the containers 12A, 12B and 12C directed leftward. In this storage mode, the body 50 of the storage box 14 has the opening 84 formed on the left side face 78 similar to the first embodiment; the openings 142 and 144 corresponding to the respective recesses 26 of the container 12B and 12C are formed on the front face 64; and the openings 143 and 145 corresponding to the respective recesses 26 of the containers 12B and 12C are formed on the back face 58.

In this manner, a third pattern towards prevention of erroneous loading is formed on the cartridge 160 of the third embodiment. The third pattern towards prevention of erroneous loading is formed of the first guide portion 86 identical to that in the first embodiment, the fourth guide portion 162, and the fifth guide portion 164. The fourth guide portion 162 is formed of the recess 26 of the container 12B and the openings 142 and 143. The fifth guide portion 164 is formed of the recess 26 of the container 12C and the openings 144 and 145.

Figure 23A:
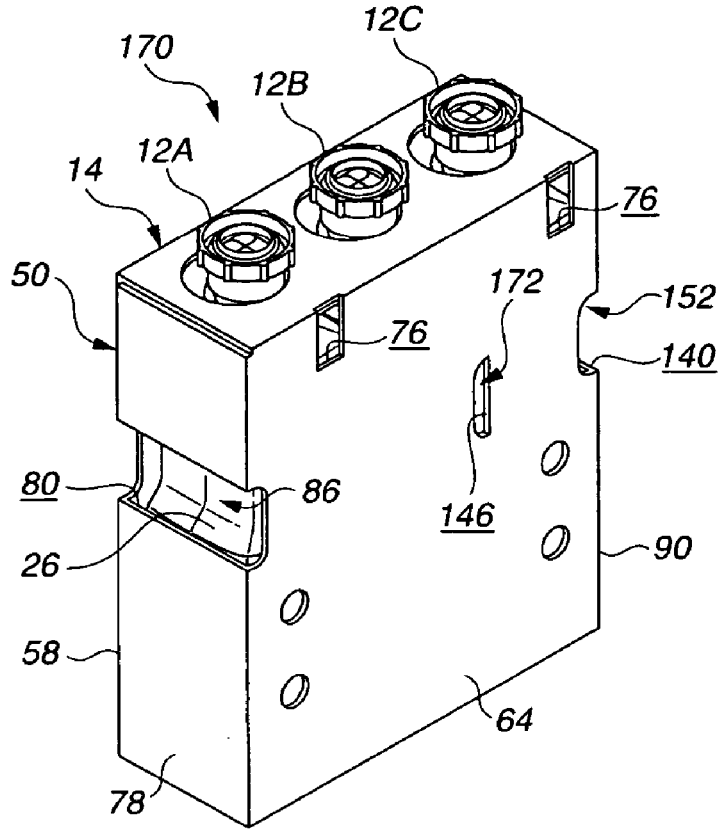
FIG. 23(A) is a perspective view of the cartridge for photographic processing agents looking from the front face side according to the fourth embodiment of the present invention.
Figure 23B:
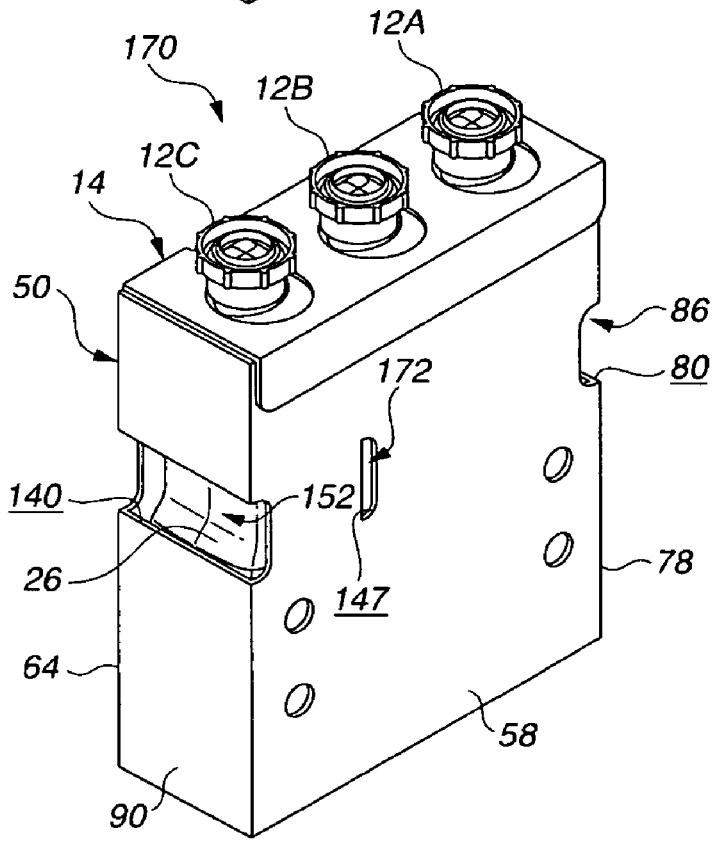
FIG. 23(B) is a perspective view looking from the rear face side thereof.

In the fourth embodiment as shown in FIG. 20(D) and FIGS. 23(A) and 23(B), the containers 12 are housed in the box 14 to have the recess 26 of the container 12A directed leftward and the each recess 26 of the containers 12B and 12C directed rightward. In this storage mode, the body 50 of the storage box 14 has the openings 84, 140, 146 and 147. The opening 84 is formed on the left side face 78. The opening 140 is formed on the right side face 90 in a manner similar to that of the second embodiment. The opening 146 corresponding to the recess 26 of the container 12B is formed on the front face 64. The opening 147 corresponding to the recess 26 of the containers 12B is formed on the back face 58.

Thus, the fourth pattern towards prevention of erroneous loading is formed on the cartridge 170 of the fourth embodiment. The fourth pattern towards prevention of erroneous loading is formed of the first guide portion 86, the third guide portion 152, and the sixth guide portion 172. The first guide portion 86 is similar to that in the first embodiment. The third guide portion 152 is similar to that in the second embodiment. The sixth guide portion 172 is formed of the recess 26 of the container 12B and the openings 146 and 147.

Figure 24A:
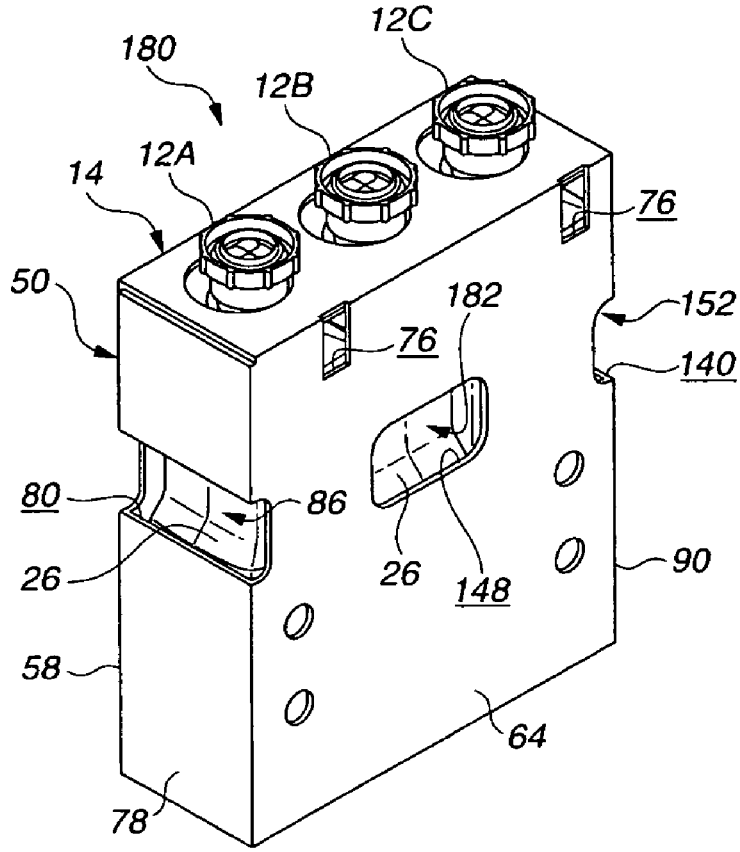
FIG. 24(A) is a perspective view of the cartridge for photographic processing agents looking from the front face side according to the fifth embodiment of the present invention.
Figure 24B:
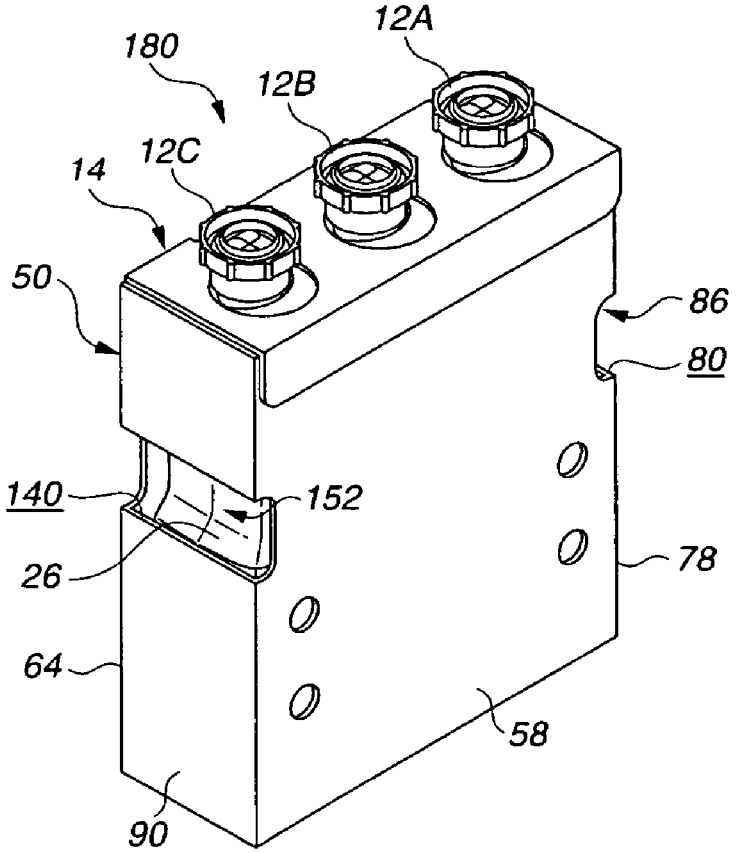
FIG. 24(B) is a perspective view looking from the rear face side thereof.

In the fifth embodiment as shown in FIG. 20(E) and FIGS. 24(A) and 24(B), the containers are housed in the box 14 to have the containers 12A, 12B and 12C directed in a manner similar to that in the second embodiment. In this housing mode, the body 50 of the box 14 has the openings 84, 140 and 148. The opening 84 is formed on the left side face 78. The opening 140 is formed on the right side face 90. The opening 148 corresponding to the recess 26 of the container 12B is formed on the back face 58.

In this manner, a fifth pattern towards prevention of erroneous loading is formed on the cartridge 180 for photographic processing agents according to the fifth embodiment. The fifth erroneous loading prevention pattern is formed of the first guide portion 86 identical to that in the first embodiment, the third guide portion 152 identical to that in the second embodiment, and the seventh guide portion 182 formed of the recess 26 of the container 12B and the opening 148.

According to the first to fifth embodiments, five kinds of patterns towards prevention of the erroneous loading can be formed. In addition, a large number of patterns towards prevention of erroneous loading can be simply formed, by changing the housing disposition of the containers 12A, 12B and 12C, respectively. For example, if three containers 12A, 12B and 12C are the same shape, 64 kinds of patterns towards prevention of the erroneous loading can be formed at the maximum. The guide protrusions corresponding to the pattern for preventing erroneous loading of the cartridge are formed in the cartridge loading chamber of the automatic photo-processor. When the cartridge is loaded to the automatic photo-processor, the operator can know the proper loading state of the cartridge, based on whether or not the guide portion and the guide protrusion are properly engaged.

As described above, in the cartridge 10 for photographic processing agents according to the embodiments, plural (e.g. three) containers 12, each of which is filled with a different kind of photographic processing agents, are held in the storage box 14. In the cartridge 10, the recesses 26 formed by locally deforming the outer side faces 22 of the containers 12 are aligned to the openings 80, 82, and 84 formed in the storage box 14, respectively. The cartridge 10 is loaded in the automatic photo-processor 100, by confirming whether or not the first guide portion 86 formed of the recess 26 and the opening 80 is properly engaged with the first guide protrusion 136 provided in the cartridge loading chamber 120 of the automatic photo-processor 100 and also whether or not the second guide portion 88 formed of the recess 26 and the openings 82 and 84 is properly engaged with the second guide protrusion 138 provided in the cartridge loading chamber 120 of the automatic photo-processor 100. In this manner, the erroneous loading of the cartridges 10 to the automatic photo-processor 100 can be prevented.

In order to change the number and the arrangement of recesses or guide portions to be formed on the cartridge 10, the containers 12 are housed in the storage box 14 to have each recess 26 of the containers 12 directed to a predetermined direction, and the openings (e.g. openings 80, 82, 84, 140, 142, 143, 144, 145, 146, 147, and 148) different in number and arrangement corresponding to the each recess are formed in the storage box 14. In this manner, a larger number of loading patterns for preventing the cartridge 10 from being erroneously loaded to the automatic photo-processor 100 can be simply formed on the cartridge 10.

According to the embodiments of the present invention, the containers 12 can be stored in the storage box 14 in such a manner that the disposition of the recess 26 of each container can be selected from any one of plural (e.g. four) dispositions. This facilitates to prepare the patterns towards prevention of erroneous loading to be adapted to the recesses 26 different in number and arrangement. When the two recesses 26 of the containers 12 faces each other, a recess different from and larger than a single recess 26 in shape can be formed. This allows to prepare a larger number of patterns towards the prevention of erroneous loading.

In these embodiment of the present invention, it is possible for the tetragonal bottle shaped container to reduce the waste spaces formed around containers 12 in the box 14 and also between the containers 12 and the box 14. Furthermore, a single recess (26) is formed on any one of the four outer side faces 22 of the container 12. Therefore, the containers 12 can be stored into the box 14 so as to select any of four dispositions of the recess 26 of each container, while reduction in the volume of each container is suppressed as compared with the container on which plural recesses are formed.

According to the embodiments of the present invention, three containers 12 used in the cartridge have the same shape. Namely, one kind of the container 12 made of the same material having the same shape is used in the cartridge of the present invention. Accordingly, the production control of the containers 12 and cartridges 10 can be effected easily, and the production costs can be suppressed.

Figure 25:
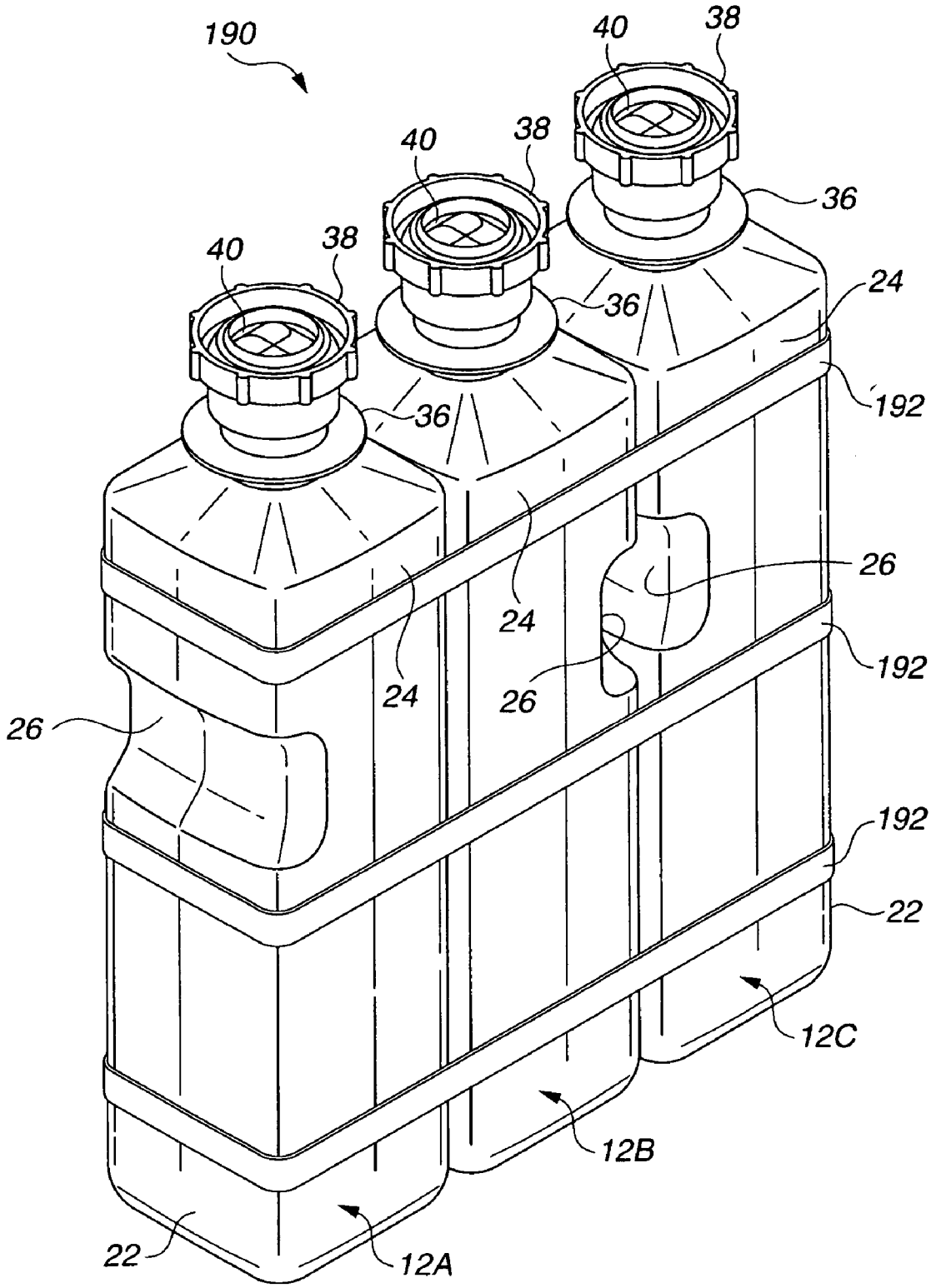
FIG. 25 is a perspective view of the cartridge for photographic processing agents looking from the front face side according to the sixth embodiment of the present invention.

FIG. 25 shows a sixth embodiment of the present invention in which a tape (binding member) is used as the holding member of a set of three containers 12 in the first embodiment. The explanation will be omitted by affixing the same reference numerals to the same elements as those in the first embodiment.

In the cartridge 190 for photographic processing agents according to the sixth embodiment as shown in FIG. 25, three containers 12A, 12B and 12C are bundled together with three tapes 192. Each recess 26 of the containers 12A, 12B and 12C are oriented in a manner similar to that in the first embodiment. Outer side faces 22 are in contact with each other and the containers 12A, 12B and 12C are arranged in row. Using the three tapes 192, the containers 12A, 12B and 12C are bundled at the upper and lower portions of the bodies 24 and at the middle portions of the bodies 24 slightly below the recesses 26 thereof. Thus, each recess 26 of the containers 12A, 12B and 12C is exposed without being covered with the tape 192.

The tape 192 is made of a thermoplastic material. When the containers 12A, 12B and 12C are bundled, a predetermined length of the tape 192 is wound around the bodies 24 of the containers 12A, 12B and 12C under a predetermined tension, and the both ends of the tape 192 are overlapped and thermally welded.

In the cartridge 190 according to the sixth embodiment of the present invention, three containers 12A, 12B and 12C are bundled as one set with three tapes 192. The recesses 26 are exposed without being covered with the tape 192, and a pattern towards the prevention of erroneous loading is formed similar to that in the cartridge 10 of the first embodiment. Similarly to those mentioned above, in the cartridge 190, by rotating each of the containers 12A, 12B and 12C around its axis at the intervals of 90°, the arrangement of the recesses 26 can be changed so that a large number of patterns towards prevention of erroneous loading can be easily formed. Moreover, the use of the tape 192 suppresses the production costs of the cartridge 190. If a plastic tape is used, the plastic tape 192 can be recycled, which is preferable.

Based on the above first to sixth embodiments, the present invention is described in detail. However, the present invention should not be limited only to the above embodiments. Other various embodiments may be attained within the scope of the present invention.

For example, in the above embodiments, plural (e.g. three) containers having the same shape are used, but the present invention is not limited particularly to those. For example, various kinds of the containers having or not having the recess, the number and arrangement of which is different from the previous embodiments, may be combined together. In this regard, the container may have two or more recesses, but not limited only to one recess. When two or more recesses are formed in one container, such as polyhedron (e.g. rectangular) bottle shaped container, the plural recesses may be formed in the same outer side face or in plural outer side faces thereof. The containers are not limited to rectangular in shape, and may be another polygonal-bottle or cylindrical in shape. When the recesses are formed on polygonal bottle shaped containers, the plural recesses may be formed in the same outer side face or in plural outer side faces thereof. The recess may be formed on the bottom (bottom face) of the container, as well as the rectangular outer side face or the cylindrical outer peripheral face. The shape and size of the recess is not particularly limited, as far as the guide protrusions provided in the automatic photo-processor are engageable. However, if the recess is larger, the overall size of the container becomes bigger in order to keep the required volume of the container. Thus, it is preferable that the recess is as small as possible taking the size and shape of the container into consideration, within the range in which the guide protrusion is engageable. Two, four or more containers may be set in the cartridge, as well as the above three containers.

In the embodiments explained above, the four grooves 44 formed on the packing 40 for closing the mouth 37 of the container 12 extend radially to form curved lines, but the present invention is not limited to this. For example, the packing may have four grooves extending radially and straight to make a cross, or may have a single straight groove to make a straight line.

The storage box (casing member; also referred to as a cartridge box) may be, for example, a plastic box, but not limited to the corrugated paper box as explained above. The cutouts 212 used for preventing the conventional container from erroneously loading are left in the above-described storage box 14, but they may be removed. The presence or absence of the cutout 212 and the cutouts 212 different in number and arrangement may be combined to form the pattern towards prevention of erroneous loading of the present invention. As a result, a larger number of patterns towards prevention of erroneous loading may be prepared.

The holding member for a set of plural containers is not limited to a case, such as a box for storing plural containers or to a tie such as a tape for bundling plural containers. For example, the fastening member such as a film material for wrapping plural containers may be used.

The shape and the size of the recess is not limited particularly to those explained in the embodiments described above, if the guide protrusion formed in the automatic photo-processor is engageable with the recess and the recess has the depth not to damage the washing capability in the container. However, due to variance in the dimensional precision of the nozzle orifice of the washing nozzle 130, and to variance in the pump performance, or the like, the spray condition of the washing liquid W may changes somewhat. For example, the washing liquid spray pressure decreases or the washing liquid spray angle increases. If the recess is formed extending over the shoulder adjacent to the body (outer side face) of the container, the upper portion of the recess becomes a void or opened. In this state, the rigidity of the vicinity of the shoulder cannot be maintained to the necessary mechanical strength, and the container may be liable to be deformed.

Accordingly, taking the above into consideration, the position (H5) of the lower end of the recess is generally above more than ⅓ of the height (H4) of the outer side face of the container measured from the bottom line L1, and preferably above more than ½ of H4 measured from the bottom L1. More preferably, the position (H5) of the lower end of the recess is above more than ⅔ of H4 measured from the bottom line L1 but below the range within 5 mm in vertical (height) direction from the upper end of the outer side face. When the lower end of the recess is disposed at a position above more than ⅓ of the height of the outer side face of the container measured from the bottom line (e.g. about 83 mm in the case of the container 12), it can be avoided to deteriorate the washing capability in the inside of the container in the normal spraying of a washing liquid. Moreover, when the lower end of the recess is disposed at a position above more than ½ of the height of the outer side face of the container measured from the bottom line (e.g. about 125 mm in the case of the container 12), it can be avoided to deteriorate the washing capability in the inside of the container even if the spraying state of the washing liquid varies somewhat. Moreover, when the lower end of the recess is disposed at a position above more than ⅔ of the height of the outer side face of the container measured from the bottom line (e.g. about 167 mm in the case of the container 12) and below the range within 5 mm in the vertical direction from the upper end of the outer side face (e.g. about 245 mm in the case the container 12), it can be avoided most satisfactorily to deteriorate the washing capability in the inside of the container even if the spraying state of the washing liquid varies somewhat and the rigidity of the vicinity of the shoulder of the container can be maintained to the required mechanical strength.

The largest depth (D1) of the recess is ½ or less, preferably ¼ or less of the thickness (L1) of the container. More preferably, the depth (D1) is ⅙ or less of the thickness (L1). When the largest depth of the recess is ½ or less of L1 (e.g. about 39 mm in the case of the container 12), it can be avoided to deteriorate the washing capability in the inside of the container in the normal spraying of the washing liquid. When the largest depth of the recess is ¼ or less of L1 (e.g. about 20 mm in the case of the container 12), it can be avoided to deteriorate the washing capability in the inside of the container even if the spraying state of the washing liquid varies somewhat. When the largest depth of the recess is ⅙ or less of L1 (e.g. about 13 mm in the case of the container 12), it can be best avoided to deteriorate the washing capability in the inside of the container even if the spraying state of the washing liquid varies somewhat, and it can also be avoided to increase in size with the container.

The height (H6) of the recess is 10 mm or more and less then a value obtained by subtracting 5 mm from ⅔ of the height of the outer side face of the container. Preferably, the height (H6) ranges from 20 mm to 100 mm. When the recess has a height of 10 mm or more, it can be engaged with the protrusion for prevention of the erroneous loading of the containers. When the height of the recess is less than a value obtained by subtracting 5 mm from ⅔ of the height of the outer side face of the container (e.g. about 162 mm in the case of the container 12), the region of 5 mm in the height direction not having the recess can be reserved at the upper end of the outer side face, thus the rigidity of the area around the shoulder of the container can be maintained to the required mechanical strength. When the height of the recess is 20 mm or more, the protrusion for prevention of the erroneous loading of the container can be increased in size, resulting in improving mechanical strength of the protrusion. When the height of the recess is 100 mm or less, the container can be avoided to increase in size.

The volume of the recess is preferably 30% or less of the volume of the body of the container, more preferably 10% or less thereof. When the volume of the recess is at least 30% of the volume of the body of the container, the recess is engageable with the protrusion for prevention of the erroneous loading of the container. When the volume of the recess is 10% or less of the volume of the body of the container, the recess is engageable with the protrusion for prevention of the erroneous loading of the container while suppressing increasing in size of the container.

The maximum volume (V1) of the recess in the rectangular container can be calculated using the following formula (1) from the above conditions:

Maximum volume ($V1$) of a recess={largest height up to the recess (corresponding to ⅔ of height ($H4$) of an outer side face (body) of a container)}×{largest depth of the recess (corresponding to ½ of one width ($L1$) of the container)}×{width of the recess (corresponding to another width ($L1$) of the container)} Formula (1)

The volume (V2) of the body in the rectangular container can be calculated using the following formula (2):

Volume ($V2$) of the body of the container={height ($H4$) of the outer side face (body) of the container}×{one width ($L1$) of the container}×{another width ($L1$) of the container} Formula (2)

The ratio (R) of the maximum volume of the recess to the volume of the body in the rectangular bottle shaped container can be calculated by the following formula (3):

Ratio ($R$)={(Maximum volume ($V1$) of the recess)/(Volume ($V2$) of the body of the container)}×100(%) Formula (3)

Using the formulae (1) to (3), V1, V2 and R of the container 12 are calculated as shown below. However, the reduction in volume caused, for example, by the skin thickness, the rounded corner forming the boundary between the bottom 20 and the body 24, the recess in the middle of the bottom 20, four rounded corners in horizontal cross section of the body 24, and the curved region of the outer side face 22, is ignored.

$V1$=(about 250 mm×⅔)×(about 78×½)×about 78 mm=about 507 mL $V2$=about 250 mm×about 78 mm×about 78 mm=about 1521 mL $R$=(about 507 mL/about 1521 mL)×100=about 33.3 (%)

If the region not having the recess corresponding to a height in the range of 5 mm is retained at the upper end of the outer side face 22 of the container 12, the volume of the recess is about 492 mL, which is calculated from: {(about 250 mm×⅔)−5 mm}×(about 78 mm×½)×about 78 mm. The ratio of the volume of the recess to the volume of the body 24 of the container 12 is about 32.3(%), which is calculated from: (about 492 mL/about 1521 mL)×100.

Modified embodiments of the present invention are further described below with reference to the drawings.

Figures 1, 31:
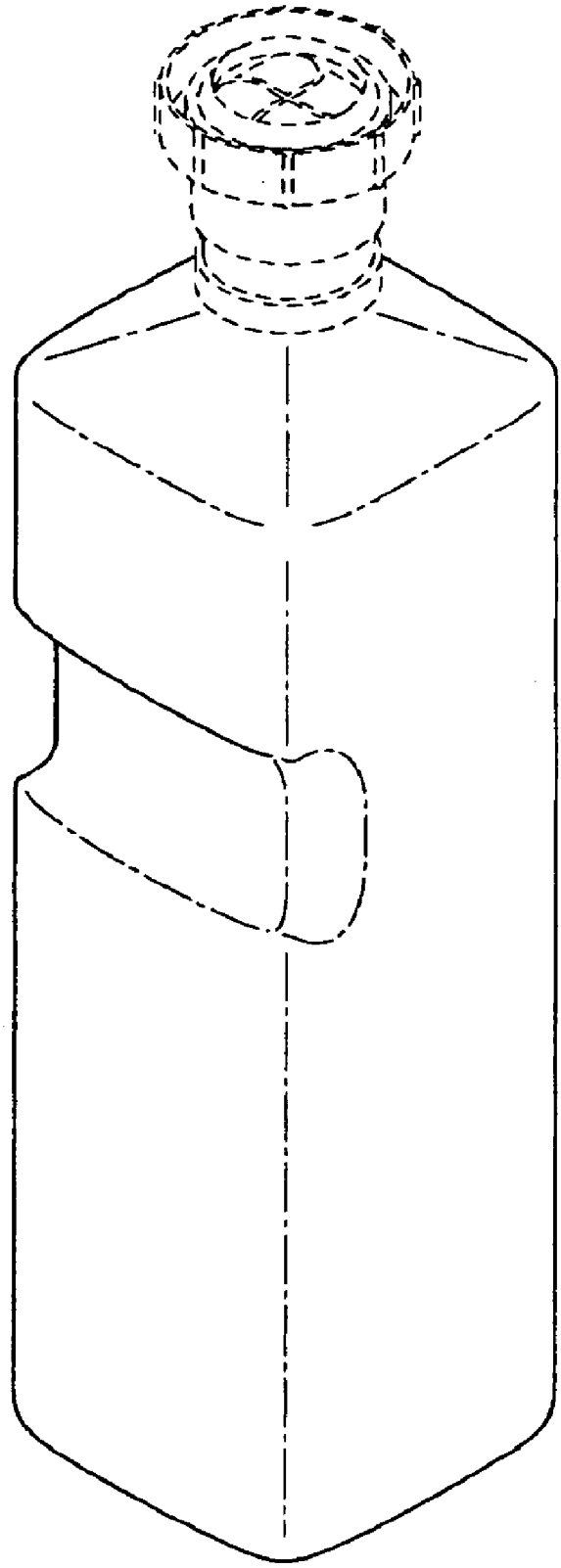
Figures 2, 31:
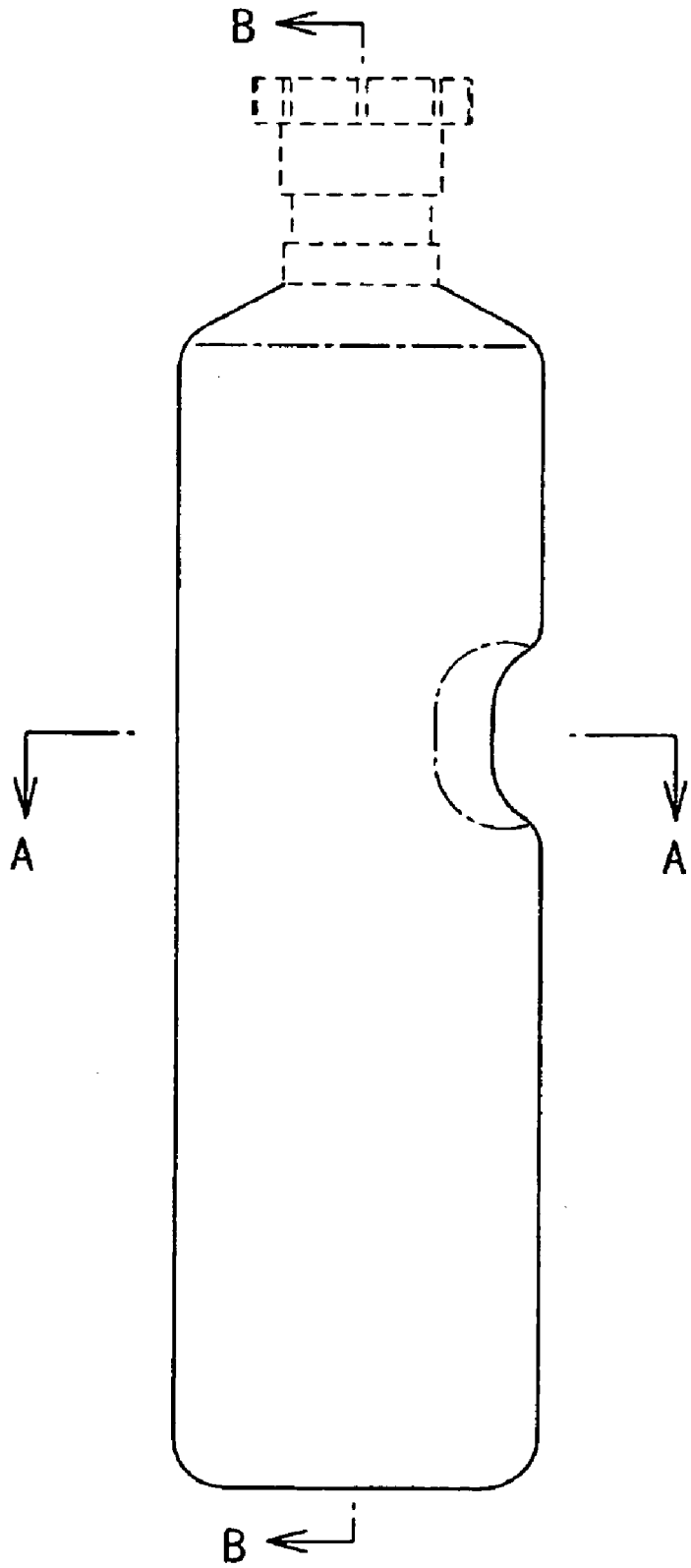
Figures 3, 31:
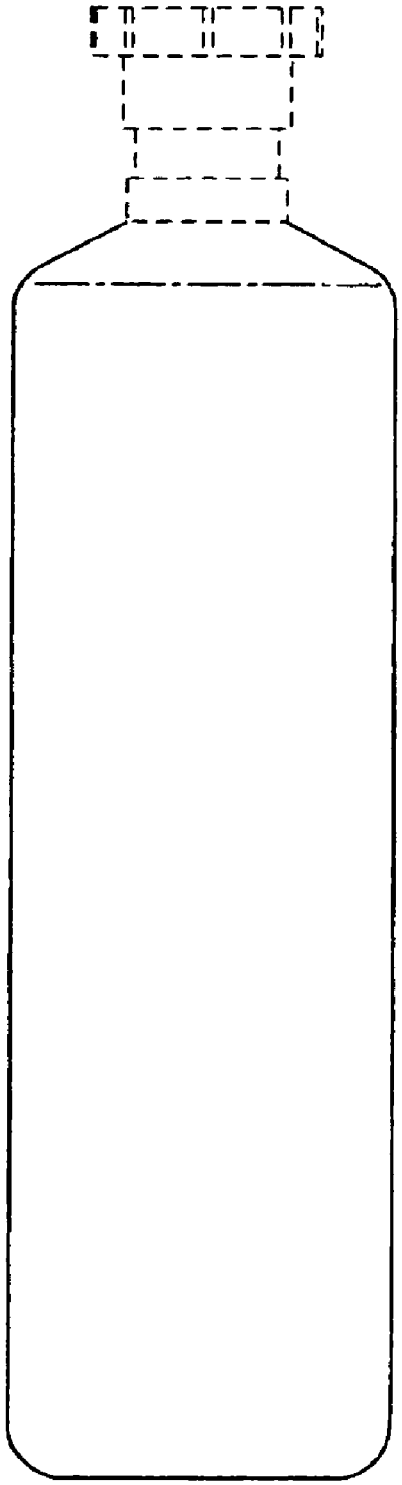
Figures 4, 31:
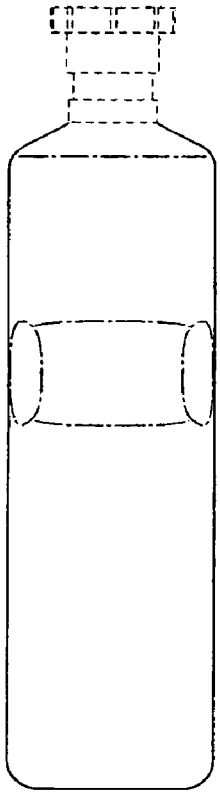
Figures 5, 31:
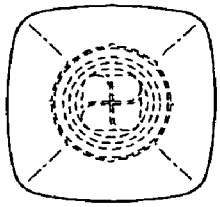
Figures 6, 31:
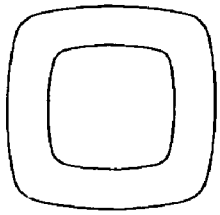
Figures 7, 31:
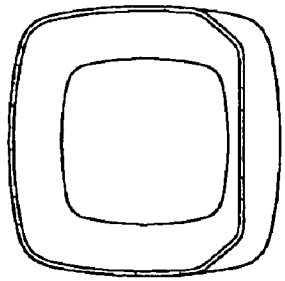
Figures 8, 31:
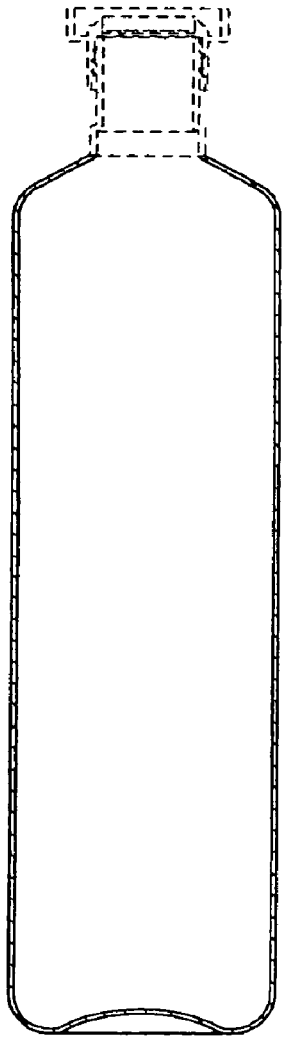
Figures 9, 31:
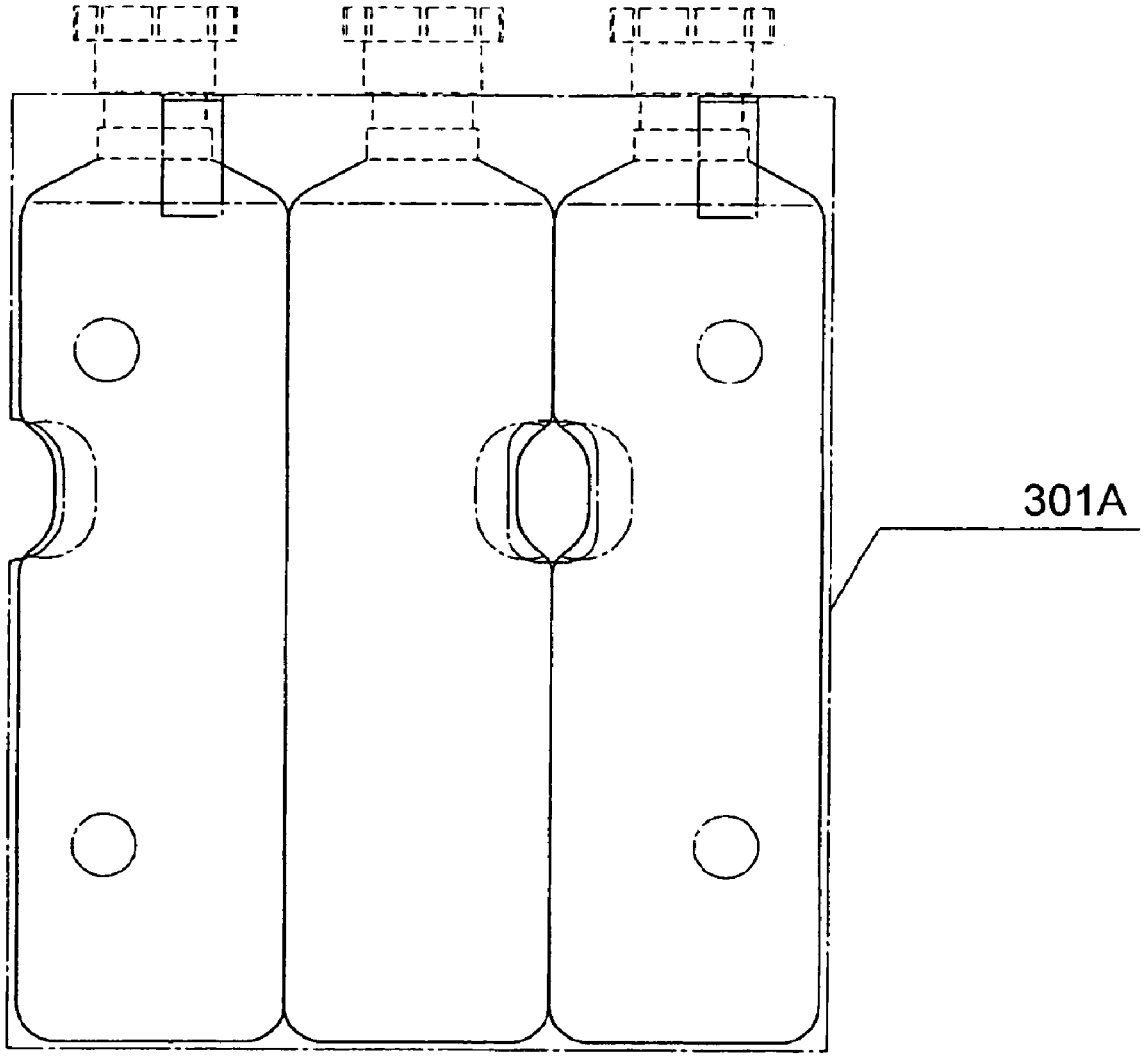
Figures 10, 31:
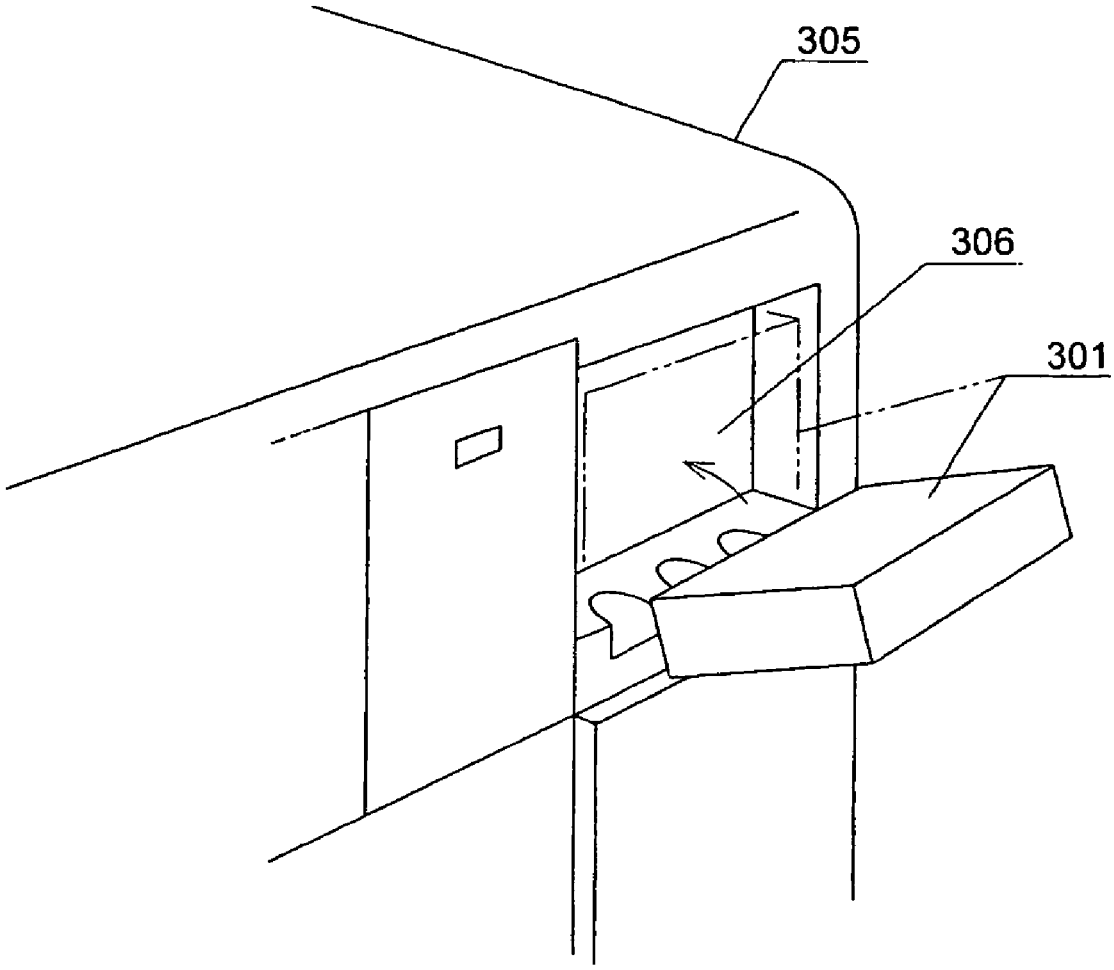

A modified embodiment of the present invention is a replenisher container (hereinafter also referred to as a container for a photographic processing agent) as illustrated in FIGS. 31-1, 31-2, 31-3, 31-4, 31-5, 31-6, 31-7, and 31-8 from which processing solution is replenished to an automatic processor. The container can be housed in a cartridge box, to form a cartridge (301A) as illustrated in FIG. 31-9. As illustrated in FIG. 31-10, the cartridge (301) is flipped upside down and inserted into a cartridge loading chamber (306) of an automatic processor (305), allowing one-step exchange of the cartridge. (In this connection, the cartridge (301) is a generic concept for 301A to 301K, and it can be any of the cartridges mentioned hereinafter). In FIGS. 31-1 to 31-8, the solid-line portions indicate characteristic portions of this container. The dash dot lines in FIGS. 31-1 to 31-5 illustrate the shapes of the three-dimensional surfaces of the container.

Figures 1, 32:
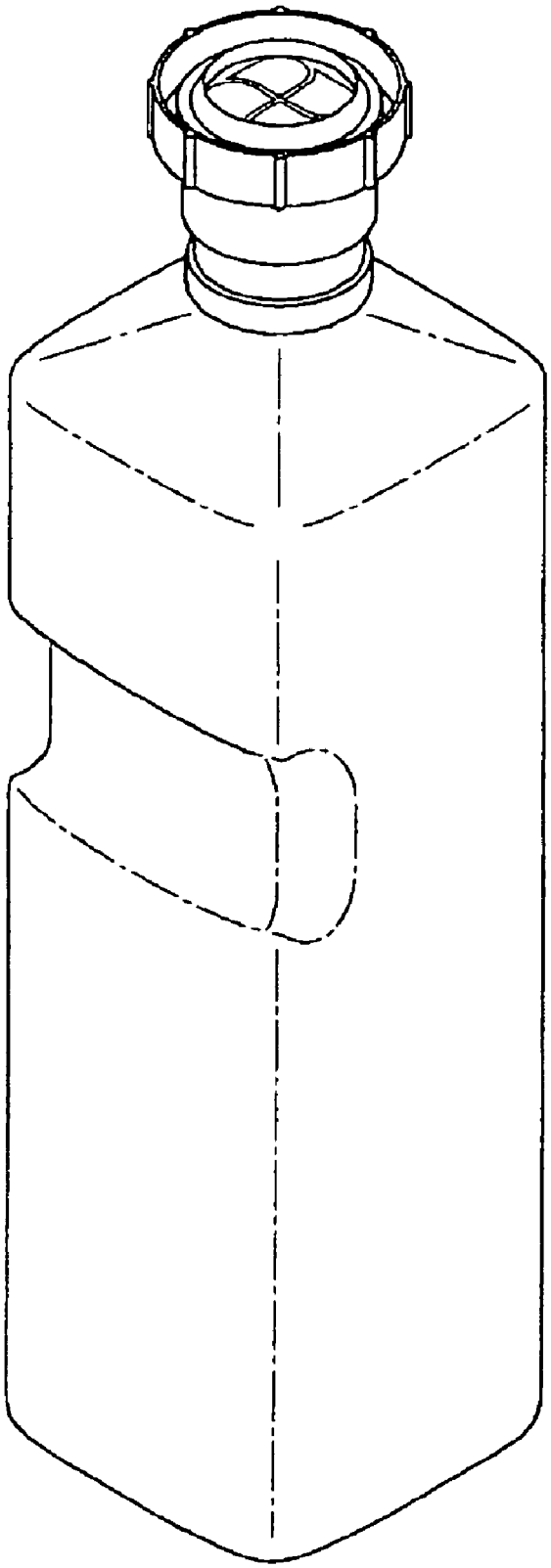
Figures 2, 32:
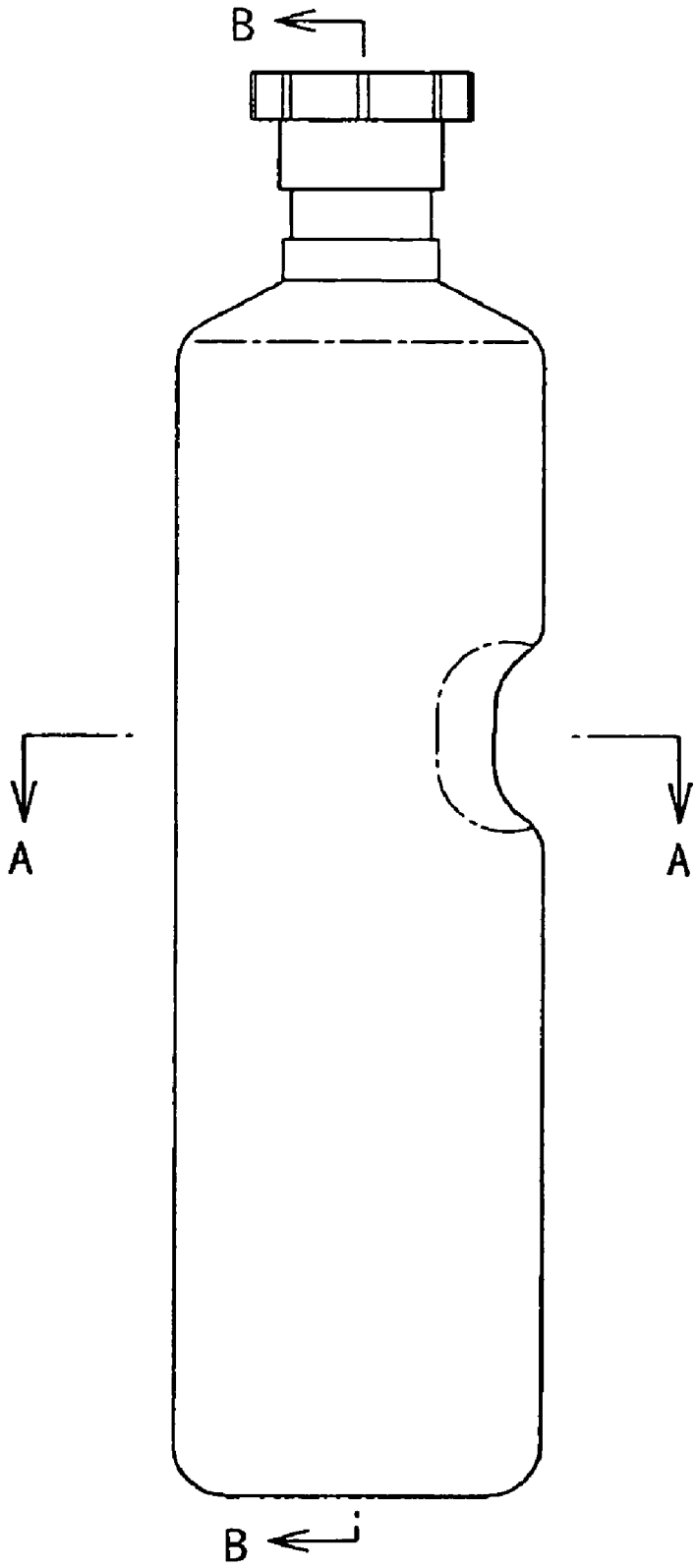
Figures 3, 32:
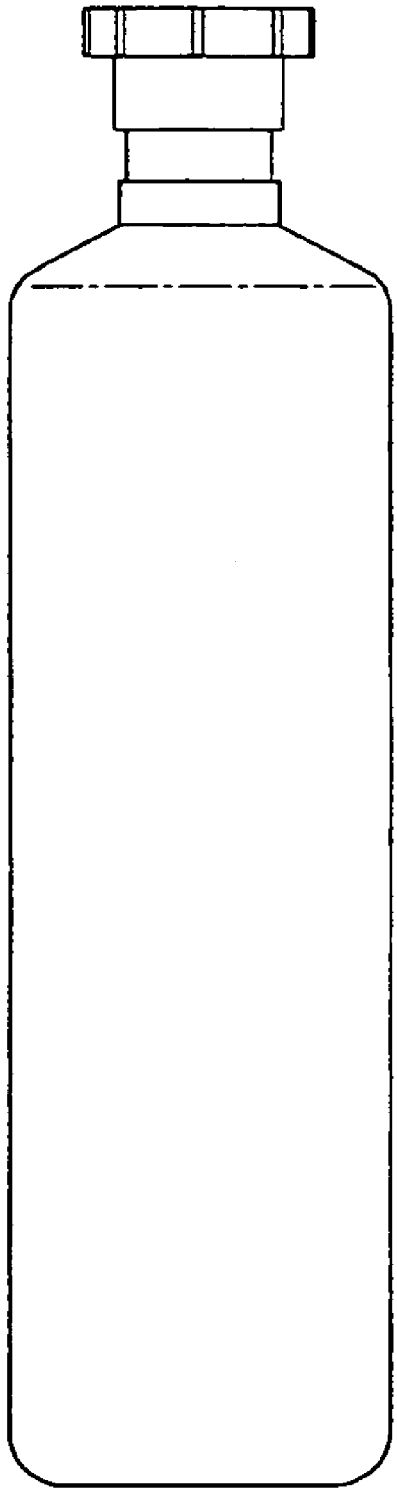
Figures 4, 32:
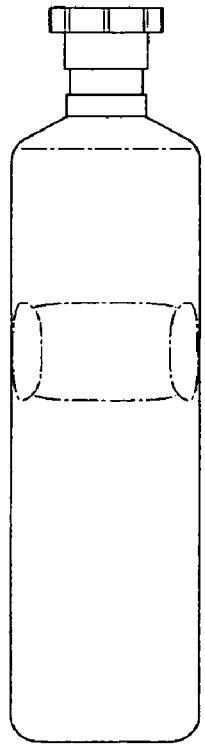
Figures 5, 32:
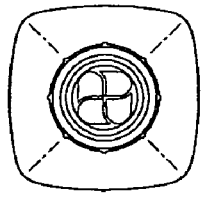
Figures 6, 32:
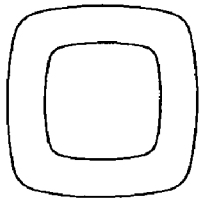
Figures 7, 32:
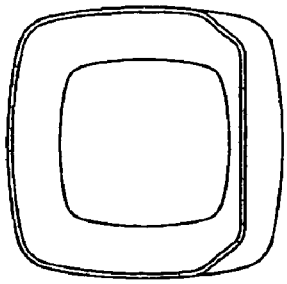
Figures 8, 32:
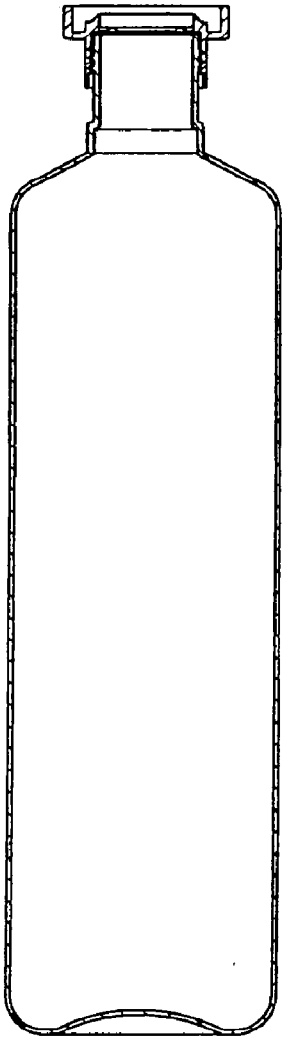
Figures 9, 32:
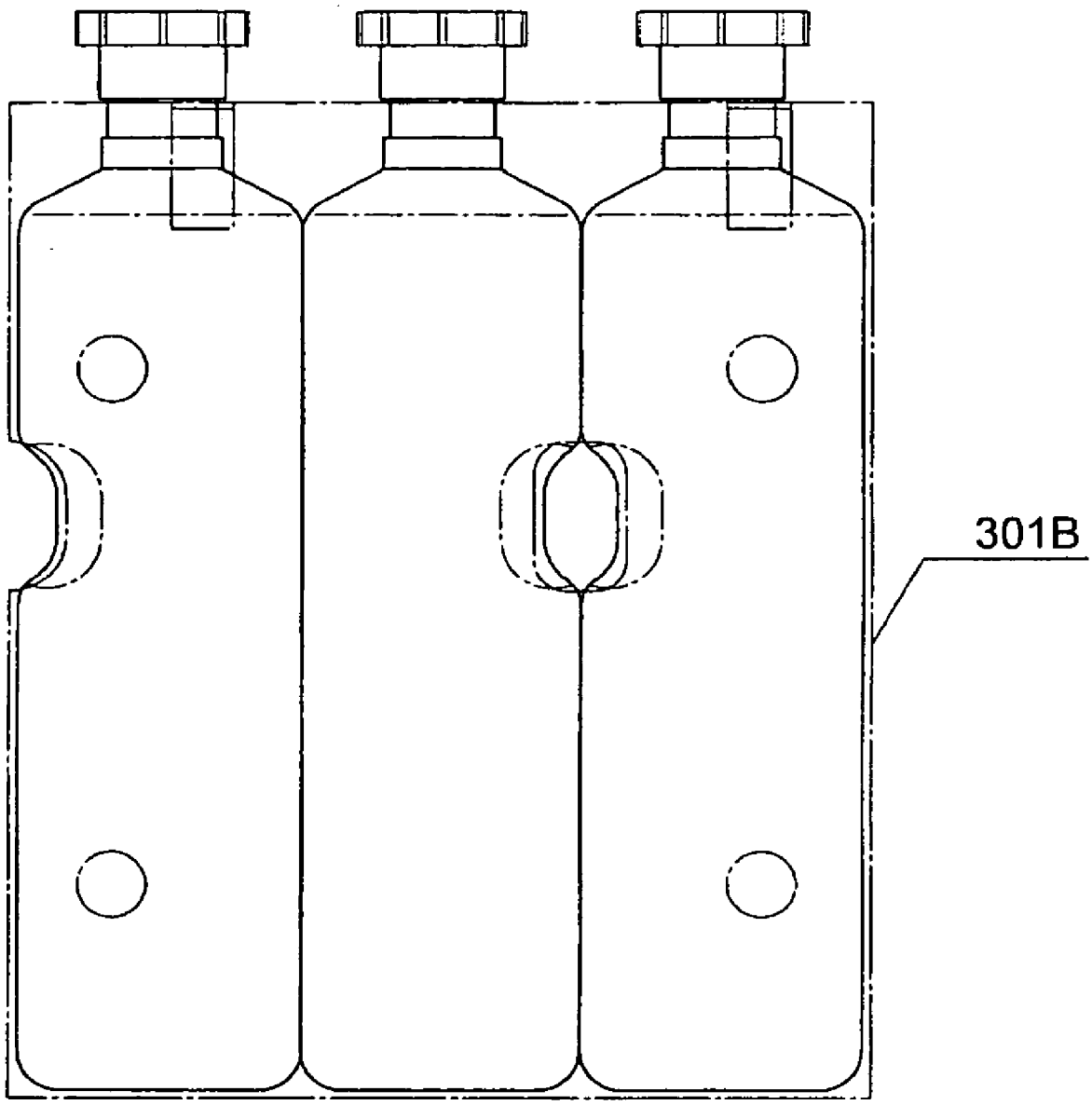

Another modified embodiment of the present invention is a replenisher container as illustrated in FIGS. 32-1, 32-2, 32-3, 32-4, 32-5, 32-6, 32-7, and 32-8, from which processing solution is replenished to an automatic processor. The container can be housed in a cartridge box, to form a cartridge (301B) as illustrated in FIG. 32-9. As illustrated in FIG. 31-10, the cartridge is flipped upside down and inserted into an automatic processor, allowing one-step exchange of the cartridge. The dash dot lines in FIGS. 32-1 to 32-5 illustrate the shapes of the three-dimensional surfaces of the container.

Figures 1, 33:
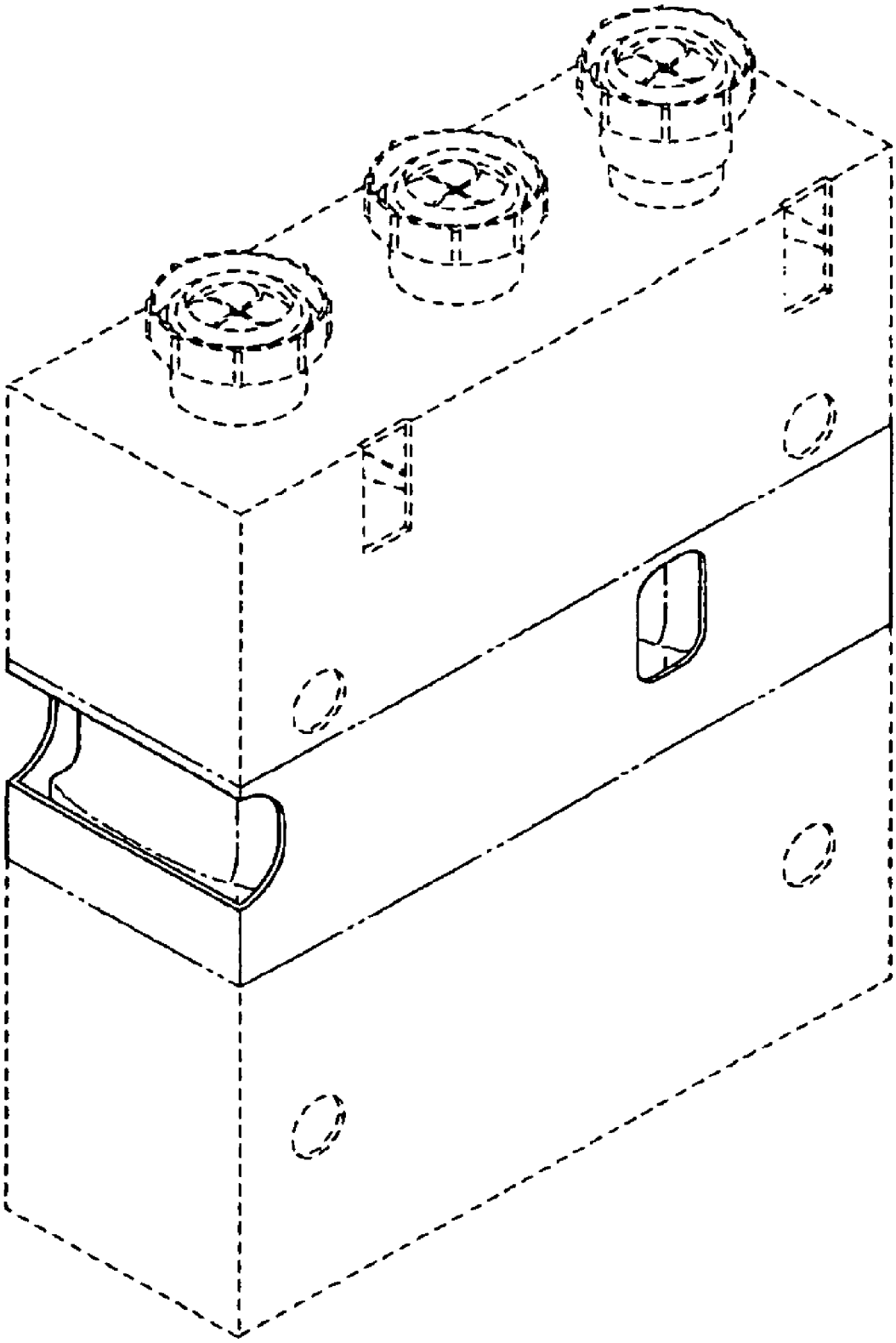
Figures 2, 33:
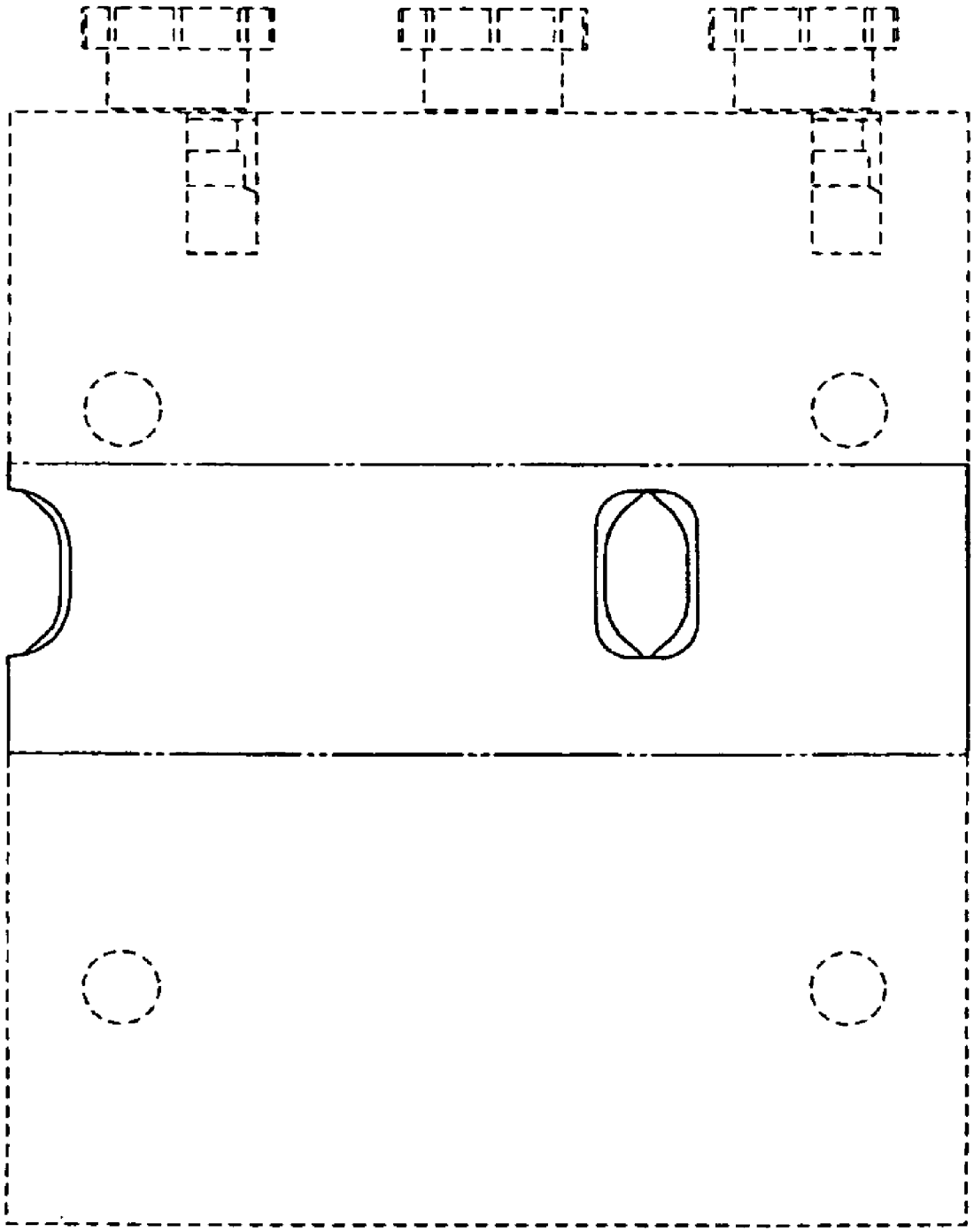
Figures 3, 33:
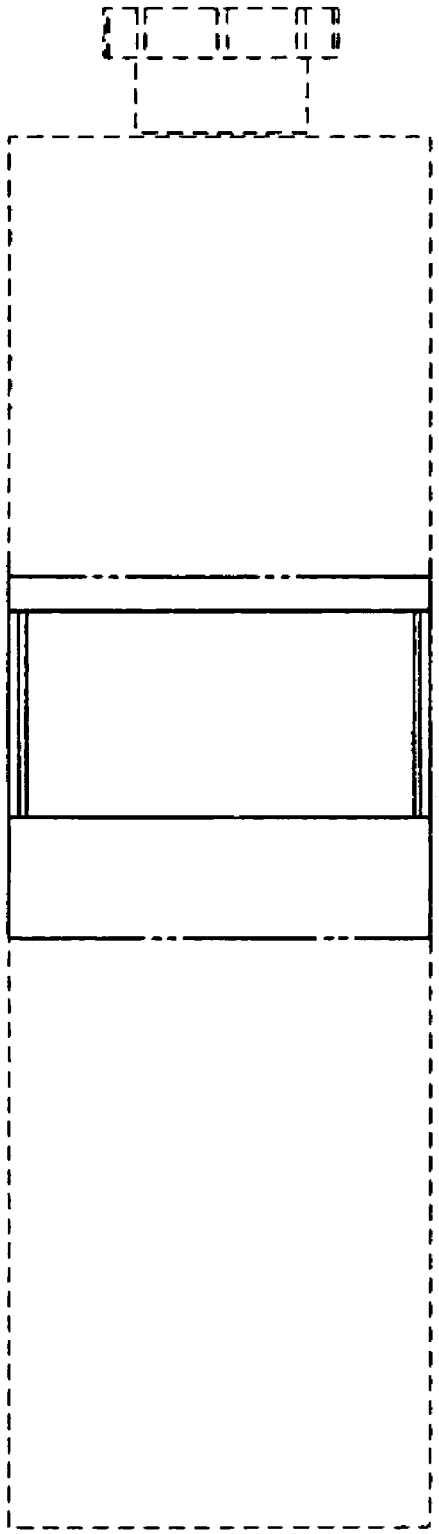
Figures 4, 33:
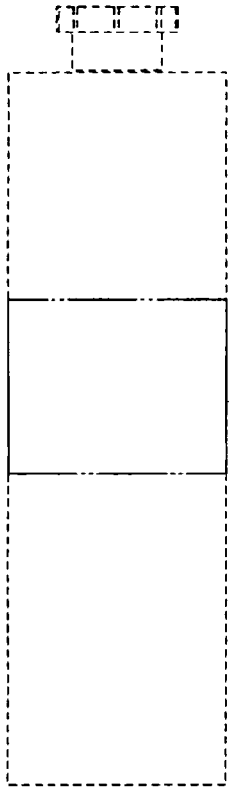
Figures 5, 33:
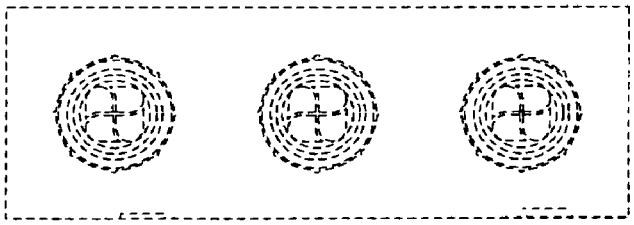
Figures 6, 33:
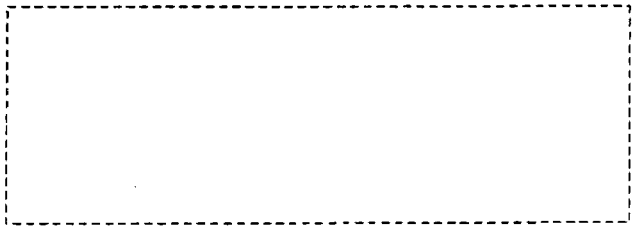
Figures 7, 33:
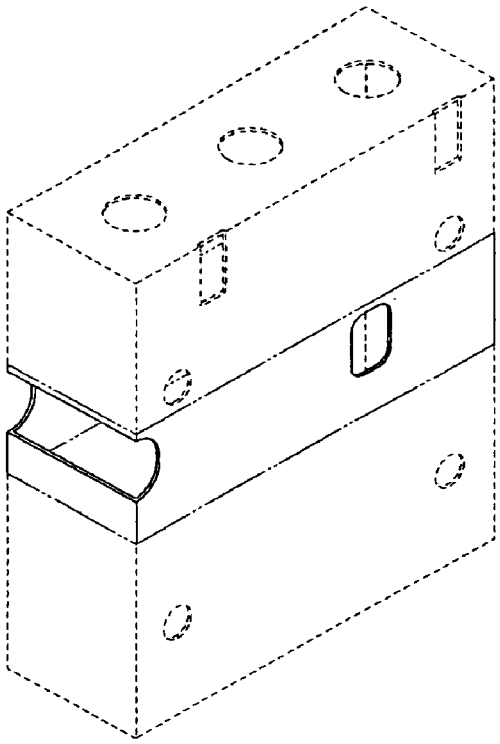
Figures 8, 33:
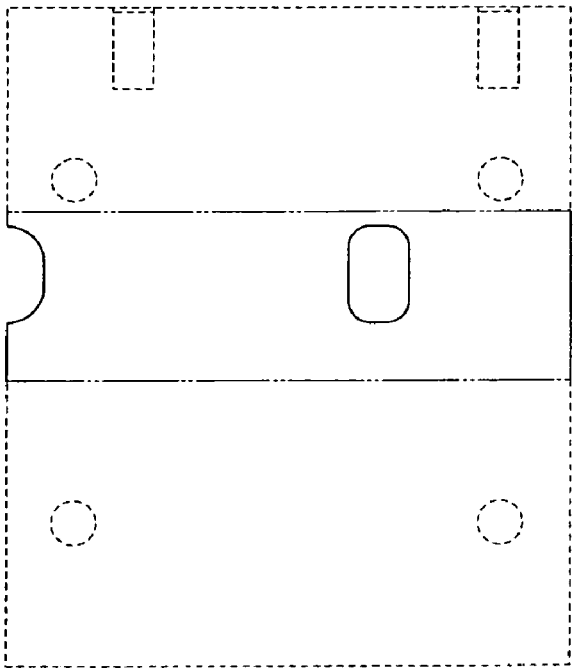
Figures 9, 33:
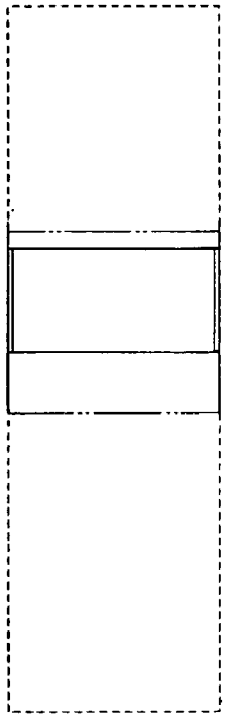
Figures 10, 33:
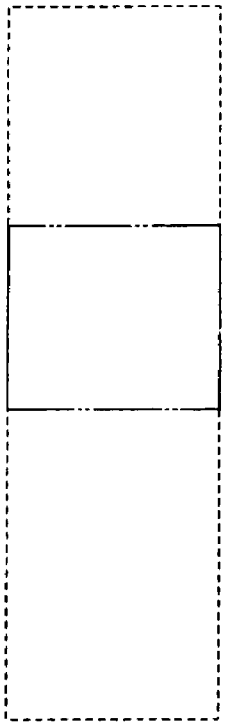
Figures 11, 33:
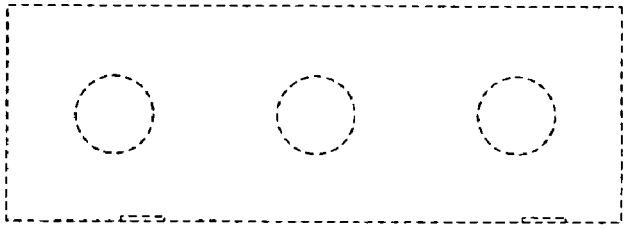
Figures 12, 33:
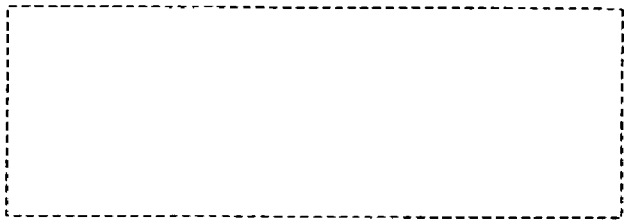
Figures 13, 33:
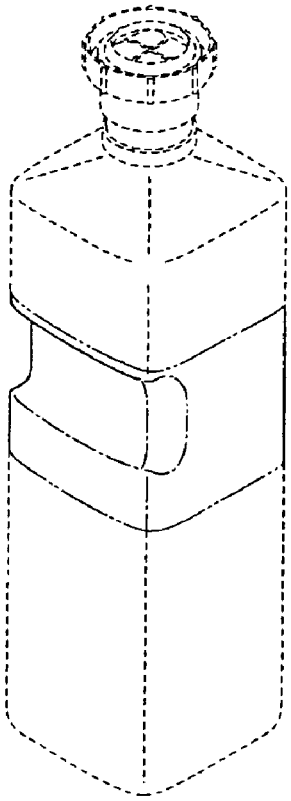
Figures 14, 33:
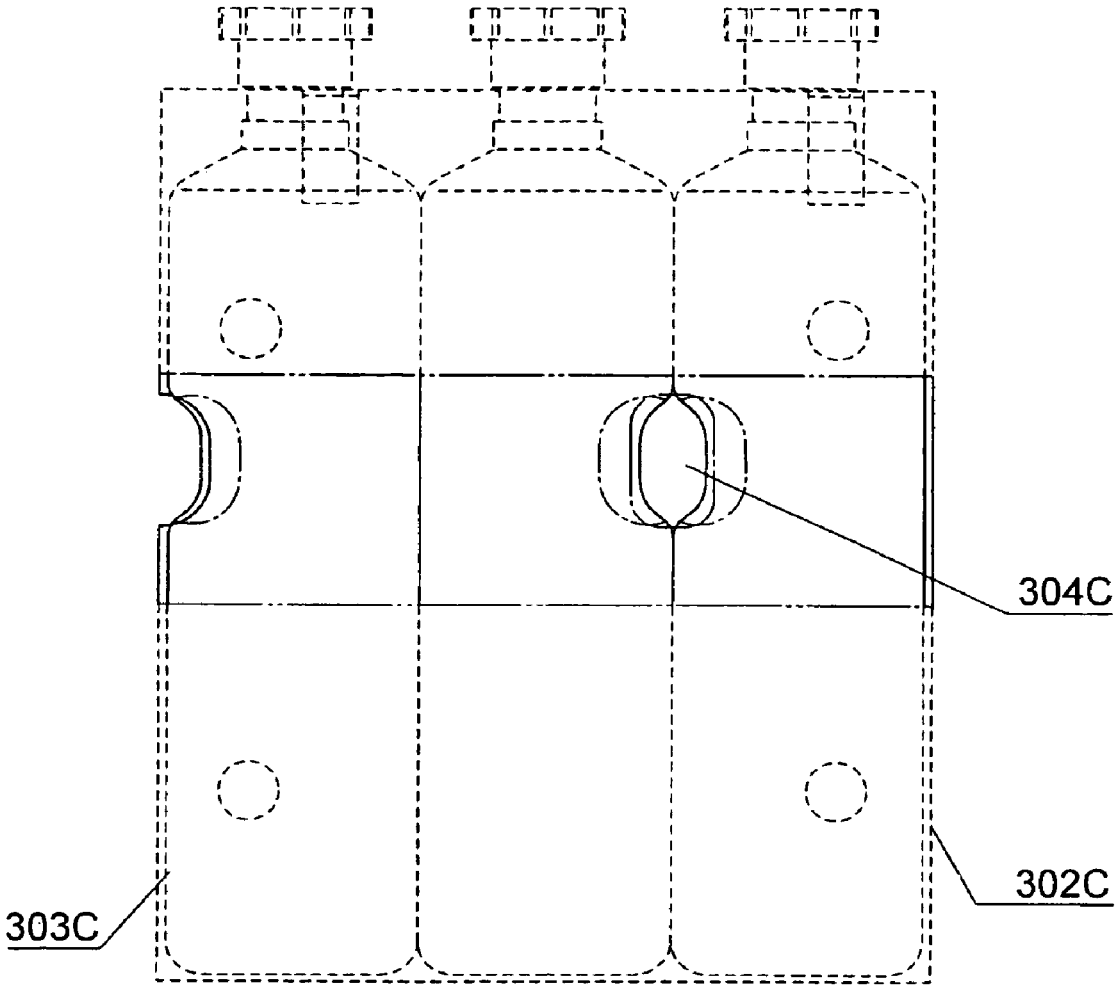

Another modified embodiment of the present invention is a cartridge as illustrated in FIGS. 33-1, 33-2, 33-3, 33-4, 33-5, and 33-6, for replenishing processing solution to an automatic processor. This cartridge comprises a cardboard cartridge box (302C) containing three (3) replenisher containers (303C) in a row, as illustrated in FIG. 33-14. The cartridge has a through hole (304C). As seen in FIG. 31-10, the cartridge is flipped upside down and inserted into an automatic processor, allowing one-step exchange of the cartridge. The cartridge is supplied, used, and removed as it is. The outline of the cartridge is illustrated with dashed lines, and the portions enclosed in solid lines and dash double-dot lines indicate characteristic portions of this cartridge. The dash dot lines in the perspective views of the cartridge illustrate the shapes of the three-dimensional surfaces of the cartridge.

Figures 1, 34:
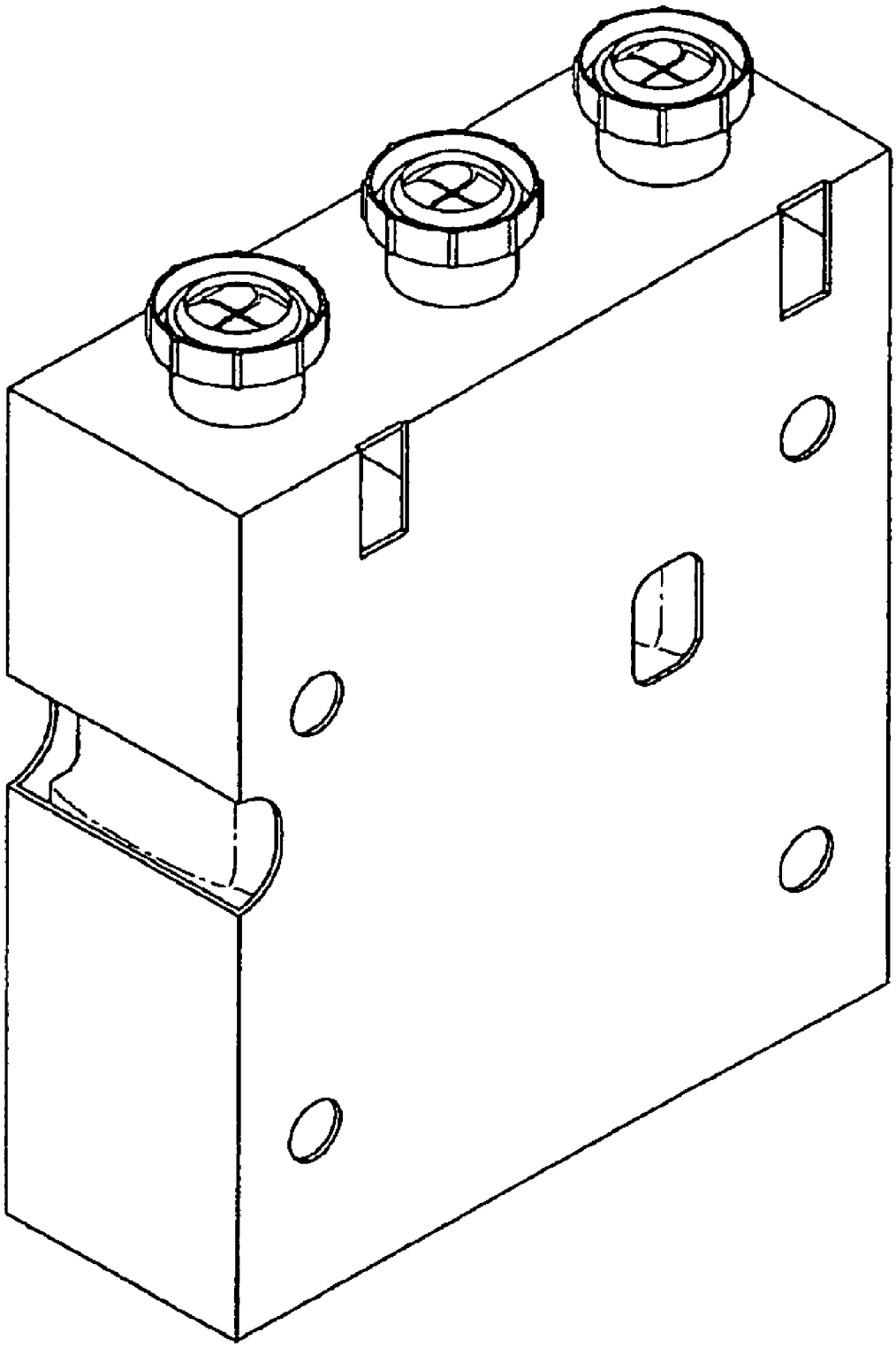
Figures 2, 34:
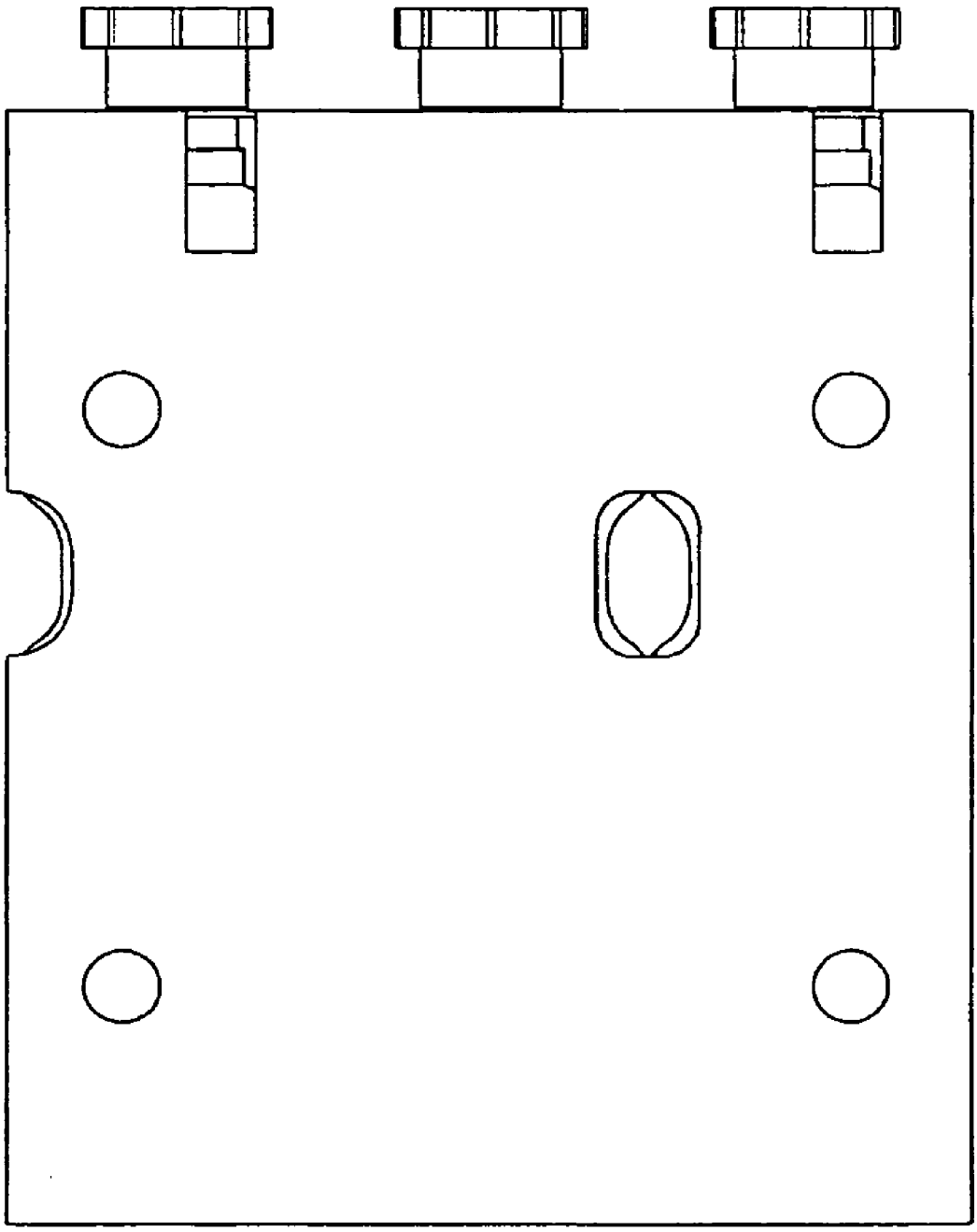
Figures 3, 34:
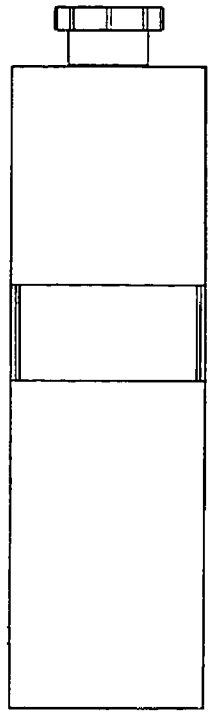
Figures 4, 34:
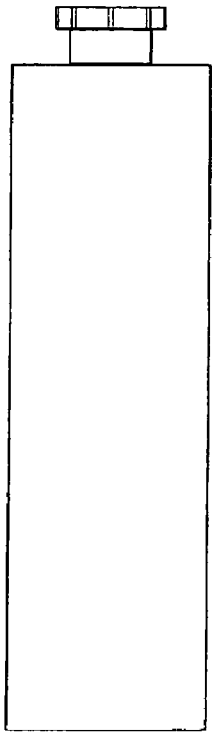
Figures 5, 34:
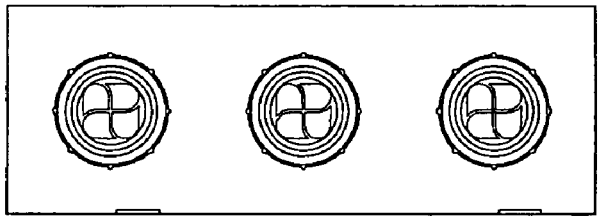
Figures 6, 34:
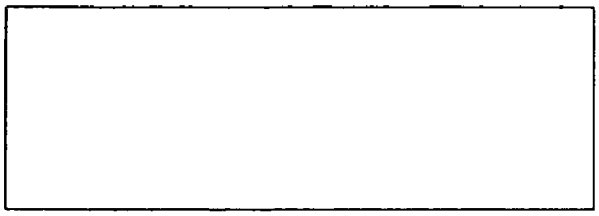
Figures 7, 34:
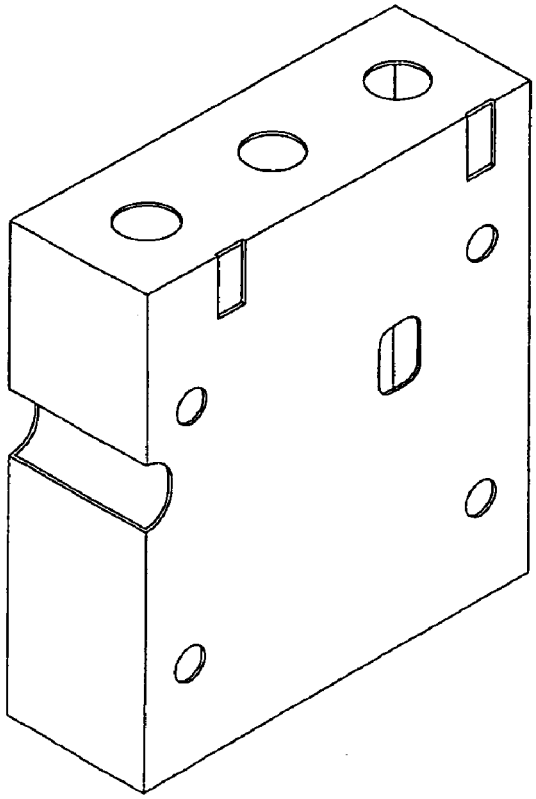
Figures 8, 34:
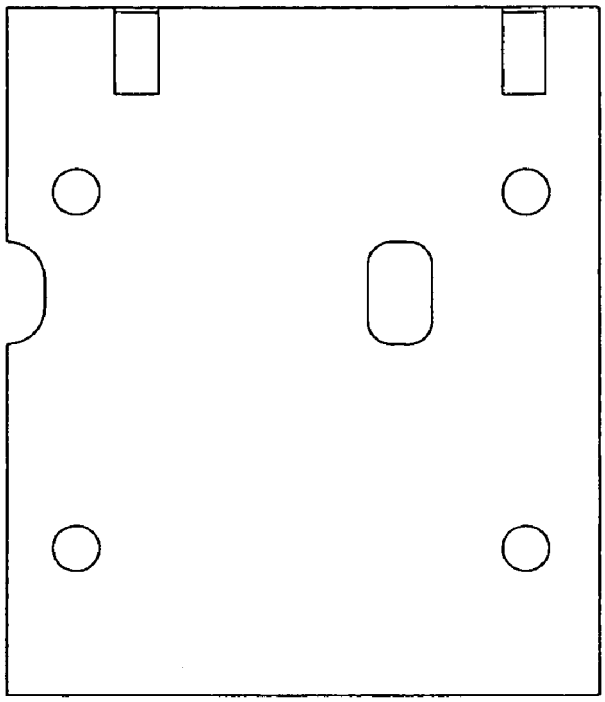
Figures 9, 34:
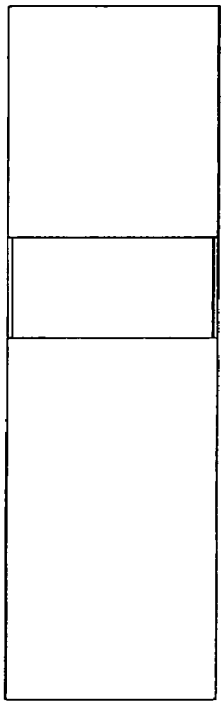
Figures 10, 34:
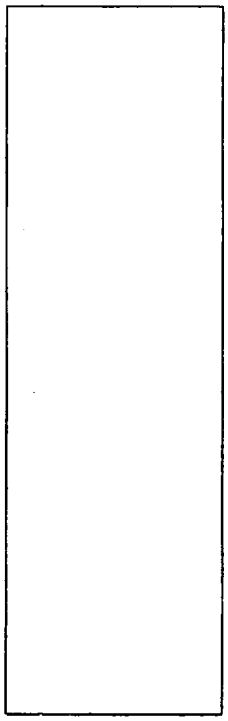
Figures 11, 34:
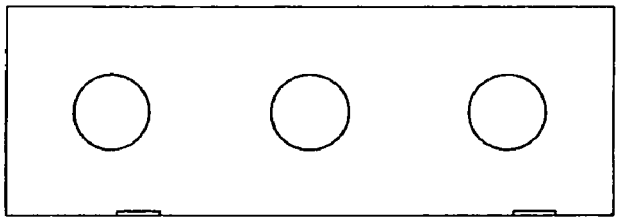
Figures 12, 34:
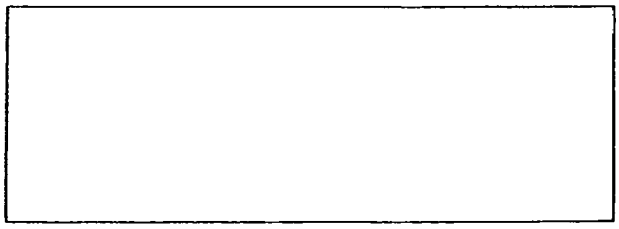
Figures 13, 34:
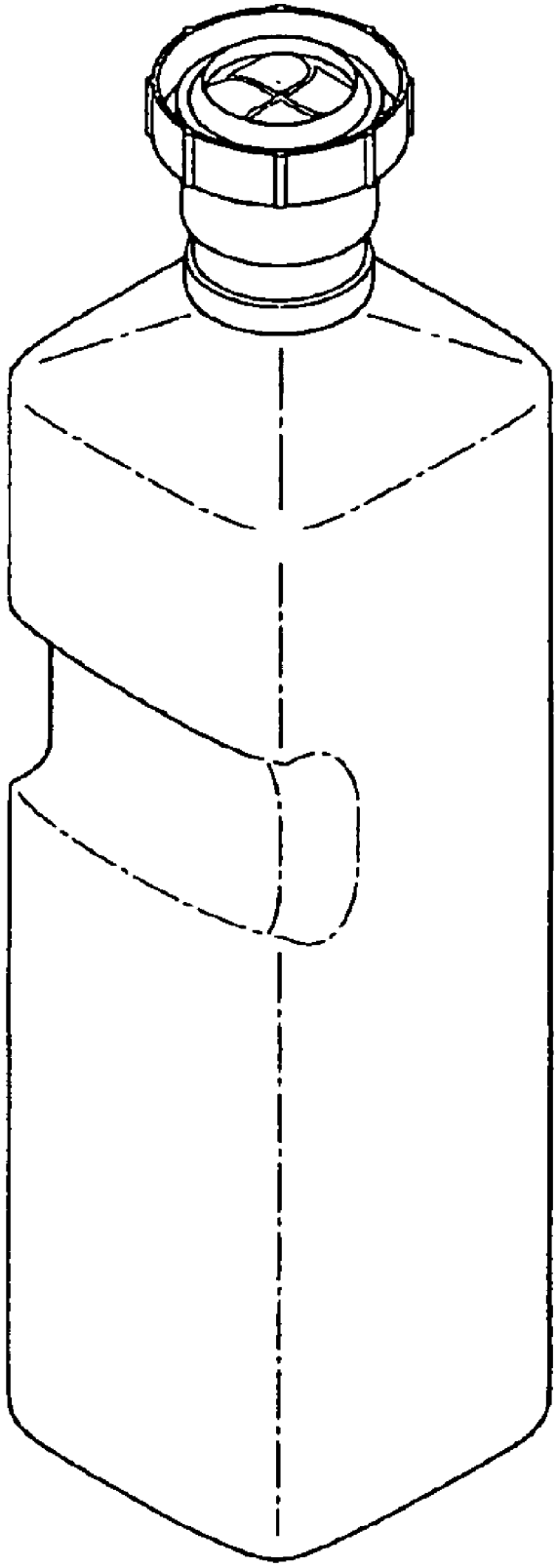
Figures 14, 34:
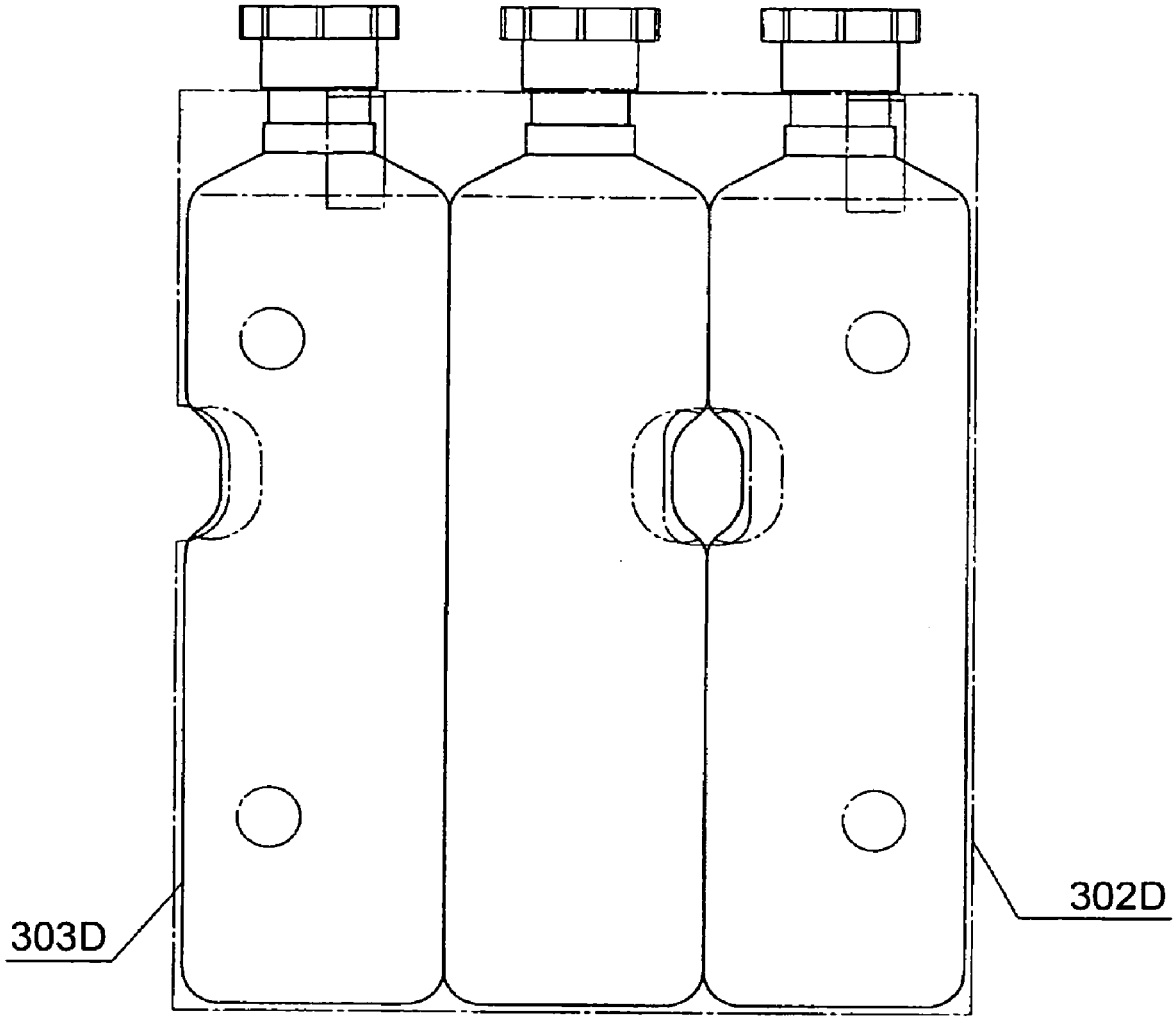

Another modified embodiment of the present invention is a cartridge as illustrated in FIGS. 34-1, 34-2, 34-3, 34-4, 34-5, and 34-6, for replenishing processing solution to an automatic processor. This cartridge comprises a cardboard cartridge box (302D) containing three (3) replenisher containers (303D) in a row, as illustrated in FIG. 34-14. As seen in FIG. 31-10, the cartridge is flipped upside down and inserted into an automatic processor, allowing one-step exchange of the cartridge. The cartridge is supplied, used, and removed as it is. The dash dot lines in the perspective views of the cartridge illustrate the shapes of the three-dimensional surfaces of the cartridge.

Figure 11:
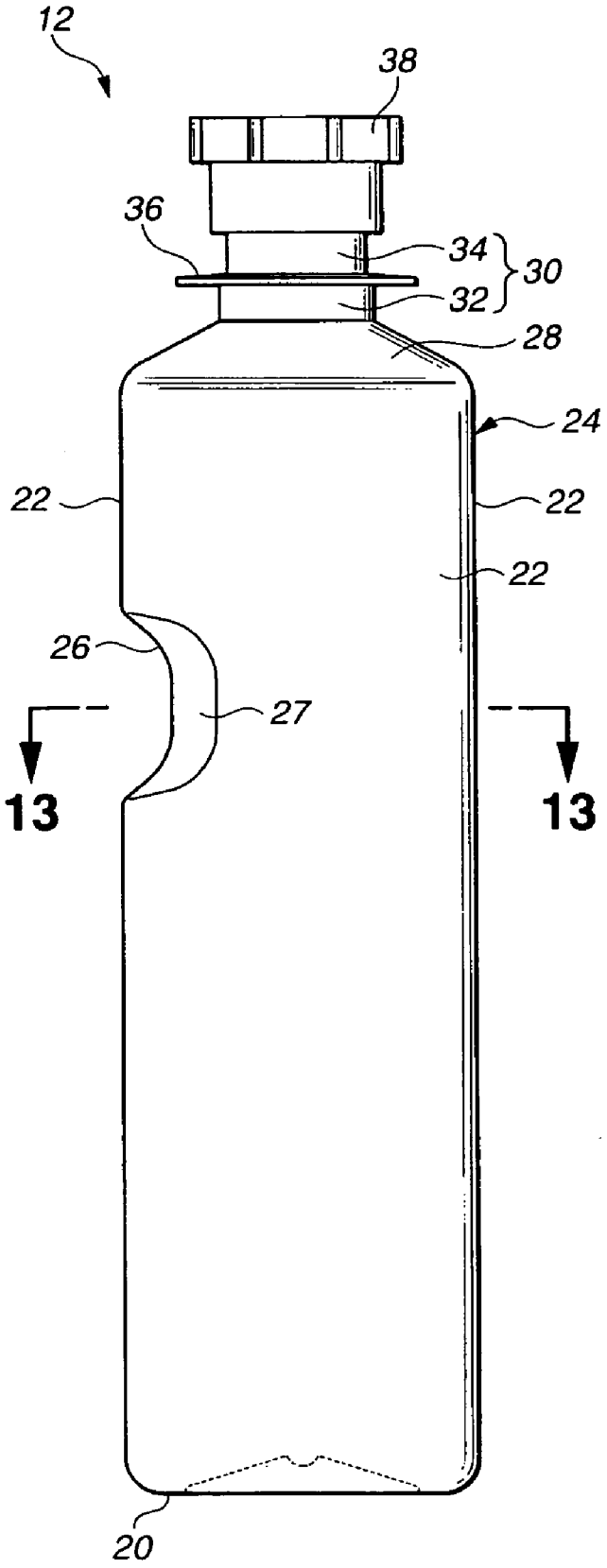
FIG. 11 is a right side view of the container for a photographic processing agent according to the first embodiment of the present invention.
Figures 1, 35:
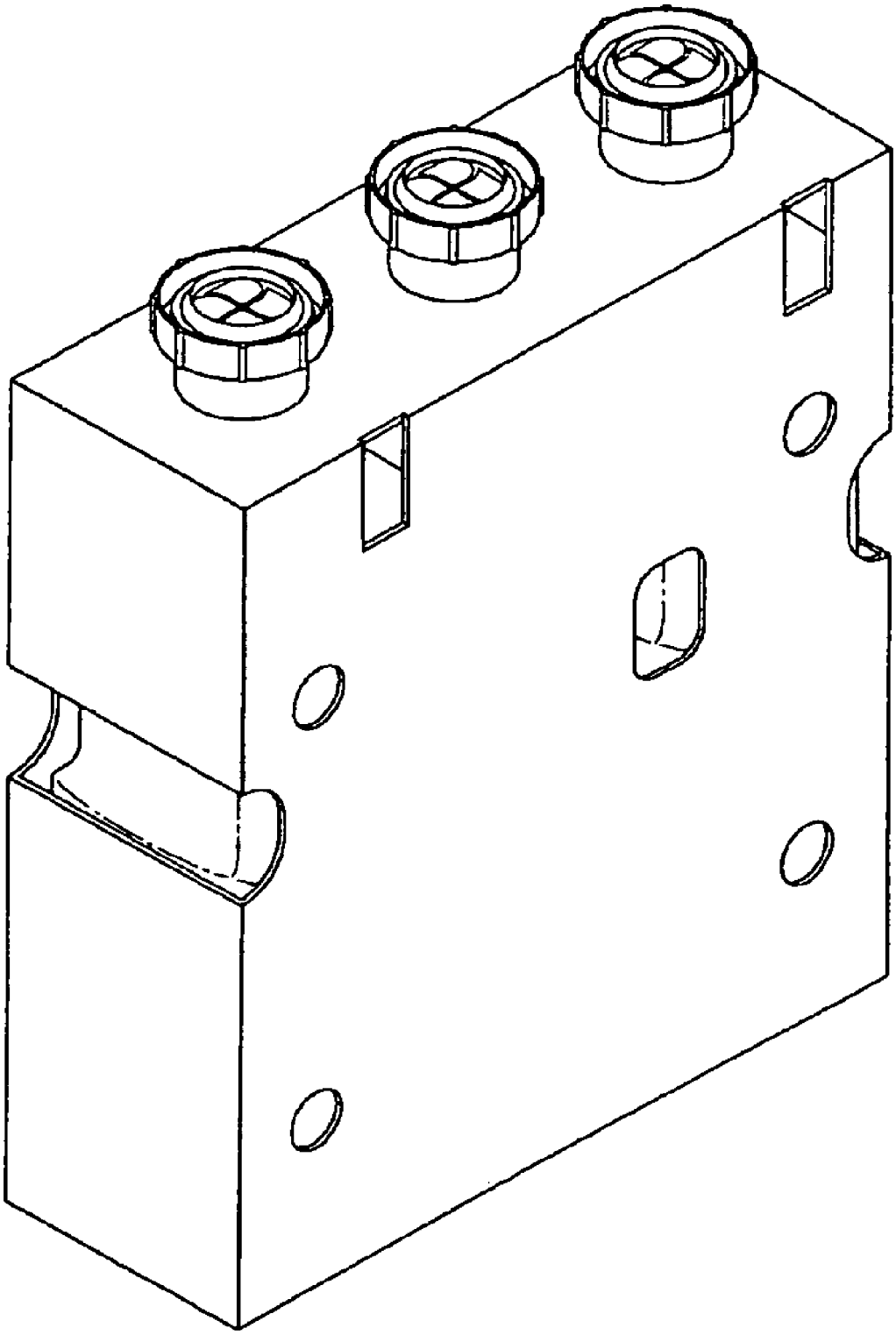
Figures 2, 35:
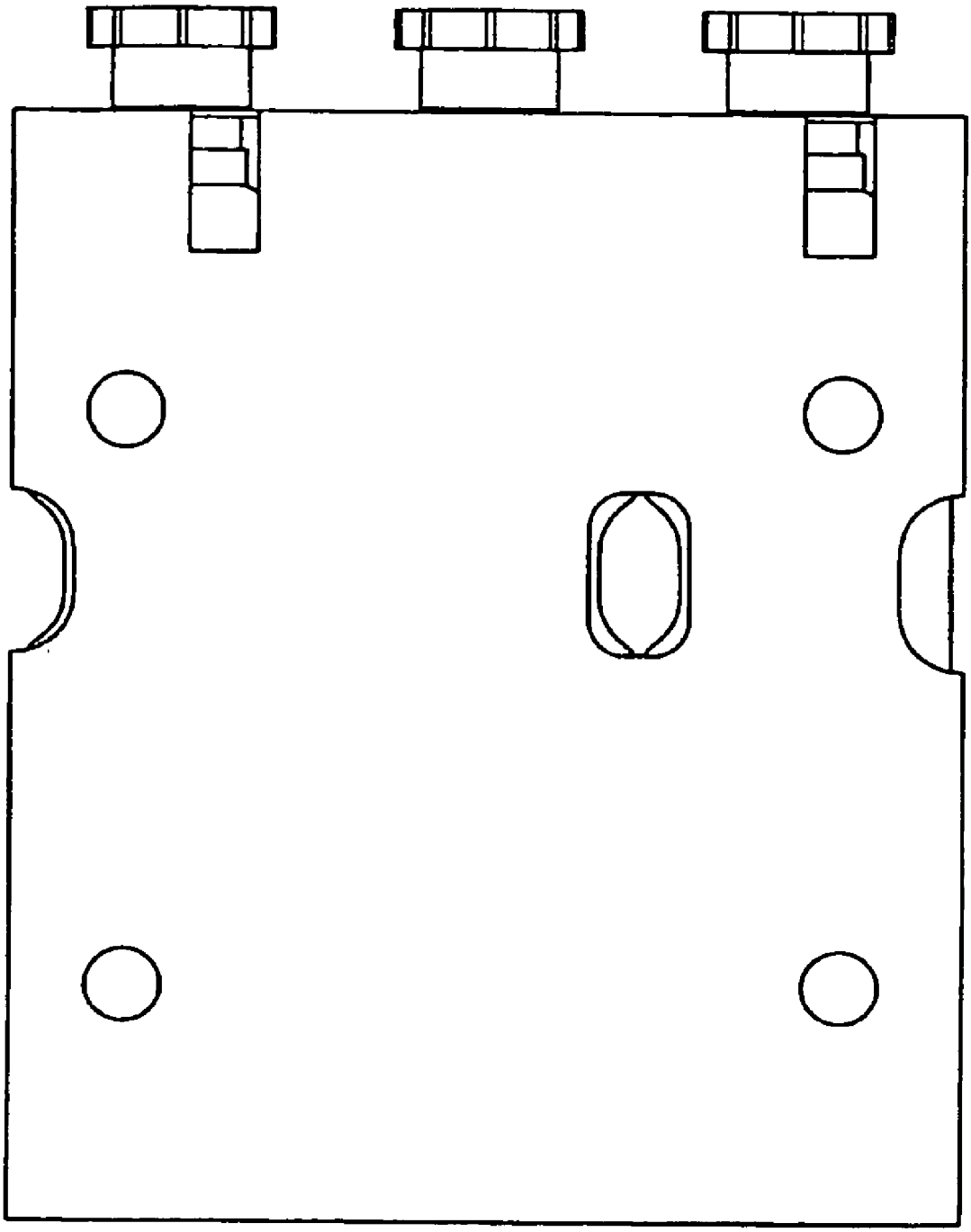
Figures 3, 35:
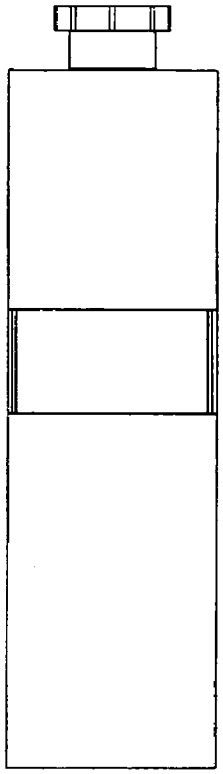
Figures 4, 35:
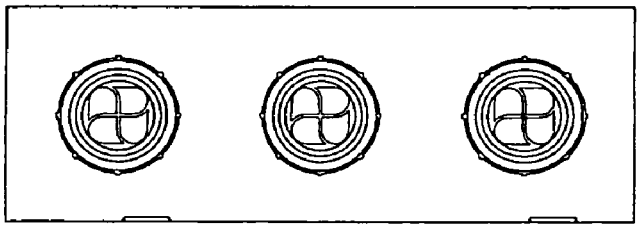
Figures 5, 35:
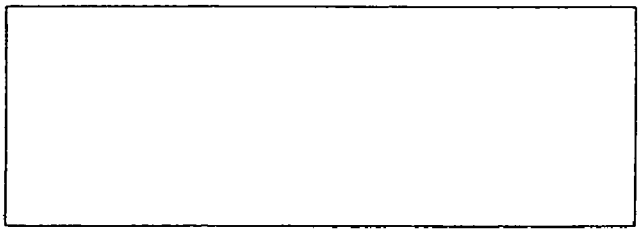
Figures 6, 35:
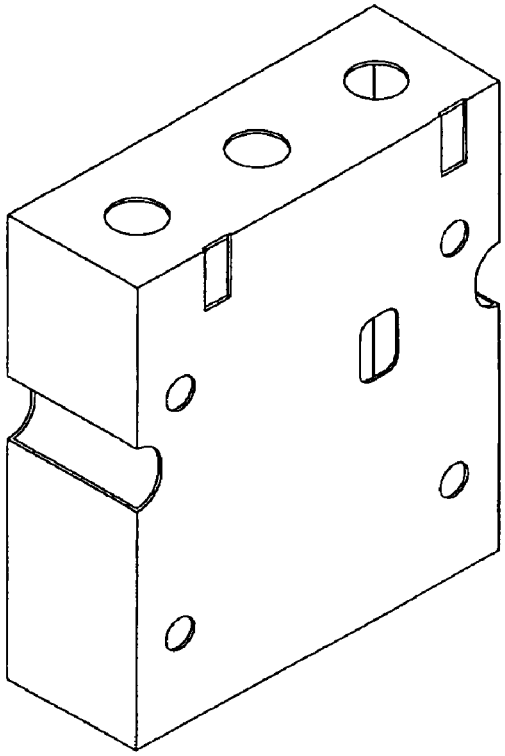
Figures 7, 35:
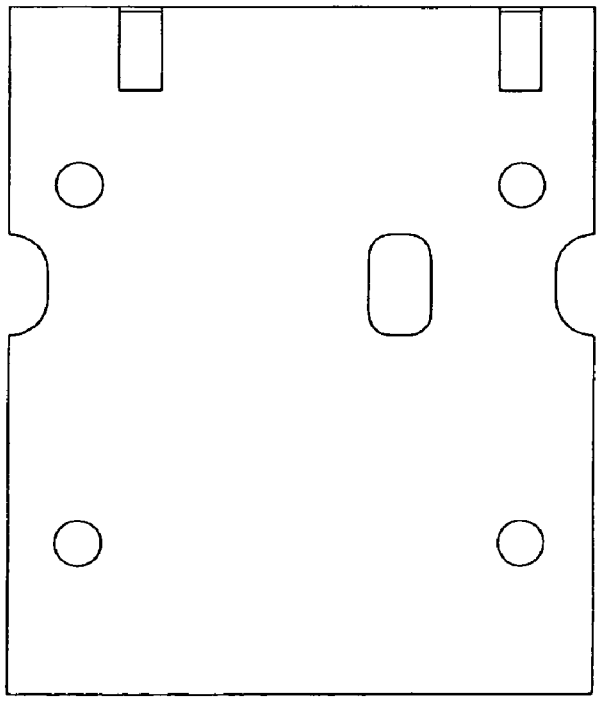
Figures 8, 35:
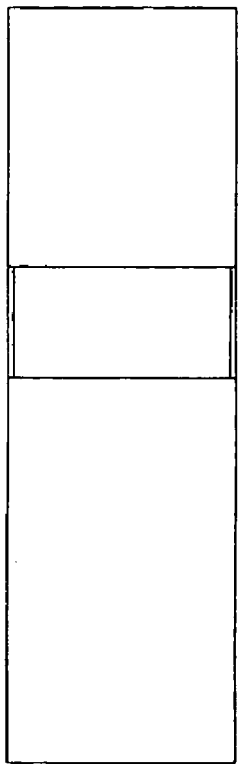
Figures 9, 35:
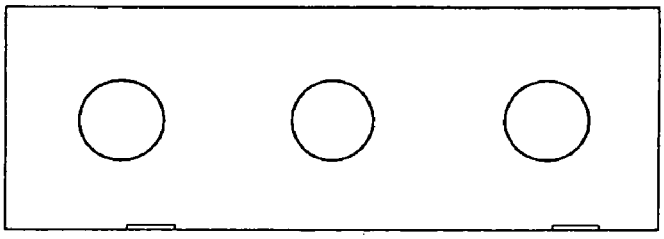
Figures 10, 35:
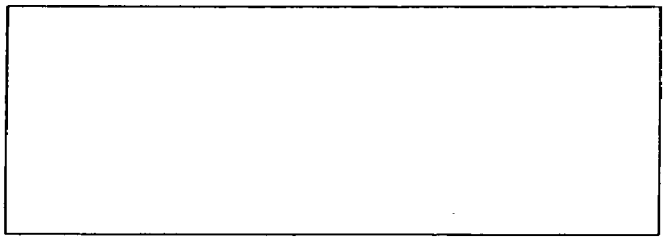
Figures 11, 35:
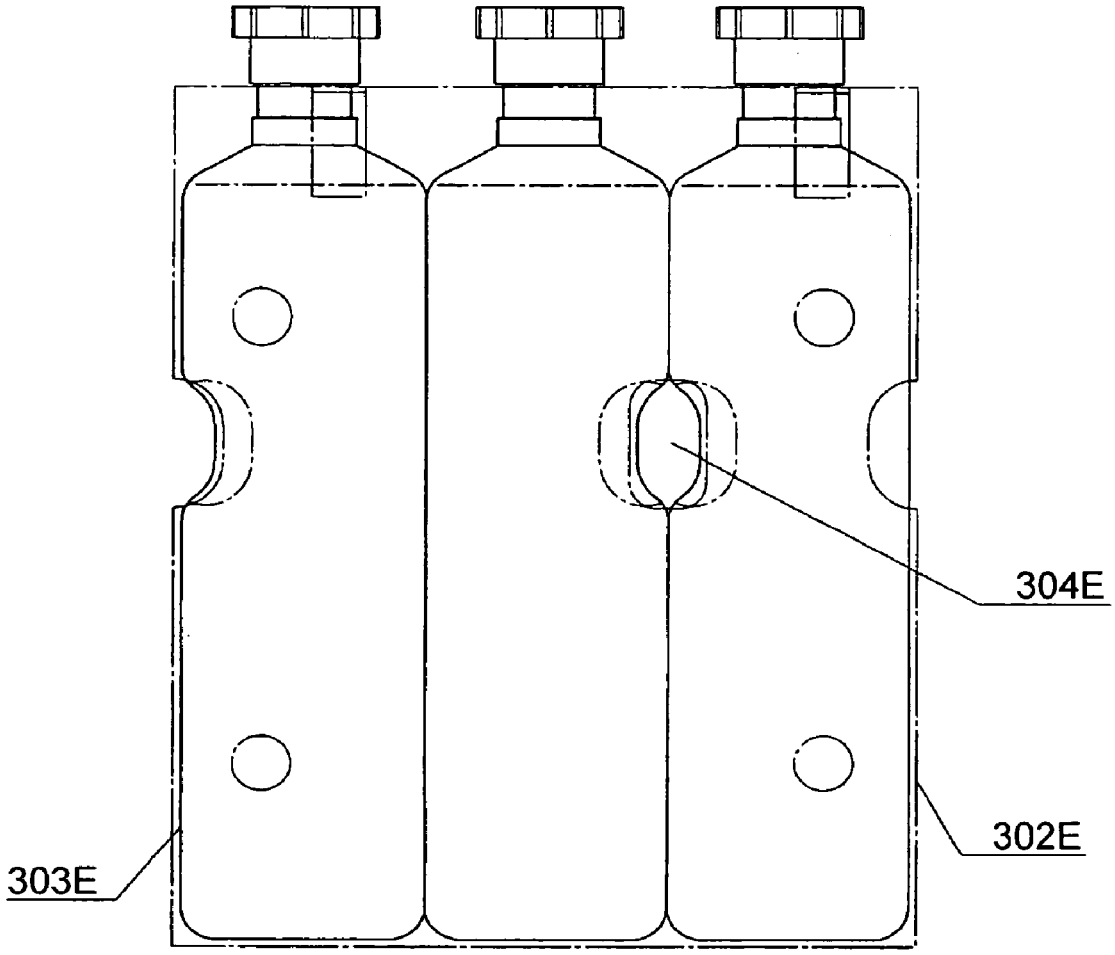

Another modified embodiment of the present invention is a cartridge as illustrated in 35-1, 35-2, 35-3, 35-4, and 35-5, for replenishing processing solution to an automatic processor. This cartridge comprises a cardboard cartridge box (302E) containing three (3) replenisher containers (303E) in a row, as illustrated in FIG. 35-11. This cartridge has a thorough hole (304E). As seen in FIG. 31-10, the cartridge is flipped upside down and inserted into an automatic processor, allowing one-step exchange of the cartridge. The cartridge is supplied, used, and removed as it is. The dash dot lines in the perspective views of the cartridge illustrate the shapes of the three-dimensional surfaces of the cartridge.

Figures 1, 36:
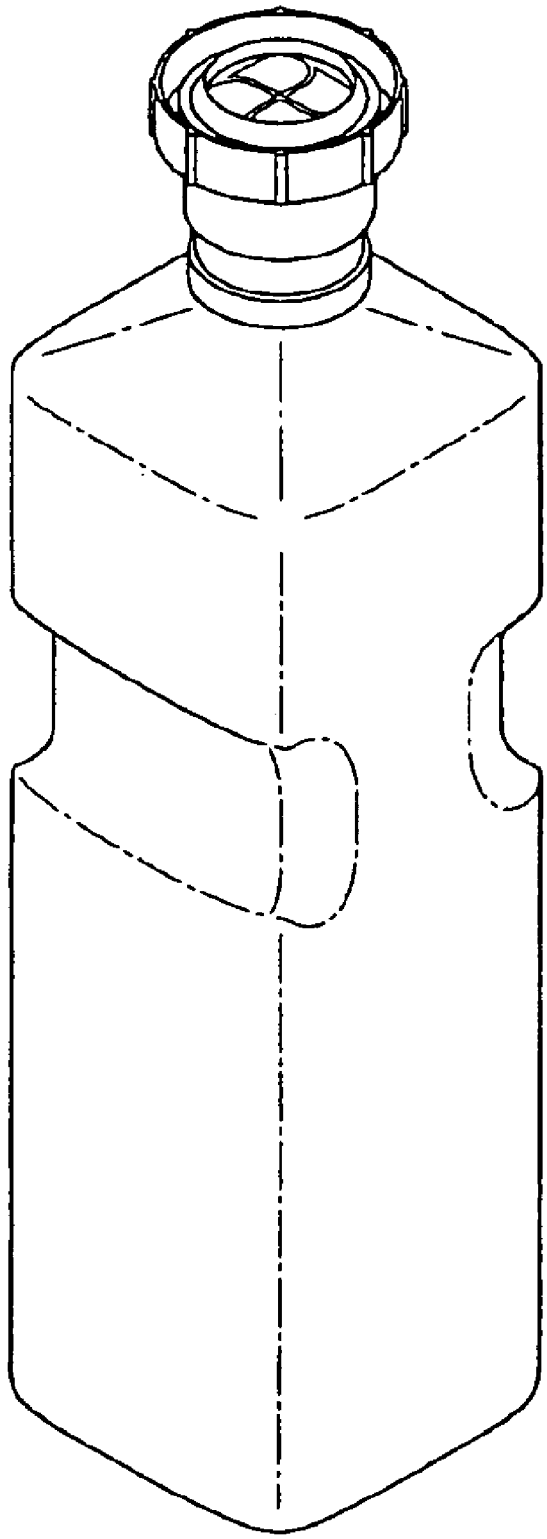
Figures 2, 36:
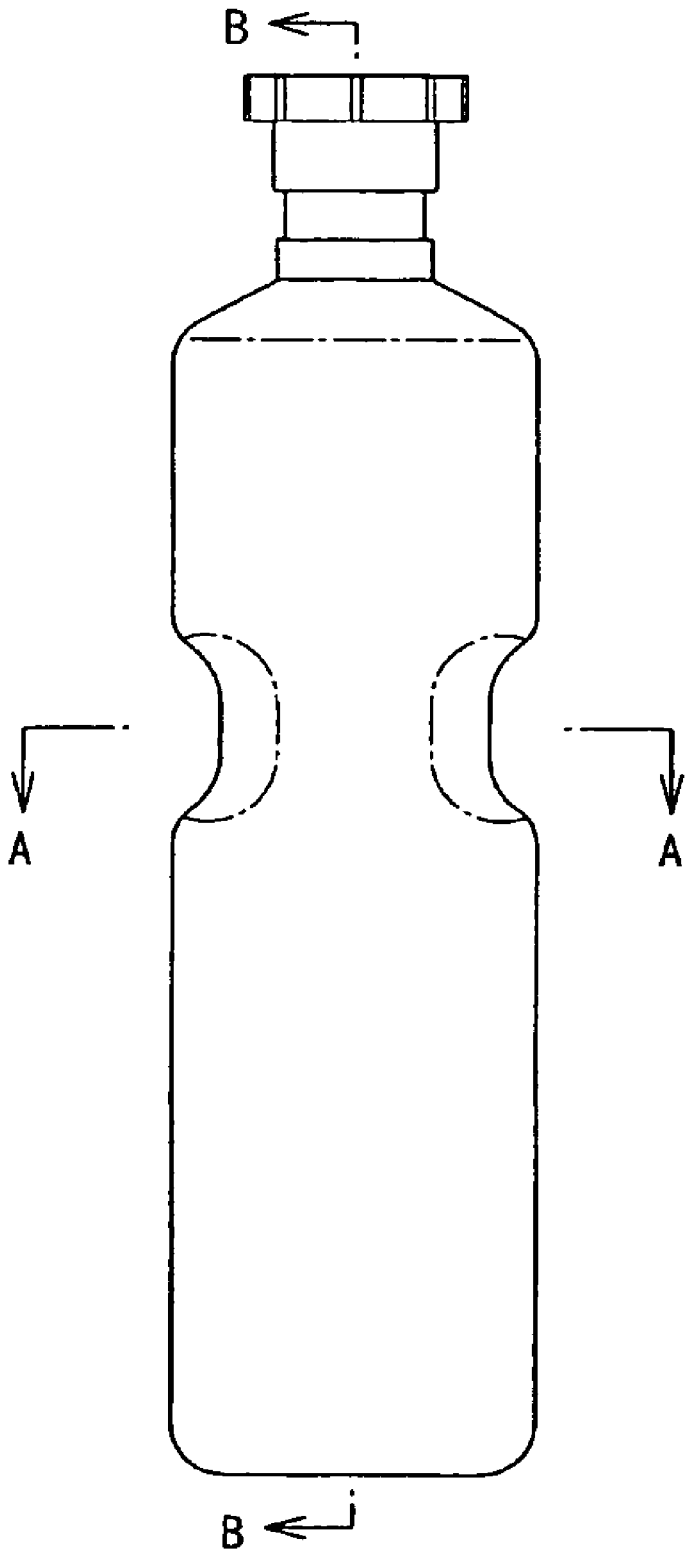
Figures 3, 36:
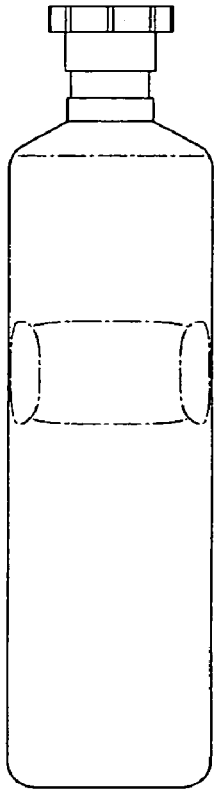
Figures 4, 36:
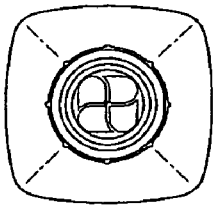
Figures 5, 36:
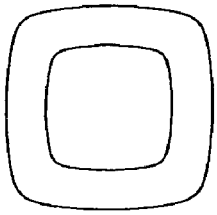
Figures 6, 36:
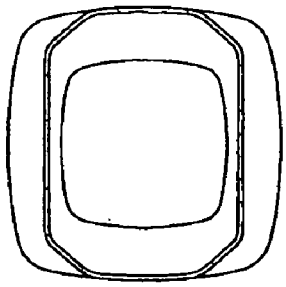
Figures 7, 36:
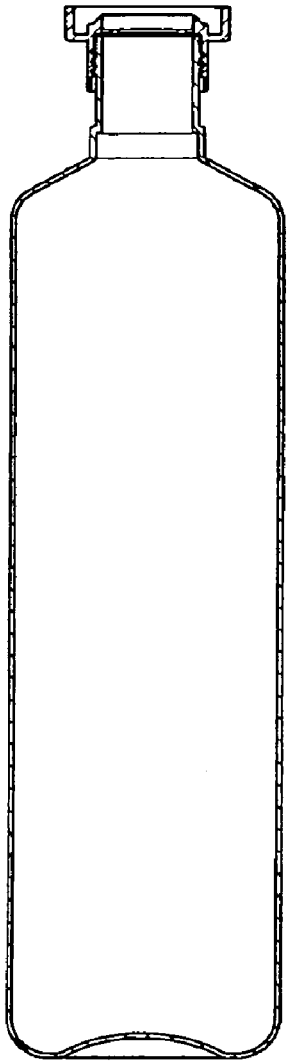
Figures 8, 36:
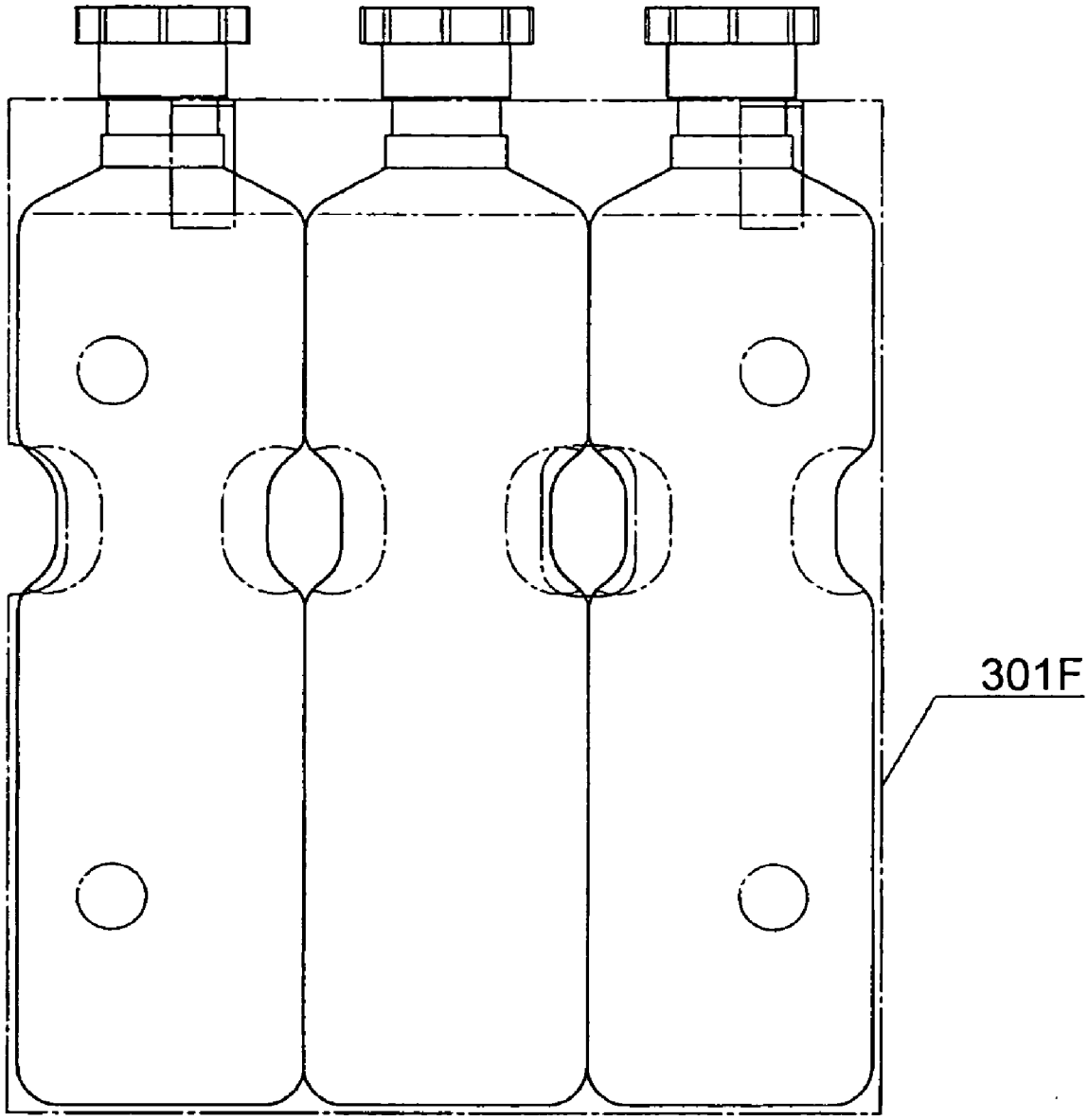

Another modified embodiment of the present invention is a replenisher container as illustrated in FIGS. 36-1, 36-2, 36-3, 36-4, 36-5, 36-6, and 36-7 from which processing solution is replenished to an automatic processor. The container can be housed in a cartridge box, to form a cartridge (301F) as illustrated in FIG. 36-8. As illustrated in FIG. 31-10, the cartridge is flipped upside down and inserted into an automatic processor, allowing one-step exchange of the cartridge. The dash dot lines in FIGS. 36-1 to 36-4 illustrate the shapes of the three-dimensional surfaces of the container.

Figures 1, 37:
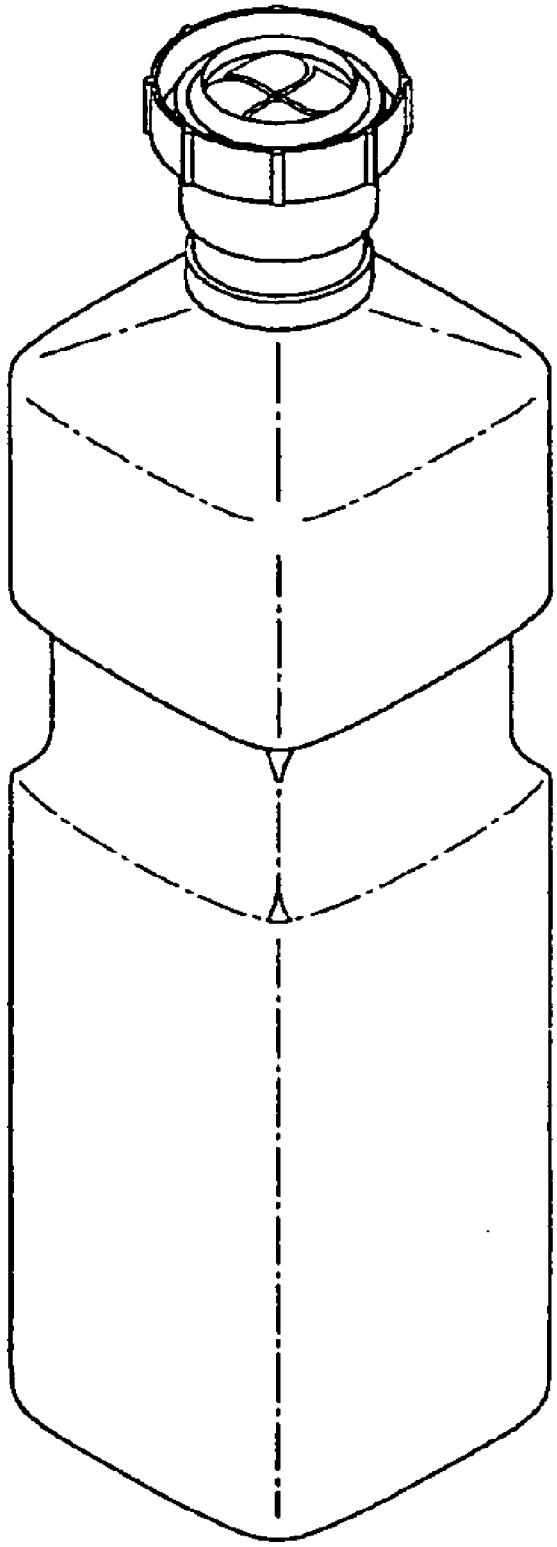
Figures 2, 37:
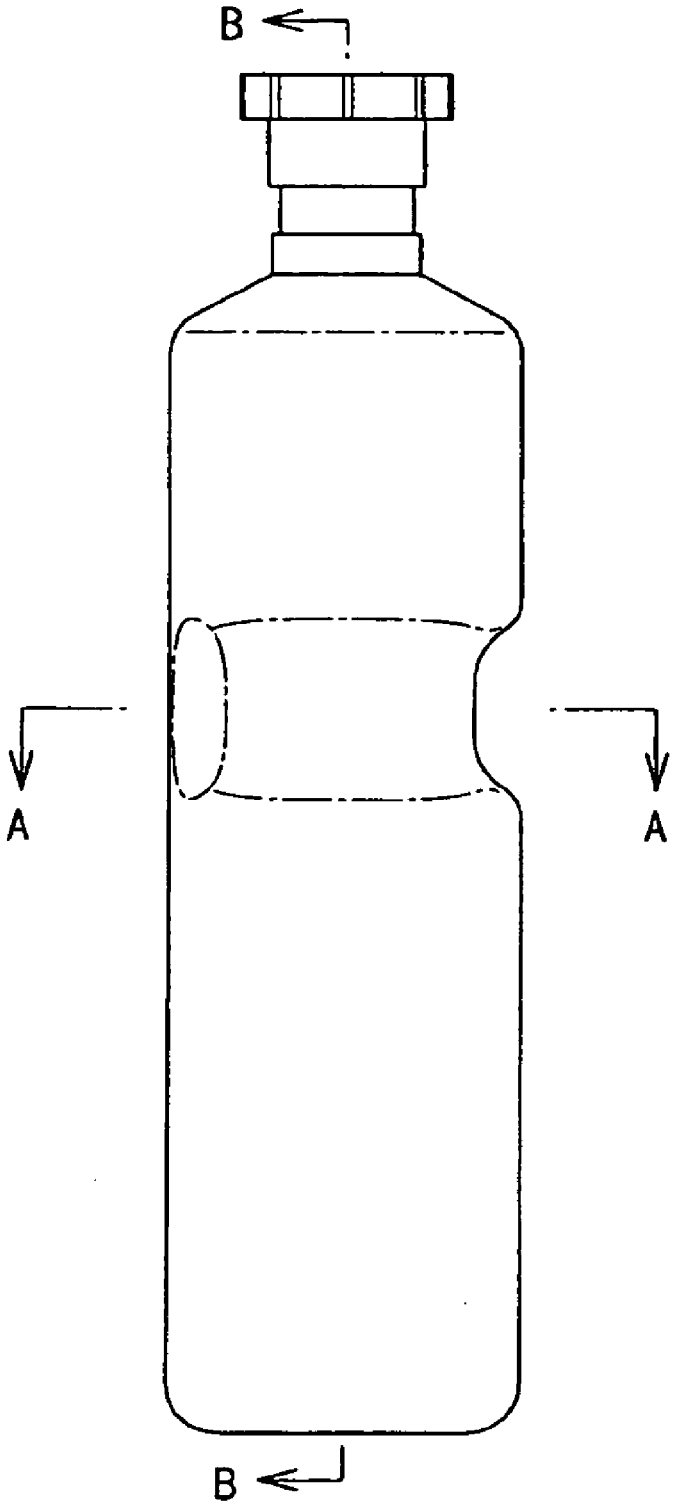
Figures 3, 37:
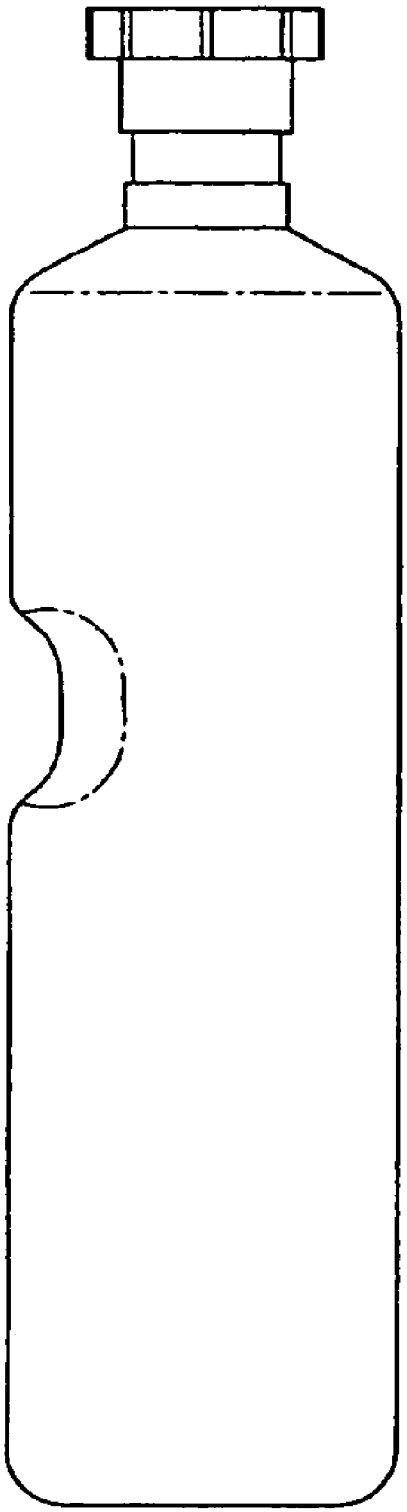
Figures 4, 37:
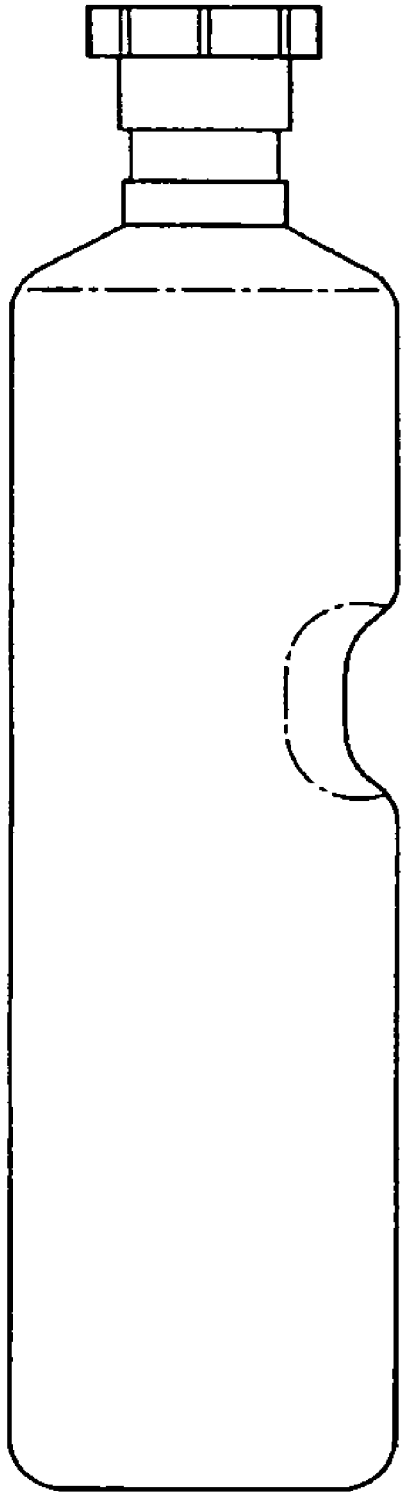
Figures 5, 37:
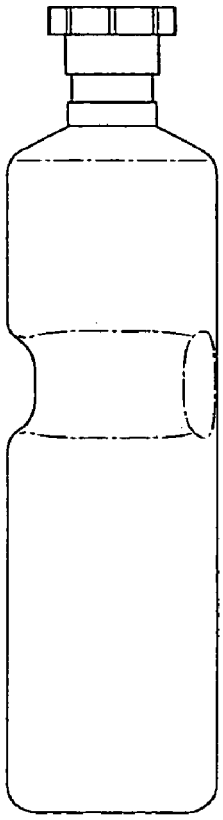
Figures 6, 37:
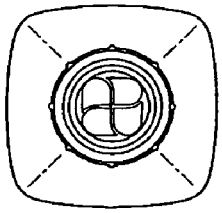
Figures 7, 37:
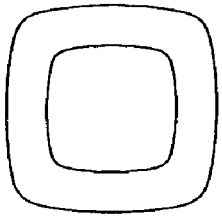
Figures 8, 37:
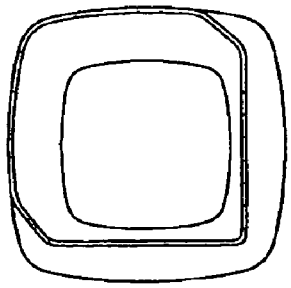
Figures 9, 37:
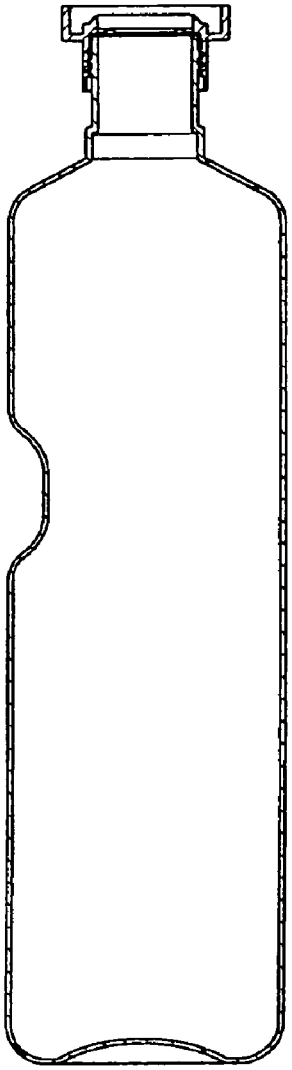
Figures 10, 37:
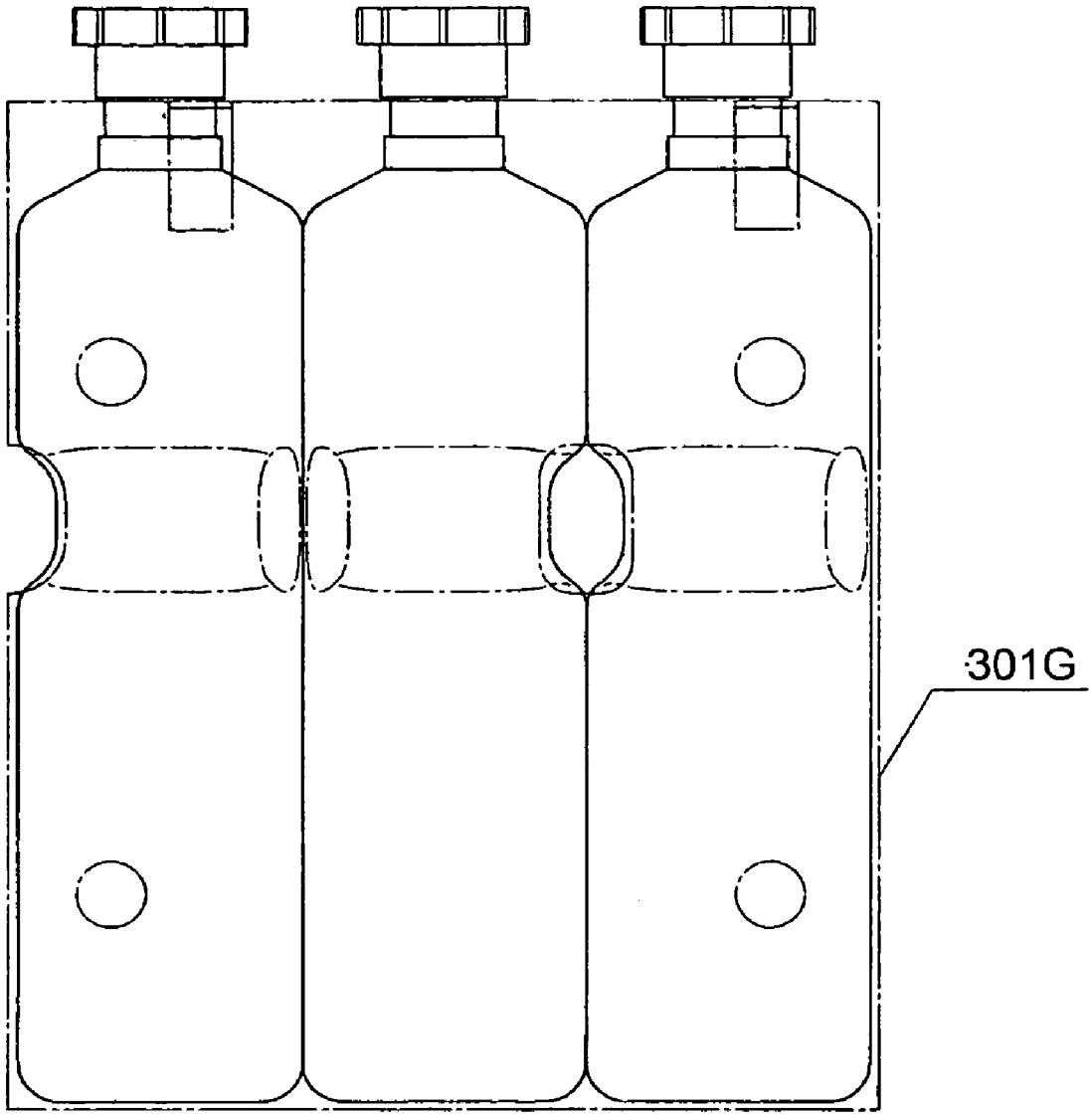

Another modified embodiment of the present invention is a replenisher container as illustrated in FIGS. 37-1, 37-2, 37-3, 37-4, 37-5, 37-6, 37-7, 37-8, and 37-9 from which processing solution is replenished to an automatic processor. The container can be housed in a cartridge box, to form a cartridge (301G) as illustrated in FIG. 37-10. As illustrated in FIG. 31-10, the cartridge is flipped upside down and inserted into an automatic processor, allowing one-step exchange of the cartridge. The dash dot lines in FIGS. 37-1 to 37-6 illustrate the shapes of the three-dimensional surfaces of the container.

Figures 1, 38:
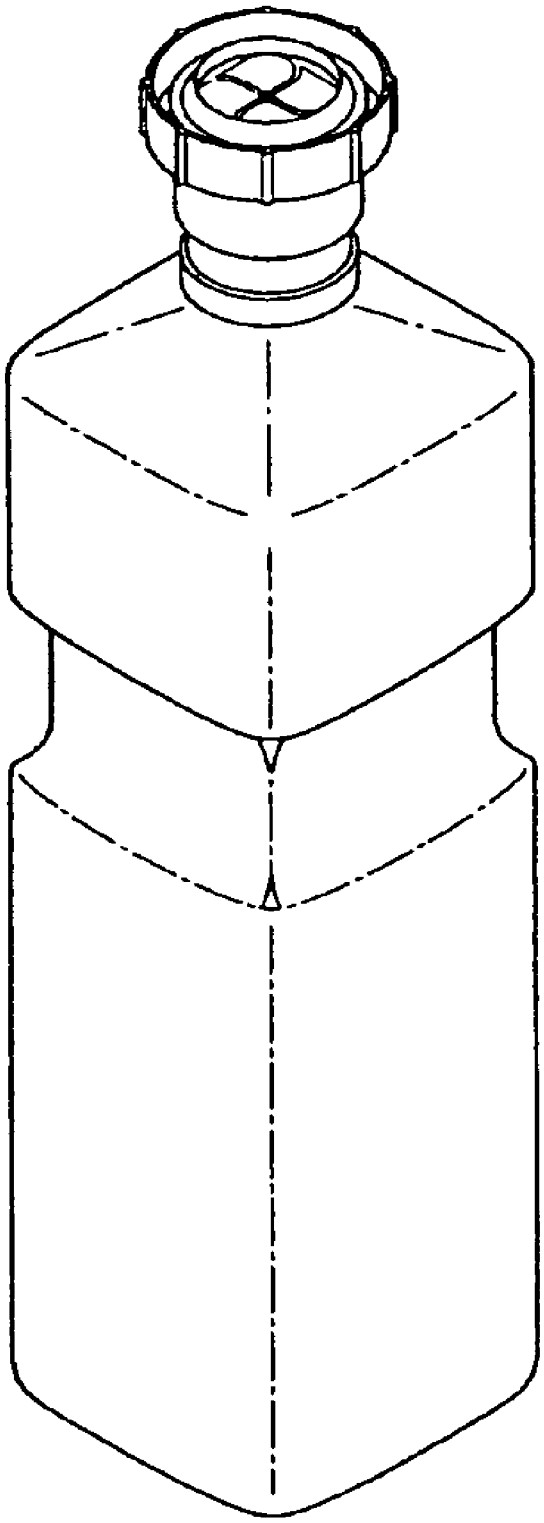
Figures 2, 38:
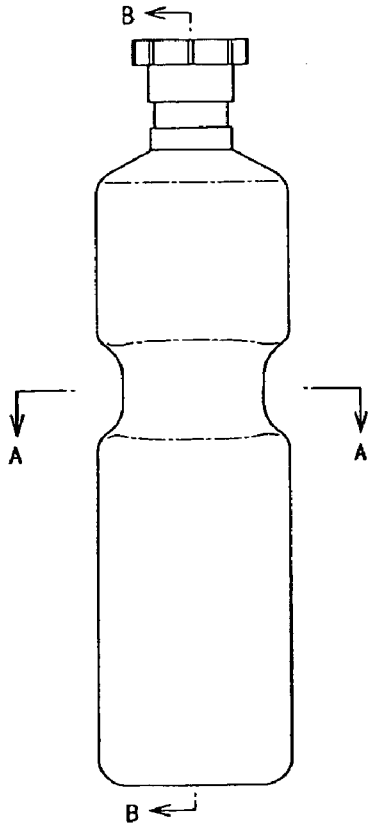
Figures 3, 38:
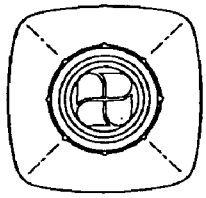
Figures 4, 38:
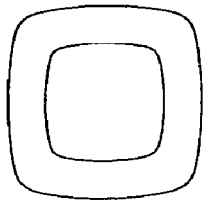
Figures 5, 38:
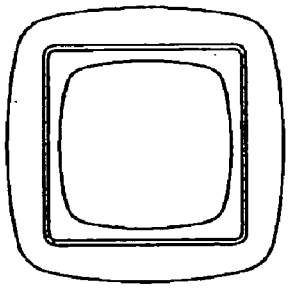
Figures 6, 38:
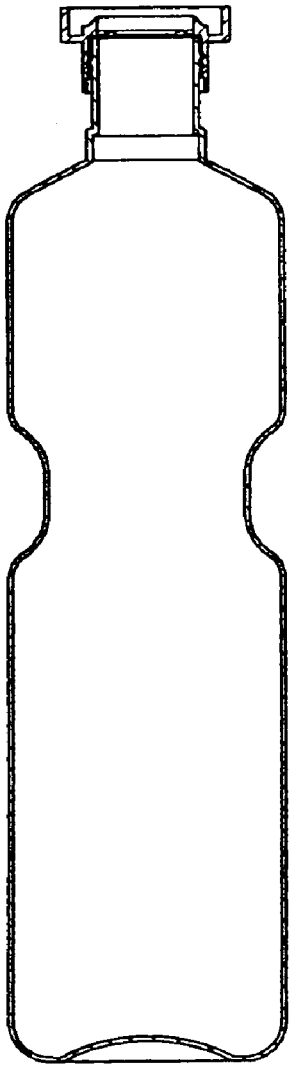
Figures 7, 38:
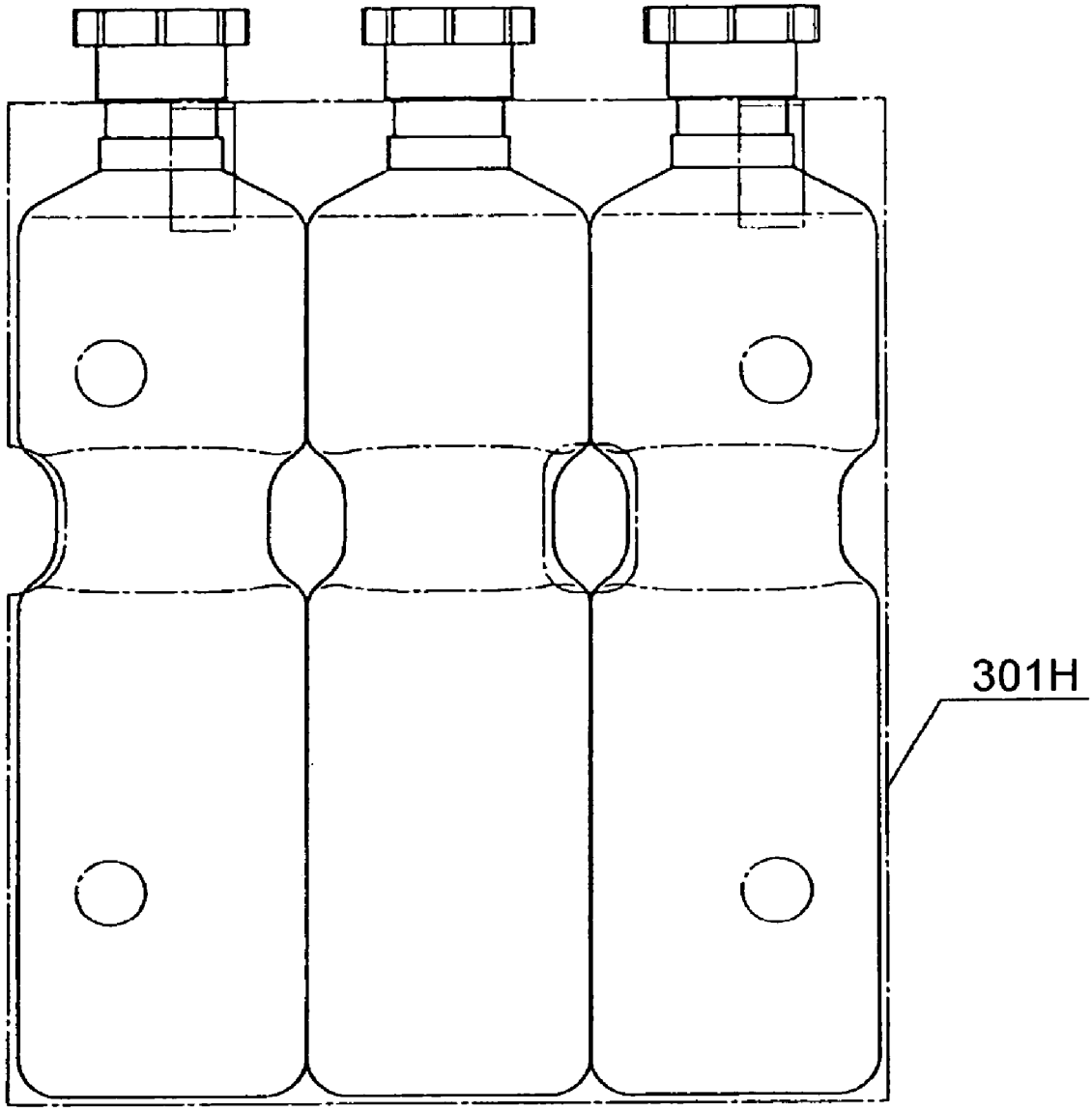

Another modified embodiment of the present invention is a replenisher container as illustrated in FIGS. 38-1, 38-2, 38-3, 38-4, 38-5, and 38-6 from which processing solution is replenished to an automatic processor. The container can be housed in a cartridge box, to form a cartridge (301H) as illustrated in FIG. 38-7. As illustrated in FIG. 31-10, the cartridge is flipped upside down and inserted into an automatic processor, allowing one-step exchange of the cartridge. The dash dot lines in FIGS. 38-1 to 38-3 illustrate the shapes of the three-dimensional surfaces of the container.

Figures 1, 39:
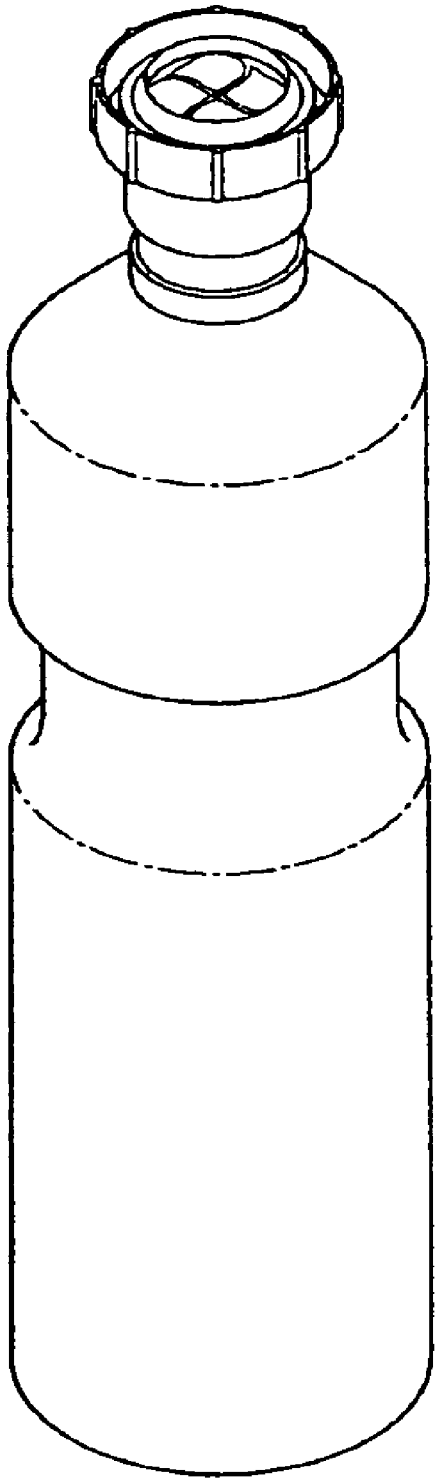
Figures 2, 39:
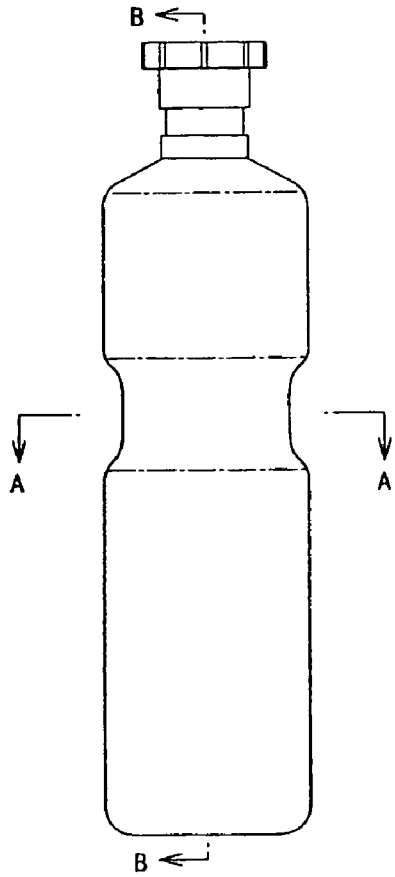
Figures 3, 39:
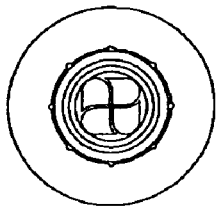
Figures 4, 39:
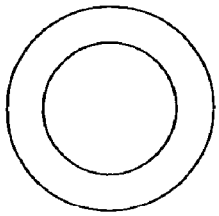
Figures 5, 39:
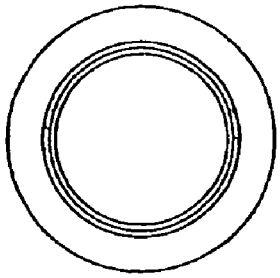
Figures 6, 39:
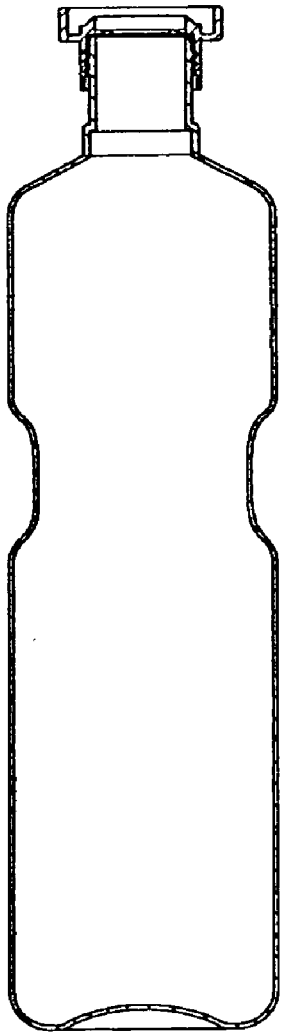
Figures 7, 39:
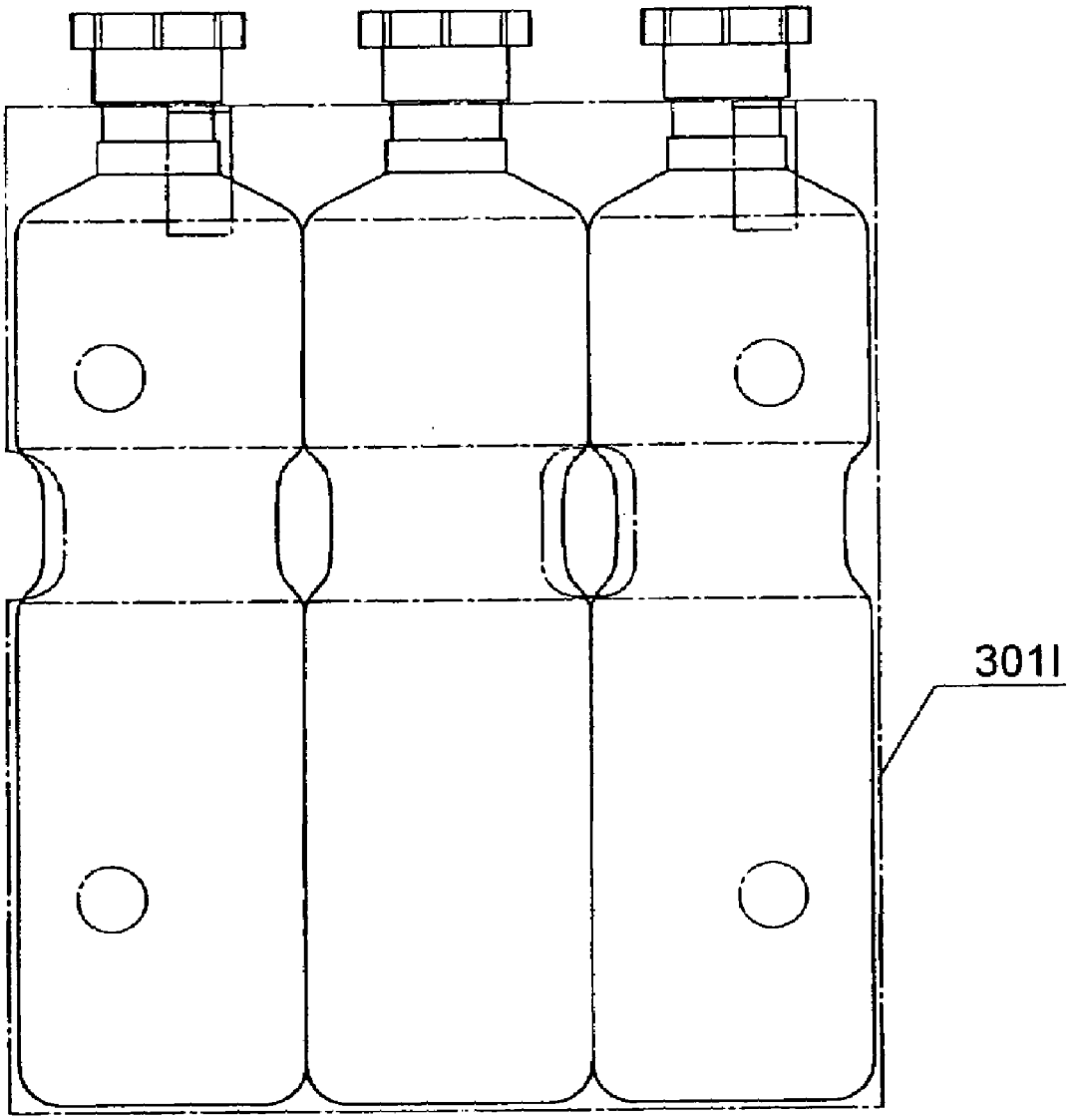

Another modified embodiment of the present invention is a replenisher container as illustrated in FIGS. 39-1, 39-2, 39-3, 39-4, 39-5, and 39-6 from which processing solution is replenished to an automatic processor. The container can be housed in a cartridge box, to form a cartridge (301I) as illustrated in FIG. 39-7. As illustrated in FIG. 31-10, the cartridge is flipped upside down and inserted into an automatic processor, allowing one-step exchange of the cartridge. The dash dot lines in FIGS. 39-1 and 39-2 illustrate the shapes of the three-dimensional surfaces of the container.

Figures 1, 40:
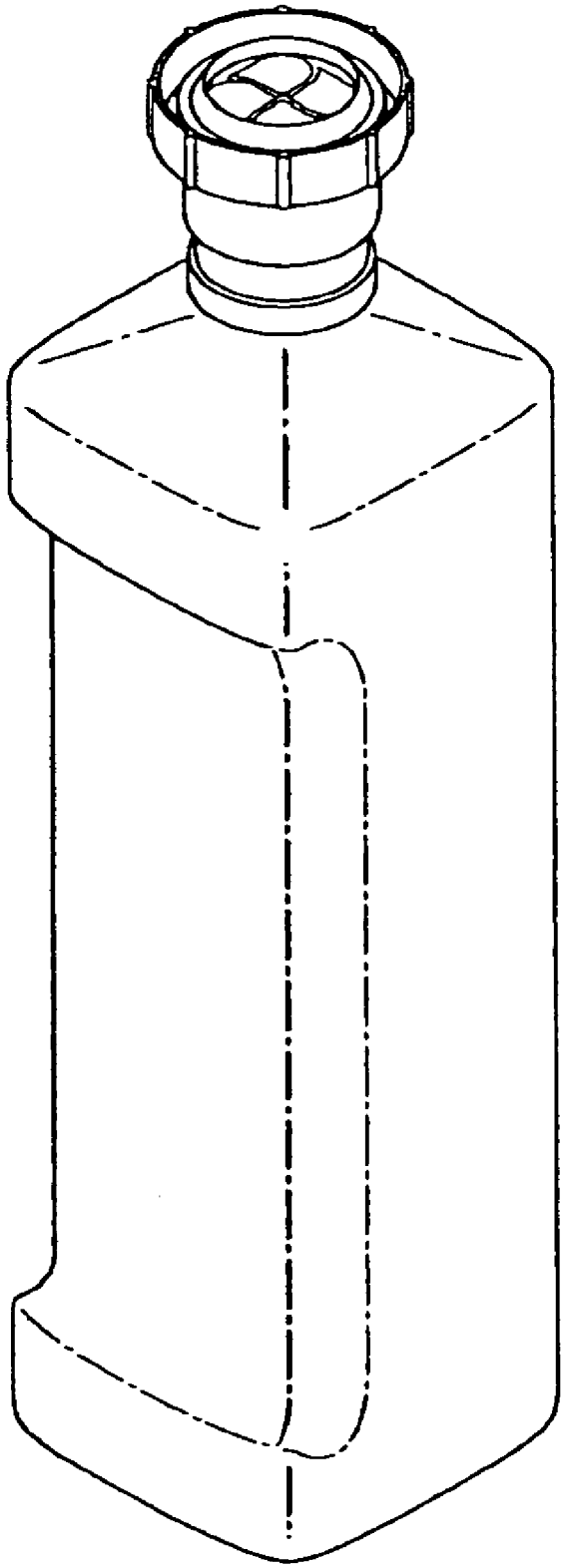
Figures 2, 40:
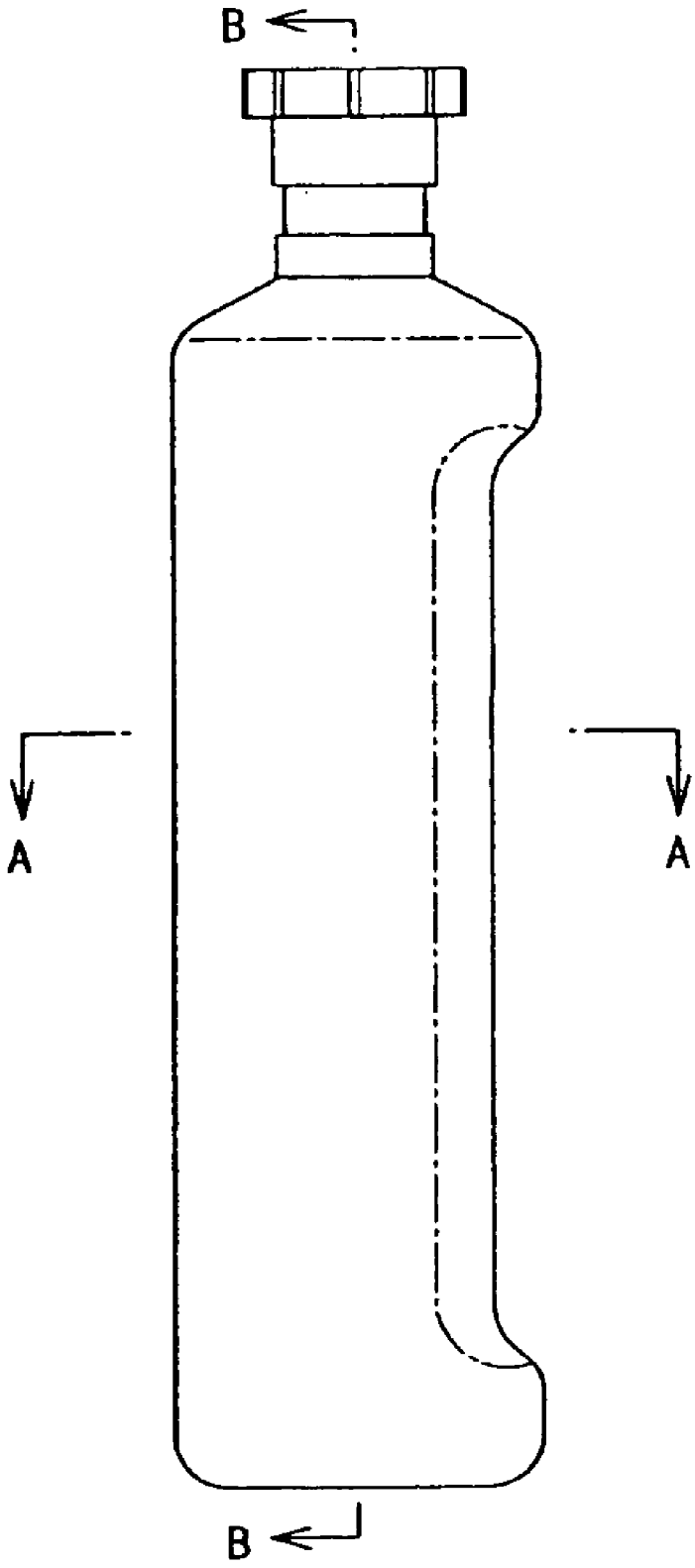
Figures 3, 40:
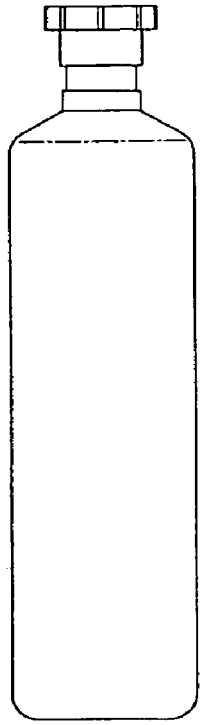
Figures 4, 40:
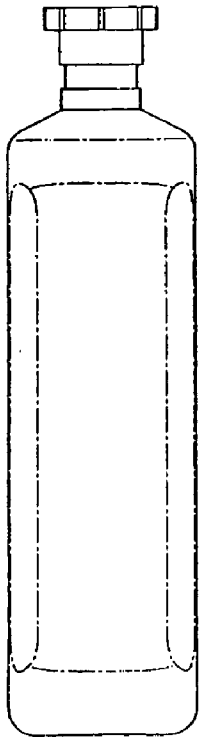
Figures 5, 40:
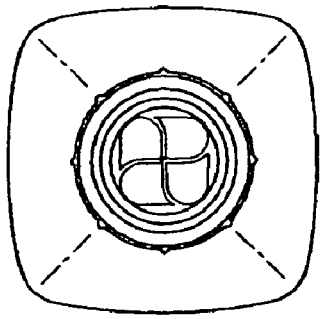
Figures 6, 40:
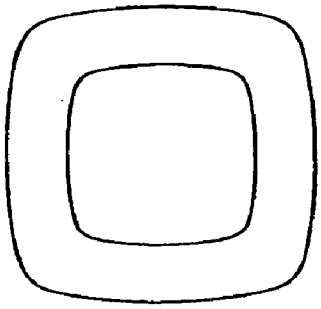
Figures 7, 40:
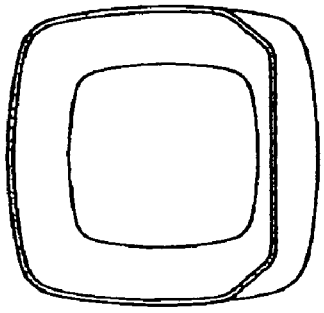
Figures 8, 40:
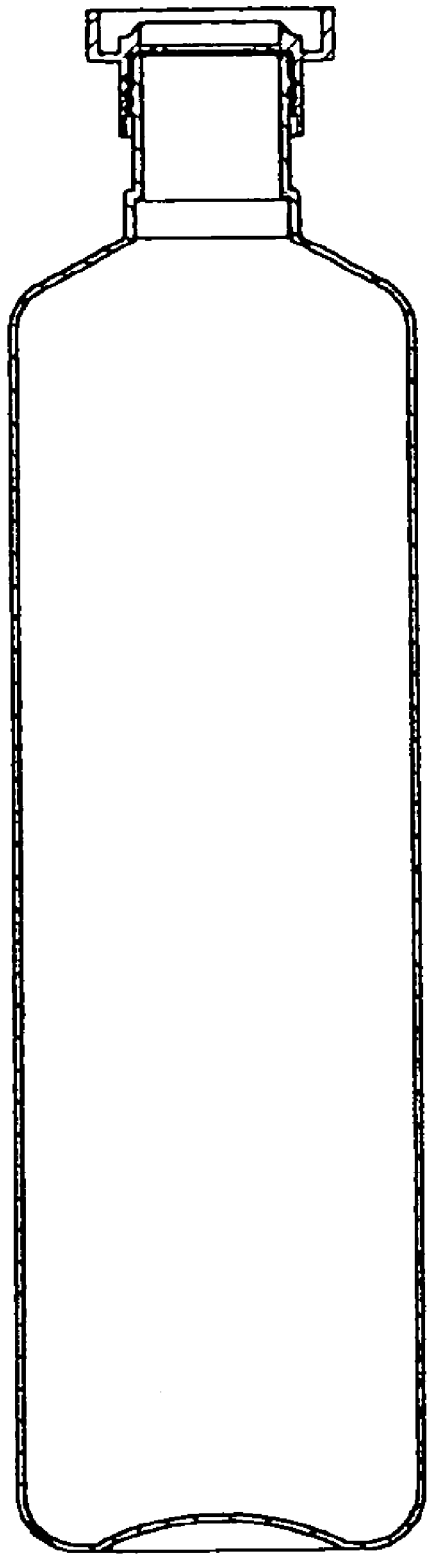
Figures 9, 40:
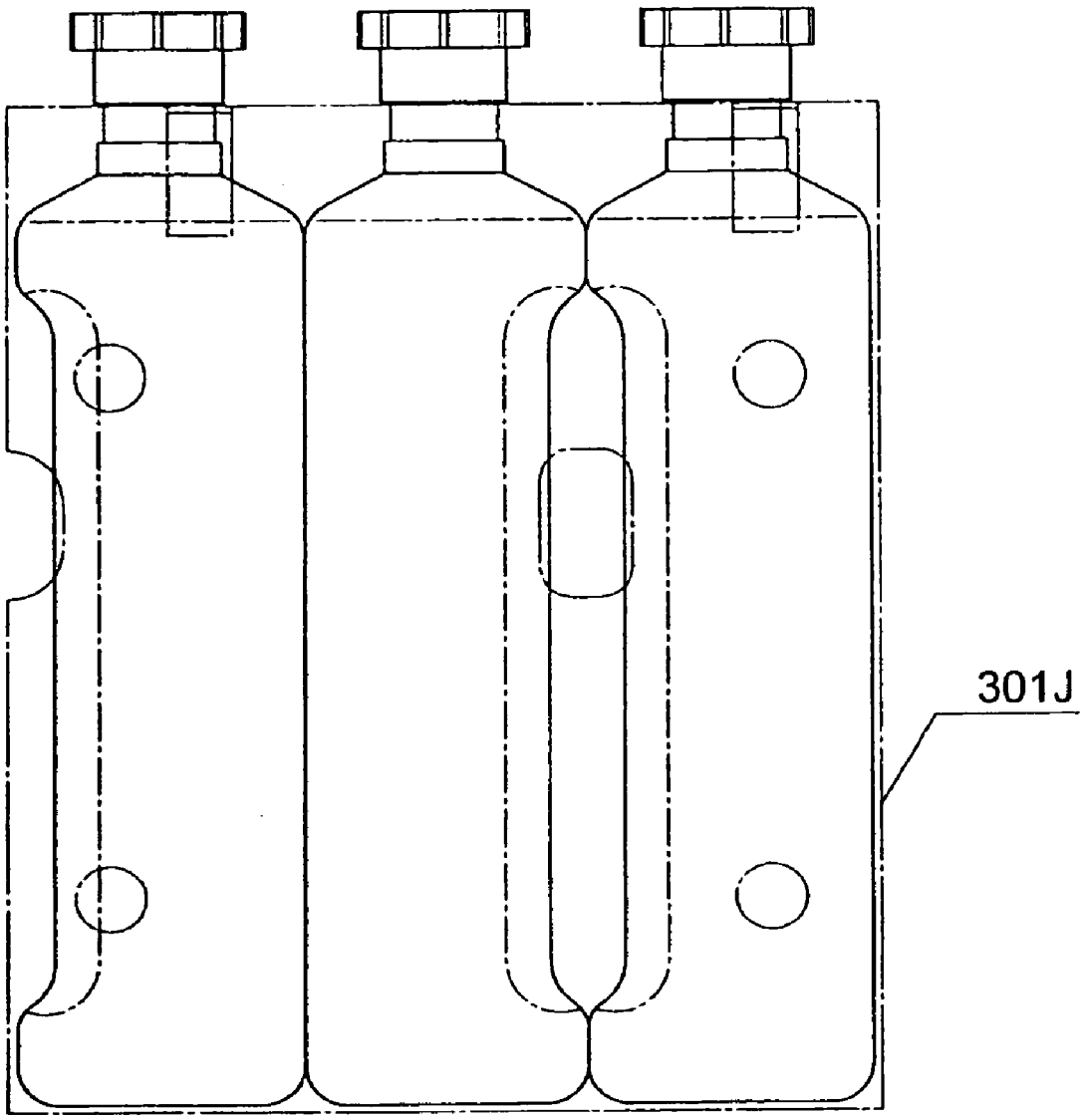

Another modified embodiment of the present invention is a replenisher container as illustrated in FIGS. 40-1, 40-2, 40-3, 40-4, 40-5, 40-6, 40-7, and 40-8 from which processing solution is replenished to an automatic processor. The container can be housed in a cartridge box, to form a cartridge (301J) as illustrated in FIG. 40-9. As illustrated in FIG. 31-10, the cartridge is flipped upside down and inserted into an automatic processor, allowing one-step exchange of the cartridge. The dash dot lines in FIGS. 40-1 to 40-5 illustrate the shapes of the three-dimensional surfaces of the container.

Another modified embodiment of the present invention is a replenisher container as illustrated in FIGS. 41-1, 41-2, 41-3, 41-4, 41-5, 41-6, 41-7, and 41-8 from which processing solution is replenished to an automatic processor. The container can be housed in a cartridge box, to form a cartridge (301K) as illustrated in FIG. 41-9. As illustrated in FIG. 31-10, the cartridge is flipped upside down and inserted into an automatic processor, allowing one-step exchange of the cartridge. The dash dot lines in FIGS. 41-1 to 41-5 illustrate the shapes of the three-dimensional surfaces of the container.

The container for a photographic processing agent of the present invention is constructed as explained above. The washing capability in the inside of the container is not damaged by the provision of the recess designed for prevention of the erroneous loading of the container to the automatic photo-processor.

Further, according to the photographic processing agent cartridge of the present invention constructed as explained above, a larger number of patterns towards the prevention of erroneous loading of the cartridge to the automatic photo-developer can be simply and easily provided.

Having described our invention as related to the present embodiments, it is not our intention that the invention is limited to any of the details of the description, unless otherwise specified, but rather is construed broadly within its spirit and scope as is set out in the accompanying claims.

This application is based on Japanese Patent Application No. 2003-184539 filed Jun. 27, 2003, Japanese Patent Application No. 2003-184540 filed Jun. 27, 2003, Japanese Design Registration Application No. 2003-19491 filed Jul. 7, 2003, Japanese Design Registration Application No. 2003-19492 filed Jul. 7, 2003, Japanese Design Registration Application No. 2003-19493 filed Jul. 7, 2003, Japanese Design Registration Application No. 2003-19494 filed Jul. 7, 2003, Japanese Design Registration Application No. 2003-19495 filed Jul. 7, 2003, Japanese Design Registration Application No. 2003-19496 filed Jul. 7, 2003, Japanese Design Registration Application No. 2003-19497 filed Jul. 7, 2003, Japanese Design Registration Application No. 2003-19498 filed Jul. 7, 2003, Japanese Design Registration Application No. 2003-19499 filed Jul. 7, 2003, Japanese Design Registration Application No. 2003-19500 filed Jul. 7, 2003 and Japanese Design Registration Application No. 2003-19501 filed Jul. 7, 2003, the above-noted applications incorporated herein by reference in their entirety.

What is claimed is:

1. A cartridge for photographic processing agents comprising:

plural containers each of which is filled with a different kind of photographic processing agent and having an axis; and a holding member making a set of said plural containers;

said cartridge for photographic processing agents being capable of supplying said different kinds of the photographic processing agents to an automatic photo-processor, by being loaded into a cartridge loading chamber mounted on the automatic photo-processor; wherein at least one of said plural containers has at least one recess formed on an outer surface of said at least one container by partially deforming;

wherein said at least one recess is capable of fitting at least one guide protrusion arranged in the cartridge loading chamber, and wherein said plural containers are each rotatable around their respective axes so as to allow for a change in location of said at least one recess and thereby present a plurality of patterns for preventing erroneous loading in an automatic photo-processor.

2. The cartridge for photographic processing agents as in claim 1, wherein said holding member is a box in which said plural containers are stored, said box having at least one opening corresponding to said at least one recess in said plural containers stored in said box.

3. The cartridge for photographic processing agents as in claim 2, wherein said at least one container having at least one recess can be stored in said box so as to have said at least one recess disposed to a predetermined direction selected from directions different in recess disposition.

4. The cartridge for photographic processing agents as in claim 1, wherein said holding member is a tie binding said plural containers together.

5. The cartridge for photographic processing agents as in claim 1, wherein each of said containers is a polygonal bottle or a cylinder.

6. The cartridge for photographic processing agents as in claim 5, wherein said polygonal bottle is a tetragonal bottle having four outer side faces that are a part of said outer surface, and wherein said at least one recess is formed on at least one of said four outer side faces.

7. The cartridge for photographic processing agents as in claim 1, wherein said plural containers each have the same structure as each other.

8. The cartridge for photographic processing agents as in claim 1, wherein each said container comprises:

a mouth; and a packing by which said mouth is sealed, in which said its said container is capable of discharging and supplying a photographic processing agent filled therein container to the automatic photo-processor when each said container is installed in the automatic photo-processor by turning its said mouth down, and into each said mouth a washing nozzle mounted on the automatic photo-processor is penetrated through its said packing, and an inside of each said container is washed by a washing liquid sprayed from each washing nozzle, wherein each said container has at least one recess on an outer side face thereof for preventing each said from erroneously loading in the automatic photo-processor, each said recess being shaped on said outer side face of its container to form a partial concave portion, and wherein said each said recess is disposed at a position above ⅓ of the height of said outer side face measured from a bottom of its container, and each said recess has the maximum depth of ½ or less of the width of its said container in the horizontal cross section.

9. The cartridge for photographic processing agents as in claim 8, each said recess has a curved surface in the vertical cross section.

10. A cartridge for photographic processing agents comprising:

at least one container in the shape of a bottle disposed in said cartridge, each container having an elongated body defining an axis, a bottom, a shoulder, and a relatively narrow neck having a mouth at a terminating end thereof, each said container having at least one recess on an outer side face thereof for preventing said cartridge from erroneously loading to an automatic photo-processor, and each said container being filled with a photographic processing agent therein wherein said cartridge is capable of discharging and supplying each said photographic processing agent to the automatic photo-processor, by being installed in a cartridge loading chamber of the automatic photo-processor by turning said mouth of each said container down, and wherein each said container is rotatable around its axis so as to allow for a change in location of each said recess and thereby present a plurality of patterns for preventing erroneous loading in an automatic photo-processor.

11. The cartridge for photographic processing agents as in claim 10, wherein each said mouth is sealed by a packing into which a washing nozzle mounted on the automatic photo-processor is penetrated so as to discharge and supply its photographic processing agent to the automatic photo-processor when said cartridge is installed in the cartridge loading chamber of the automatic photo-processor.

12. The cartridge for photographic processing agents as in claim 11, wherein an inside of each said container is washed by a washing liquid sprayed from the washing nozzle.

13. The cartridge for photographic processing agents as in claim 10, wherein each said recess is disposed at a position above ⅓ of the height of an outer side face of its said container measured from its said bottom, and each said recess has the maximum depth of ½ or less of the width of its said container in the horizontal cross section.

14. The cartridge for photographic processing agents as in claim 10, wherein its said recess has a curved surface in the vertical cross section.

15. The cartridge for photographic processing agents as in claim 10, wherein each said container further comprises a packing by which its said mouth is sealed, in which each said container is capable of discharging and supplying a photographic processing agent filled therein to the automatic photo-processor when each said container is installed in the automatic photo-processor by turning its said mouth down, and into each said mouth a washing nozzle mounted on the automatic photo-processor is penetrated through its said packing, and an inside of each said container is washed by a washing liquid sprayed from each washing nozzle, wherein each said container has at least one recess on an outer side face thereof for preventing said each container from erroneously loading in the automatic photo-processor, each said recess being shaped on said outer side face of its container to form a partial concave portion, and wherein said at least one recess is disposed at a position above ⅓ of the height of said outer side face of said at least one container measured from a bottom of said at least one container, and said at least one recess has the maximum depth of ½ or less of the width of said at least one container in the horizontal cross section.

16. The cartridge for photographic processing agents as in claim 15, wherein said at least one recess has a curved surface in the vertical cross section.

* * * * *

UNITED STATES PATENT AND TRADEMARK OFFICE

CERTIFICATE OF CORRECTION

PATENT NO. : 7,234,592 B2
APPLICATION NO. : 11/049710
DATED : June 26, 2007
INVENTOR(S) : Hiroki Ide et al.

It is certified that error appears in the above-identified patent and that said Letters Patent is hereby corrected as shown below:

Col. 30, lines 1 – 24; should read;

8. The cartridge for photographic processing agents as in claim 1, wherein each said container comprises:

a mouth; and a packing by which said mouth is sealed, in which ~~said~~ its said container is capable of discharging and supplying a photographic processing agent filled therein ~~container~~ to the automatic photo-processor when each said container is installed in the automatic photo-processor by turning its said mouth down, and into each said mouth a washing nozzle mounted on the automatic photo-processor is penetrated through its said packing, and an inside of each said container is washed by a washing liquid sprayed from each washing nozzle, wherein ~~said~~ each said container has at least one recess on an outer side face thereof for preventing each said <u>container</u> from erroneously loading in the automatic photo-processor, each said recess being shaped on said outer side face of its container to form a partial concave portion, and wherein ~~said~~ each said recess is disposed at a position above $^1/_3$ of the height of said outer side face measured from a bottom of its container, and each said recess has the maximum depth of $^1/_2$ or less of the width of its said container in the horizontal cross section.

Col. 30, lines 25 – 27; should read;

9. The cartridge for photographic processing agents as in claim 8, <u>wherein</u> each said recess has a curved surface in the vertical cross section.

Col. 30, lines 65 – 67; should read;

14. The cartridge for photographic processing agents as in claim 10, wherein ~~its~~ <u>each</u> said recess has a curved surface in the vertical cross section.

UNITED STATES PATENT AND TRADEMARK OFFICE

CERTIFICATE OF CORRECTION

PATENT NO. : 7,234,592 B2
APPLICATION NO. : 11/049710
DATED : June 26, 2007
INVENTOR(S) : Hiroki Ide et al.

It is certified that error appears in the above-identified patent and that said Letters Patent is hereby corrected as shown below:

Cols. 31 – 32; lines 1 – 10; should read;

15. The cartridge for photographic processing agents as in Claim 10, wherein each said container further comprises a packing by which its said mouth is sealed, in which each said container is capable of discharging and supplying a photographic processing agent filled therein to the automatic photo-processor when each said container is installed in the automatic photo-processor by turning its said mouth down, and into each said mouth a washing nozzle mounted on the automatic photo-processor is penetrated through its said packing, and an inside or each said container is washed by a washing liquid sprayed from each washing nozzle, wherein each said container has at least one recess on an outer side face thereof for preventing ~~said~~ each said container from erroneously loading in the automatic photo-processor, each said recess being shaped on said outer side face of its container to form a partial concave portion, and wherein ~~said at least one~~ each said recess is disposed at a position above 1/3 of the height of said outer side face ~~of said at least one container~~ measured from a bottom of ~~said at least one~~ its container, and ~~said at least one~~ each said recess has the maximum depth of 1/2 or less of the width of its said ~~at least one~~ container in the horizontal cross section.

Col. 32, lines 11 – 13; should read;

16. The cartridge for photographic processing agents as in claim 15, wherein ~~said at least one~~ each said recess has a curved surface in the vertical cross section.

Signed and Sealed this

Twentieth Day of November, 2007

JON W. DUDAS
*Director of the United States Patent and Trademark Office*